US005356764A

United States Patent [19]

Szajewski et al.

[11] Patent Number: 5,356,764

[45] Date of Patent: Oct. 18, 1994

[54] DYE IMAGE FORMING PHOTOGRAPHIC ELEMENTS

[75] Inventors: Richard P. Szajewski, Rochester; Gary L. House, Victor; Thomas B. Brust; Debra L. Hartsell, both of Rochester; Donald L. Black, Webster; Anne E. Bohan; James P. Merrill, both of Rochester, all of N.Y.

[73] Assignee: Eastman Kodak Company, Rochester, N.Y.

[21] Appl. No.: 69,236

[22] Filed: Jun. 1, 1993

Related U.S. Application Data

[63] Continuation-in-part of Ser. No. 940,404, Sep. 3, 1992, abandoned, which is a continuation-in-part of Ser. No. 826,338, Jan. 27, 1992, abandoned.

[51] Int. Cl.[5] ..... G03C 1/035; G03C 7/305

[52] U.S. Cl. ..... 430/505; 430/544; 430/567; 430/957; 430/955

[58] Field of Search ..... 430/505, 544, 955, 956, 430/957, 958, 959, 960, 567, 569

[56] References Cited

U.S. PATENT DOCUMENTS

| | | | |
|---|---|---|---|
| 4,063,951 | 12/1977 | Bogg . | |
| 4,248,962 | 2/1981 | Lau | 430/382 |
| 4,386,158 | 5/1983 | Mignot | 430/567 |
| 4,399,215 | 8/1983 | Wey | 430/567 |
| 4,400,463 | 8/1983 | Maskasky | 430/434 |
| 4,409,323 | 10/1983 | Sato et al. | 430/544 |
| 4,414,306 | 11/1983 | Wey et al. | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,861,701 | 8/1989 | Burns et al. | 430/543 |
| 4,942,120 | 7/1990 | King et al. | 430/567 |
| 4,960,689 | 10/1990 | Nishikawa et al. | 430/603 |
| 4,983,508 | 1/1991 | Ishiguro et al. | 430/569 |
| 5,217,858 | 6/1993 | Maskasky | 430/567 |

FOREIGN PATENT DOCUMENTS

| | | |
|---|---|---|
| 0354532A3 | 2/1990 | European Pat. Off. . |
| 02/024643 | 1/1990 | Japan . |

OTHER PUBLICATIONS

Endo & Okaji, "An Empirical Rule to Modify the Habit of Silver chloride to form Tabular Grains in an Emulsion", *The Journal of Photographic Science,* vol. 36, pp. 182–188, 1988.

Mumaw & Haugh, "Silver Halide Precipitation Coalescence Processes", *Journal of Imaging Science,* vol. 30, No. 5, Sep./Oct. 1986, pp. 198–209.

Symposium: Torino 1963, *Photographic Science,* Edited by C. Semerano and U. Mazzucato, Focal Press, pp. 52–55.

*Primary Examiner*—Charles L. Bowers, Jr.
*Assistant Examiner*—Mark F. Huff
*Attorney, Agent, or Firm*—Carl O. Thomas

[57] ABSTRACT

A color photographic element having a support bearing at least one radiation sensitive emulsion layer comprising dispersing medium and silver halide grains is disclosed. The emulsion layer is a tabular grain silver halide emulsion layer Wherein at least 50 percent of total grain projected area is accounted for by tabular grains (a) bounded by {100} major faces having adjacent edge ratios of less than 10, (b) each having an aspect ratio of at least 2, and (c) internally at their nucleation site, containing iodide and at least 50 mole percent chloride. The emulsion layer has in reactive association an image dye-forming compound and a compound that contains a photographically useful group and is capable of reacting with oxidized developing agent to thereby release such group. A process for preparing the radiation sensitive tabular grain silver halide emulsions is also described.

20 Claims, 2 Drawing Sheets

2 μm

2 μm

2μm (CONTROL)

DYE IMAGE FORMING PHOTOGRAPHIC ELEMENTS

This is a continuation-in-part of U.S. Ser. No. 940,404, filed Sep. 3, 1992 now abandoned, which is in turn a continuation-in-part of U.S. Ser. No. 826,338, filed Jan. 27, 1992, which was allowed, but forfeited in favor of U.S. Ser. No. 940,404. U.S. Ser. No. 940,404 has, subsequent to this filing, been abandoned in favor of U.S. Ser. No. 34,060, filed Mar. 22, 1993, which was abandoned in favor of U.S. Ser No. 112,489, filed Aug. 25, 1993, now allowed.

FIELD OF THE INVENTION

The invention relates to color photographic elements comprising radiation sensitive tabular grain silver halide emulsion layers.

BACKGROUND

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, could be achieved by employing tabular grain emulsions.

An emulsion is generally understood to be a "tabular grain emulsion" when tabular grains account for at least 50 percent of total grain projected area. A grain is generally considered to be a tabular grain when the ratio of its equivalent circular diameter (ECD) to its thickness (t) is at least 2. The equivalent circular diameter of a grain is the diameter of a circle having an area equal to the projected area of the grain. The term "intermediate aspect ratio tabular grain emulsion" refers to an emulsion which has an average tabular grain aspect ratio in the range of from 5 to 8. The term "high aspect ratio tabular grain emulsion" refers to an emulsion which has an average tabular grain apsect ratio of greater than 8. The term "thin tabular grain" is generally understood to be a tabular grain having a thickness of less than 0.2 μm. The term "ultrathin tabular grain" is generally understood to be a tabular grain having a thickness of 0.06 μm or less. The term "high chloride" refers to grains that contain at least 50 mole percent chloride based on silver. In referring to grains of mixed halide content, the halides are named in order of increasing molar concentrations—e.g., silver iodochloride contains a higher molar concentration of chloride than iodide.

The overwhelming majority of tabular grain emulsions contain tabular grains that are irregular octahedral grains. Regular octahedral grains contain eight identical crystal faces, each lying in a different {111} crystallographic plane. Tabular irregular octahedra contain two or more parallel twin planes that separate two major grain faces lying in {111} crystallographic planes. The {111} major faces of the tabular grains exhibit a threefold symmetry, appearing triangular or hexagonal. It is generally accepted that the tabular shape of the grains is the result of the twin planes producing favored edge sites for silver halide deposition, with the result that the grains grow laterally while increasing little, if any, in thickness after parallel twin plane incorporation.

While tabular grain emulsions have been advantageously employed in a wide variety of photographic and radiographic applications, the requirement of parallel twin plane formation and }111} crystal faces pose limitations both in emulsion preparation and use. These disadvantages are most in evidence in considering tabular grains containing significant chloride concentrations. It is generally recognized that silver chloride grains prefer to form regular cubic grains—that is, grains bounded by six identical {100} crystal faces. Tabular grains bounded by {111} faces in silver chloride emulsions often revert to nontabular forms unless morphologically stabilized.

While tabular grain silver bromide emulsions were known to the art long before the 1980's, Wey U.S. Pat. No. 4,399,215 produced the first tabular grain silver chloride emulsion. The tabular grains were of the twinned type, exhibiting major faces of threefold symmetry lying in {111} crystallographic planes. An ammoniacal double-jet precipitation technique was employed. The thicknesses of the tabular grains were high compared to contemporaneous silver bromide and iodobromide tabular grain emulsions because the ammonia ripening agent thickened the tabular grains. To achieve ammonia ripening it was also necessary to precipitate the emulsions at a relatively high pH, which is known to produce elevated minimum densities (fog) in high chloride emulsions. Further, to avoid degrading the tabular grain geometries sought both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions. The highest average aspect ratio reported in the Examples was 11.

Maskasky U.S. Pat. No. 4,400,463 (hereinafter designated Maskasky I) developed a strategy for preparing a high chloride emulsion containing tabular grains with parallel twin planes and {111} major crystal faces with the significant advantage of tolerating significant internal inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. Tufano et al U.S. Pat. No. 4,804,621 employed di(hydroamino)azines as grain growth modifiers; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

Bogg U.S. Pat. No. 4,063,951 reported the first tabular grain emulsions in which the tabular grains had parallel {100} major crystal faces. The tabular grains of Bogg exhibited square or rectangular major faces, thus lacking the threefold symmetry of conventional tabular grain {111} major crystal faces. In the sole example Bogg employed an ammoniacal ripening process for preparing silver bromoiodide tabular grains having aspect ratios ranging from 4:1 to 1:1. The average aspect ratio of the emulsion was reported to be 2, with the highest aspect ratio grain (grain A in FIG. 3) being only 4. Bogg states that the emulsions can contain no more than 1 percent iodide and demonstrates only a 99.5% bromide 0.5% iodide emulsion. Attempts to prepare tabular grain emulsions by the procedures of Bogg have been unsuccessful.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia).

Endo and Okaji, "An Empirical Rule to Modify the Habit of Silver Chloride to form Tabular Grains in an Emulsion", *The Journal of Photographic Science*, Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", *Journal of Imaging Science*, Vol. 30, No. 5, September/October 1986, pp. 198–299, is essentially cumulative with Endo and Okaji, with section IV-B being particularly pertinent.

Symposium: Torino 1963, Photographic Science, Edited by C. Semerano and U. Mazzucato, Focal Press, pp. 52–55, discloses the ripening of a cubic grain silver chloride emulsion for several hours at 77° C. During ripening tabular grains emerged and the original cubic grains were depleted by Ostwald ripening. As demonstrated by Preparation II which follows, after 3 hours of ripening tabular grains account for only a small fraction of the total grain projected area, and only a small fraction of the tabular grains were less than 0.3 μm in thickness. In further investigations going beyond the actual teachings provided extended ripening eliminated many of the smaller cubic grains, but also degraded many of the tabular grains to thicker forms.

Japanese published patent application (Kokai) 02/024,643, laid open Jan. 26, 1990, was cited in a Patent Cooperation Treaty search report as being pertinent to the tabular grain structures defined in the claims, but is in Applicants' view unrelated. The application is directed to a negative working emulsion containing a hydrazide derivative and tabular grains with an equivalent circular diameter of 0.6 to 0.2 μm. Only conventional tabular grain preparations are disclosed and only silver bromide and bromoiodide emulsions are exemplified.

Nishikawa et al U.S. Pat. No. 4,952,491 referred to previously, discloses the use of tabular silver halide emulsions having high chloride contents in color photographic elements. The tabular grains described therein are bounded by {111} major crystal faces, as illustrated in FIGS. 1 and 2 of the patent.

The use of image dye-forming compounds in color photographic elements has been known for many years. Typically these compounds are used in reactive association with silver halide emulsion layers in such elements. During the development process the dye-forming compound reacts with oxidized developing agent to form a dye. The dye density that can be obtained for a specific quantity of developed silver is greatly influenced by the morphology of the silver halide grains in the emulsion layer since larger, more sensitive silver halide grains tend to provide lower dye density than smaller, less light sensitive grains. Accordingly, there is a continuing need for combinations of silver halide emulsions and image dye-forming compounds which can provide both high sensitivity and high dye density formation. This need is especially apparent with silver halide emulsions that have high chloride contents since such high chloride contents typically enable faster and easier processability, including faster and easier development, bleaching and fixing. Unfortunately, silver halide emulsions having high chloride contents which also exhibit high photographic sensitivity have been difficult to prepare.

It is also known that beneficial effects can be achieved when silver halide emulsion layers are used in color photographic elements comprising compounds that contain photographically useful groups that are released upon reaction with oxidized developing agent. Such compounds are used to achieve such desired effects as an interlayer or interimage effect or an image accutance effect. These compounds can be simply referred to as "photographically useful group-releasing compounds", as more fully described hereinafter, and are illustrated in Lau U.S. Pat. No. No. 4,248,962, Sato et al U.S. Pat. No. 4,409,323, Burns et al U.S. Pat. No. 4,861,701 and Szajewki published European Patent Application 354,532. An example of such photographically useful group-releasing compounds are the Development Inhibitor Releasing (DIR) compounds which are known in the photographic art. DIR compounds can release development inhibitors during photographic processing and such inhibitors can be used to provide a variety of photographic effects such as decreasing gamma which can be used to control curve shape. Unfortunately, Development Inhibitor Releasing compounds have limited utility with cubic silver halide emulsions having high chloride contents because such compounds tend to have little impact on latitude or gamma when they are used with such emulsions. Additionally, DIR compounds often cause speed losses with such emulsions.

It is evident that it would be very desirable to have in the art color photographic elements containing radiation sensitive tabular grain emulsion layers that comprise tabular silver halide grains, particularly grains having a high chloride content, in combination with image-forming compounds and photographically useful group-releasing compounds such as DIR compounds that would not be subject to the disadvantages discussed hereinbefore. An objective of this invention is to provide such color photographic elements.

RELATED PATENT APPLICATIONS

Maskasky allowed U.S. Ser. No. 035,349, filed Mar. 22, 1993 as a continuation-in-part of U.S. Ser. No. 955,010, filed Oct. 1, 1992, which is in turn a continuation-in-part of U.S. Ser. No. 764,868, filed Sep. 24, 1991, titled HIGH TABULARITY HIGH CHLORIDE EMULSIONS WITH INHERENTLY STABLE GRAIN FACES, commonly assigned, hereinafter referred to as Maskasky III, discloses high aspect ratio tabular grain high chloride emulsions containing tabular grains that are internally free of iodide and that have {100} major faces. In a preferred form, Maskasky III employs an organic compound containing a nitrogen atom with a resonance stabilized pi electron pair to favor formation of {100} faces.

House, Brust, Hartsell and Black U.S. Ser. No. 034,060, filed Mar. 22, 1993 (abandoned in favor of U.S. Ser. No. 112,489, filed Aug. 25, 1993, now allowed) as a continuation-in-part of U.S. Ser. No. 940,404, filed Sep. 3, 1992 (now abandoned), which is in turn a continuation-in-part of U.S. Ser. No. 826,338, filed Jan. 27, 1992, each commonly assigned, titled HIGH ASPECT RATIO TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride.

Brust, House, Hartsell and Black U.S. Ser. No. 035,009, filed Mar. 22, 1993 and commonly assigned, titled MODERATE ASPECT RATIO TABULAR GRAIN EMULSIONS AND PROCESSES FOR THEIR PREPARATION, (now abandoned in favor of U.S. Ser. No. 112,489, filed Aug. 112,489, filed Aug. 25, 1993, now allowed) discloses radiation sensitive emulsions comprised of a dispersing medium and silver halide grains. At least 50 percent of total grain projected area is accounted for by tabular grains bounded by {100} major faces having adjacent edge ratios of less than 10, each having an aspect ratio of at least 2 and an average aspect ratio of up to 8, and internally at their nucleation site containing iodide and at least 50 mole percent chloride. A process of preparing the emulsions is also disclosed.

House, Brust, Hartsell, Black, Antoniades, Tsaur and Chang U.S. Ser. No. 033,738, filed Mar. 22, 1993 (now abandoned in favor of U.S. Ser. No. 112,489, filed Aug. 112,489, filed Aug. 25, 1993, now allowed) as a continuation-in-part of U.S. Ser. No. 940,404, filed Sep. 3, 1992, which is in turn a continuation-in-part of U.S. Ser. No. 826,338, filed Jan. 27, 1992, (now forfeited) each commonly assigned, titled PROCESSES OF PREPARING TABULAR GRAIN EMULSIONS, discloses processes of preparing emulsions containing tabular grains bounded by {100} major faces of which tabular grains bounded by {100} major faces account for 50 percent of total grain projected area selected on the criteria of adjacent major face edge ratios of less than 10 and thicknesses of less than 0.3 μm and internally at their nucleation site contain iodide and at least 50 mole percent chloride, comprised of the steps of (1) introducing silver and halide salts into the dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (2) following nucleation completing grain growth under conditions that maintain the {100} major faces of the tabular grains until the tabular grains exhibit an average aspect ratio of greater than 8.

Puckett U.S. Ser. No. 033,739, filed Mar. 22, 1993 (now abandoned in favor of U.S. Ser. No. 112,489, filed Aug. 112,489, filed Aug. 25, 1993, now allowed) and commonly assigned, titled OLIGOMER MODIFIED TABULAR GRAIN EMULSIONS discloses radiation sensitive emulsions and processes for their preparation. At least 50 percent of total grain projected area is accounted for by high chloride tabular grains bounded by {100} major faces having adjacent edge ratios of less than 10, each having an aspect ratio of at least 2 and containing on average at least one pair of metal ions chosen from group VIII, periods 5 and 6, at adjacent cation sites in their crystal lattice.

Brust, House, Hartsell, Black, Marchetti and Budz U.S. Ser. No. 034,982, filed Mar. 22, 1993 (now abandoned in favor of U.S. Ser. No. 112,489, filed Aug. 112,489, filed Aug. 25, 1993, now allowed) as a continuation-in-part of U.S. Ser. No. 940,404, filed Sep. 3, 1992 (now abandoned), which is in turn a continuation-in-part of U.S. Ser. No. 826,338, filed Jan. 27, 1992 (now forfeited), each commonly assigned, titled COORDINATION COMPLEX LIGAND MODIFIED TAB- ULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride. The tabular grain contain non-halide coordination complex ligands.

Budz, Ligtenberg and Roberts U.S. Ser. No. 034,050, filed Mar. 22, 1993 and commonly assigned, titled DIGITAL IMAGING WITH TABULAR GRAIN EMULSIONS, discloses digitally imaging photographic elements containing tabular grain emulsions comprised of a dispersing medium and silver halide grains containing at least 50 mole percent chloride based on silver. At least 50 percent of total grain projected area is accounted for by tabular grains bounded by {100} major faces having adjacent edge ratios of less than 10, each having an aspect ratio of at least 2.

Szajewski allowed U.S. Ser. No. 034,061, filed Mar. 22, 1993 and commonly assigned, titled FILM AND CAMERA, discloses roll films and roll film containing cameras containing at least one emulsion layer is present containing tabular grain emulsions comprised of a dispersing medium and silver halide grains containing at least 50 mole percent chloride based on silver. At least 50 percent of total grain projected area is accounted for by tabular grains bounded by {100} major faces having adjacent edge ratios of less than 10, each having an aspect ratio of at least 2.

Lok and Budz U.S. Ser. No. 034,317, filed Mar. 22, 1993 (now abandoned in favor of U.S. Ser. No. 112,489, filed Aug. 112,489, filed Aug. 25, 1993, now allowed) and commonly assigned, titled TABULAR GRAIN EMULSIONS CONTAINING ANTIFOGGANTS AND STABILIZERS discloses tabular grain emulsions comprised of a dispersing medium, silver halide grains containing at least 50 mole percent chloride based on silver and at least one selected antifoggant or stabilizer. At least 50 percent of total grain projected area is accounted for by tabular grains bounded by {100} major faces having adjacent edge ratios of less than 10, each having an aspect ratio of at least 2.

Maskasky U.S. Ser. No. 034,998, filed Mar. 22, 1993 and commonly assigned, titled MODERATE ASPECT RATIO TABULAR GRAIN HIGH CHLORIDE EMULSIONS WITH INHERENTLY STABLE GRAIN FACES now U.S. Pat. No. 5,264.337, discloses an emulsion containing a grain population internally free of iodide at the grain nucleation site and comprised of at least 50 mole percent chloride. At least 50 percent of the grain population projected area is accounted for by {100} tabular grains each having an aspect ratio of at least 2 and together having an average aspect ratio of up to 7.5.

Buchanan and Szajewski U.S. Ser. No. 035,347, filed Mar. 22, 1993 and commonly assigned, titled METHOD OF PROCESSING PHOTOGRAPHIC ELEMENTS CONTAINING TABULAR GRAIN EMULSIONS, discloses a process of developing and desilvering a dye image forming photographic element containing a high chloride {100} tabular grain emulsions of the type herein disclosed.

SUMMARY OF THE INVENTION

In accordance with this invention, we have found that novel tabular grain silver halide emulsions containing tabular grains bounded by {100} major faces which are described in greater detail hereinafter, have a unique morphology that makes them particularly useful in color photographic elements. Accordingly, in one aspect, this invention is directed to a color photographic element having a support bearing at least one radiation sensitive emulsion layer comprising dispersing medium and silver halide grains, and having in reactive association an image dye-forming compound. At least 50 percent of the total grain projected area is accounted for by tabular grains that are (a) bounded by {100} major faces having adjacent edge ratios of less than 10, (b) each having an aspect ratio of at least 2, and (c) internally at their nucleation site containing iodide and at least 50 mole percent chloride. The emulsion layer is also in reactive association with a compound that contains a photographically useful group and is capable of reacting with oxidized developing agent to thereby release such group.

An important feature of this invention is that the color photographic elements can be developed in conventional color processing techniques to obtain processed elements exhibiting exceptional image sharpness. Furthermore, as illustrated by the following Examples, color photographic elements of this invention which comprise photographically useful groups such as development inhibitor groups that are released upon reaction with oxidized developing agent, provide desirable reductions in gamma simultaneously with large increases in latitude which are completely unexpected in light of the results obtained with prior art silver halide emulsions comprising comparable cubic silver halide grains. Also, as illustrated by the following Examples, this invention provides excellent flexibility in choosing a desired specific photographic activity since a wide variety of compounds which release photographically useful groups can be used in the practice of this invention. For example, suitable photographically useful groups include development inhibitors, development accelerators, bleach inhibitors, bleach accelerators, electron transfer agents or couplers such as competing couplers.

The present invention has been facilitated by the discovery of a novel approach to forming tabular grains. Instead of introducing parallel twin planes in grains as they are being formed to induce tabularity and thereby produce tabular grains with {111} major faces, it has been discovered that the presence of iodide in the dispersing medium during a high chloride nucleation step coupled with maintaining the chloride ion in solution within a selected pCl range results in the formation of a tabular grain emulsion in which the tabular grains are bounded by {100} crystal faces.

The above approach to forming tabular grains places within the reach of the art tabular grains bounded by {100} crystal faces with grain compositions and grain thicknesses that have not been heretofore realized. For example, one can obtain an ultrathin tabular grain emulsion in which the grains are bounded by {100} crystal faces. In a preferred form, the process described herein can be used to provide intermediate and high aspect ratio tabular grain high chloride emulsions exhibiting high levels of grain stability. Unlike high chloride tabular grain emulsions in which the tabular grains have {111} major faces, such emulsions do not require a morphological stabilizer adsorbed to the major faces of the grains to maintain their tabular form. Finally, while clearly applicable to high chloride emulsions, the process used to form the tabular grain silver halide emulsions used in the practice of this invention extends beyond high chloride emulsions to those containing a wide range of bromide, iodide and chloride concentrations.

DESCRIPTION OF PREFERRED EMBODIMENT

Figure 1:
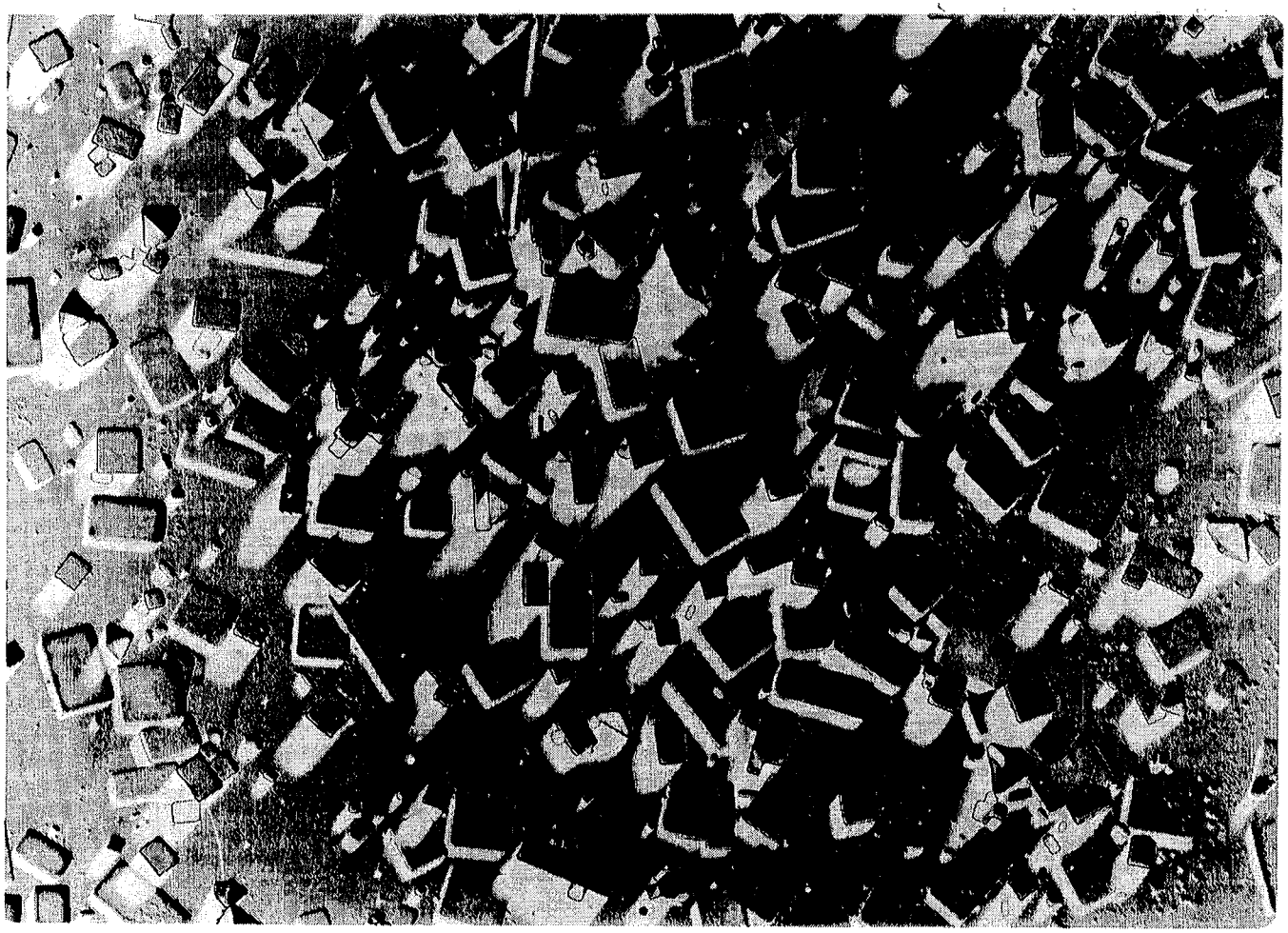
FIG. 1 is a shadowed photomicrograph of carbon grain replicas of a representative emulsion prepared according to Illustrative Emulsion Preparation, Preparation I, which is a typical emulsion useful in the color photographic elements of this invention.

The identification of tabular grain silver halide emulsions satisfying the requirements necessary for use in color photographic elements of this invention can be better appreciated by considering a representative tabular grain emulsion. FIG. 1 is a shadowed photomicrograph of carbon grain replicas of such an emulsion, prepared as described in detail in Preparation I of Illustrative Emulsion Preparation which follows. It is immediately apparent from FIG. 1 that most of the grains have orthogonal tetragonal (square or rectangular) faces. The orthogonal tetragonal shape of the grain faces indicates that they are {100} crystal faces.

The projected areas of the few grains in the sample that do not have square or rectangular faces are noted for inclusion in the calculation of the total grain projected area, but these grains clearly are not part of the tabular grain population having {100} major faces.

A few grains may be observed that are acicular or rod-like grains (hereinafter referred as rods). These grains are more than 10 times longer in one dimension than in any other dimension and can be excluded from the desired tabular grain population based on their high ratio of edge lengths. The projected area accounted for by the rods is low, but when rods are present, their projected area is noted for determining total grain projected area.

The grains remaining all have square or rectangular major faces, indicative of {100} crystal faces. To identify the tabular grains it is necessary to determine for each grain its ratio of ECD to thickness (t)—i.e., ECD/t. ECD is determined by measuring the projected area (the product of edge lengths) of the upper surface of each grain. From the grain projected area the ECD of the grain is calculated. Grain thickness is commonly determined by oblique illumination of the grain population resulting in the individual grains casting shadows. From a knowledge of the angle of illumination (the shadow angle) it is possible to calculate the thickness of a grain from a measurement of its shadow length. The grains having square or rectangular faces and each having a ratio of ECD/t of at least 2 are tabular grains having {100} major faces. When the projected areas of the {100} tabular grains account for at least 50 percent of total grain projected area, the emulsion is a tabular grain emulsion.

In the emulsion of FIG. 1 tabular grains account for more than 50 percent of total grain projected area. From the preceding definition of a tabular grain, it is apparent that the average aspect ratio of the tabular grains can only approach 2 a minimum limit. In fact, tabular grain emulsions used in the practice of this invention typically exhibit average aspect ratios of 5 or more, with high average aspect ratios greater than 8 being preferred. That is, preferred emulsions used in the invention are high aspect ratio tabular grain emulsions. In specifically preferred emulsions, average aspect ratios of the tabular grain population are at least 12 and optimally at least 20. Typically the average aspect ratio of the tabular grain population ranges up to 50, but higher aspect ratios of 100, 200 or more can be realized. Emulsions in which the average aspect ratio approaches the minimum average aspect ratio limit of 2 still provide a surface to volume ratio that is 200 percent that of cubic grains.

The tabular grain population can exhibit any grain thickness that is compatible with the average aspect ratios noted hereinbefore. However, particularly when the selected tabular grain population exhibits a high average aspect ratio, it is preferred to additionally limit the grains included in the selected tabular grain population to those that exhibit a thickness of less than 0.3 μm and, optimally, less than 0.2 μm. It is appreciated that the aspect ratio of a tabular grain can be limited either by limiting its equivalent circular diameter or increasing its thickness. Thus, when the average aspect ratio of the tabular grain population is in the range of from 2 to 8, the tabular grains accounting for at least 50 percent of total grain projected area can also each exhibit a grain thickness of less than 0.3 μm or less than 0.2 μm. Nevertheless, in the aspect ratio range of from 2 to 8 particularly, there are specific benefits that can be gained by greater tabular grain thicknesses. For example, in constructing a blue recording emulsion layer of maximum achievable speed it is specifically contemplated that tabular grain thicknesses that are on average 1 μm or or even larger can be used. This is because the eye is least sensitive to the blue record and hence higher levels of image granularity (noise) can be tolerated without objection. There is an additional incentive for employing larger grains in a blue record since it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient.

The tabular grain population preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form of the invention the tabular grain population accounting for at least 50 percent of total grain projected area is provided by tabular grains also exhibiting 0.2 μm thicknesses. In other words, the emulsions are in this instance thin tabular grain emulsions.

A significant feature of the emulsion preparation technique described herein is that it can be used to provide ultrathin tabular grain emulsions satisfying the requirements needed for use in the color photographic elements of the invention. Ultrathin tabular grain emulsions are those in which the selected tabular grain population is made up of tabular grains having thicknesses of less than 0.06 μm. Prior to discovery of the present technique, the only ultrathin tabular grain emulsions known in the art that had a halide content exhibiting a cubic crystal lattice structure contained tabular grains bounded by {111} major faces. Thus, it was thought essential to form tabular grains by the mechanism of parallel twin plane incorporation to achieve ultrathin dimensions. Emulsions prepared as described herein can have a tabular grain population ,with a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, the ultrathin tabular grain emulsions described herein can have entirely negligible levels of blue sensitivity, and are therefore capable of providing a green or red record in a color photographic element that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers (μm); and t is grain thickness in micrometers.

The selected tabular grain population accounting for 50 percent of total grain projected area as described herein preferably exhibits a tabularity of greater than 25 and most preferably greater than 100. Since the tabular grain population can be ultrathin, it is apparent that extremely high tabularities, ranging to 1000 and above are within the contemplation of our invention.

The tabular grain population can exhibit an average ECD of any photographically useful magnitude. For photographic utility average ECD's of less than 10 μm are contemplated, although average ECD's of the tabular grain emulsions used in this invention rarely exceed 6 μm. Within ultrathin tabular grain emulsions satisfying the requirements of the invention it is possible to provide intermediate aspect ratios with ECD's of the tabular grain population of 0.10 μm and less. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

So long as the population of tabular grains satisfying the parameters described previously herein accounts for at least 50 percent of total grain projected area a photographically desirable grain population is available. It is recognized that the advantageous properties of the emulsions used in the invention are increased as the proportion of tabular grains having {100} major faces is increased. The preferred emulsions used in the color photographic elements of the invention are those in which at least 70 percent and optimally at least 90 percent of total grain projected area is accounted for by tabular grains having {100} major faces.

So long as tabular grains having the desired characteristics described herein account for the requisite proportion of the total grain projected area, the remainder of the total grain projected area can be accounted for by any combination of coprecipitated grains. It is, of course, common practice in the art to blend emulsions to achieve specific photographic objectives. Blended emulsions in which at least one component emulsion satisfies the tabular grain description described herein are specifically contemplated.

If tabular grains satisfying the tabular grain population requirements do not account for 50 percent of the total grain projected area, the emulsion does not satisfy the requirements of the invention and is, in general, a photographically inferior emulsion. For most applications (particularly applications that require spectral sensitization, require rapid processing and/or seek to minimize silver coverages) emulsions are photographically inferior in which many or all of the tabular grains are relatively thick—e.g., emulsions containing high proportions of tabular grains with thicknesses in excess of 0.3 μm.

Figure 2:
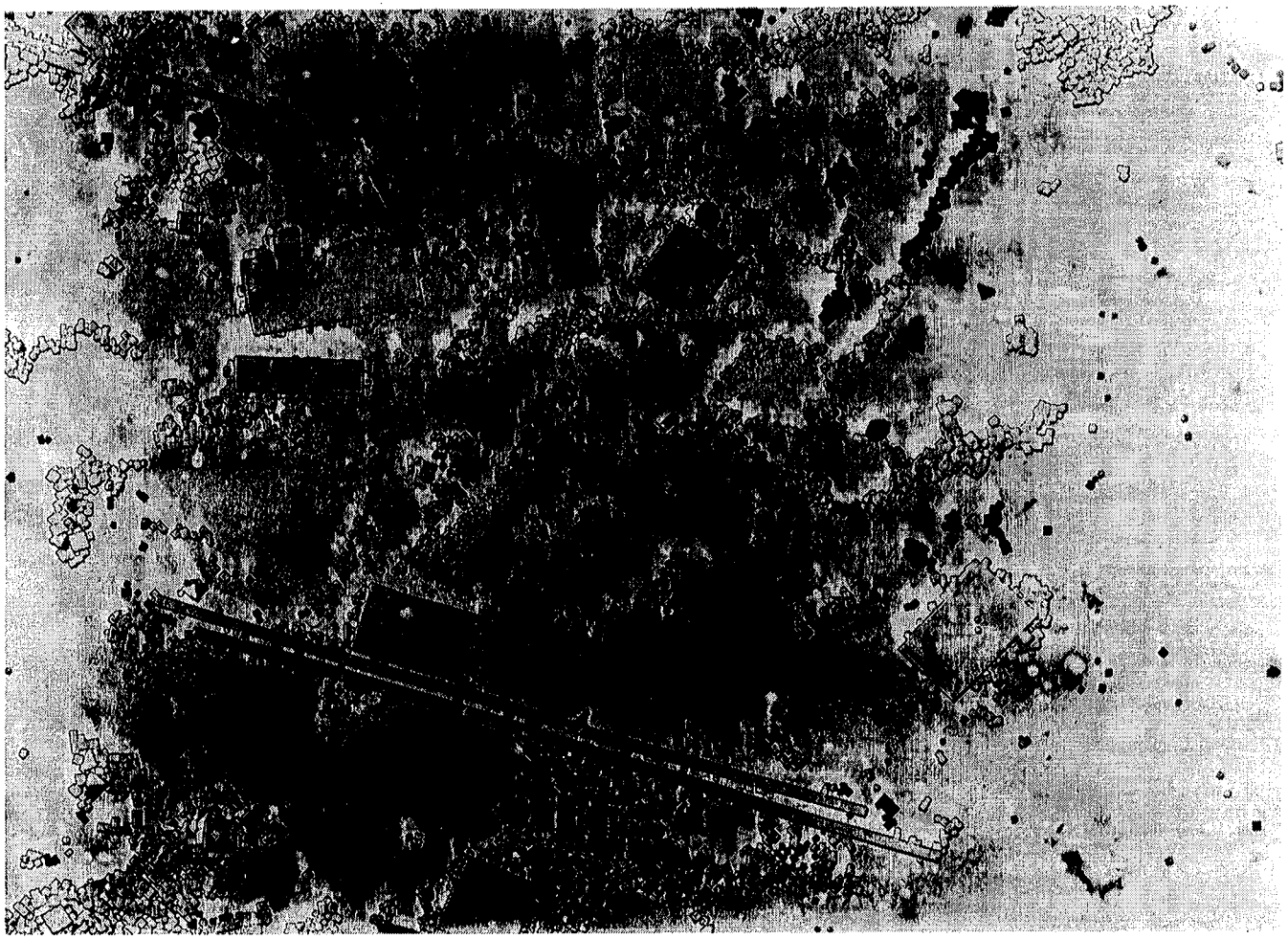
FIG. 2 is a shadowed photomicrograph of carbon grain replicas of a control emulsion prepared according to Illustrative Emulsion Preparation, Preparation II.

More commonly, inferior emulsions failing to satisfy the requirements of the invention have an excessive proportion of total grain projected area accounted for by cubes, twinned nontabular grains, and rods. Such an emulsion is shown in FIG. 2. Most of the grain projected area is accounted for by cubic grains. Also the rod population is much more pronounced than in FIG. 1. A few tabular grains are present, but they account for only a minor portion of total grain projected area.

The tabular grain emulsion of FIG. 1 satisfying the requirements of the invention and the predominantly cubic grain emulsion of FIG. 2 were prepared under conditions that were identical, except for iodide management during nucleation. The FIG. 2 emulsion is a silver chloride emulsion while the emulsion of FIG. 1 additionally includes a small amount of iodide. The details of the preparations are provided in the following Illustrative Emulsion Preparation section.

Obtaining emulsions satisfying the requirements of the invention has been achieved by the discovery of a novel precipitation process. In this process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more growth accelerating irregularities in one or more of the cubic crystal faces. The cubic crystal faces that contain at least one irregularity thereafter accept silver halide at an accelerated rate as compared to the regular cubic crystal faces (i.e., those lacking an irregularity). When only one of the cubic crystal faces contains an irregularity, grain growth on only one face is accelerated, and the resulting grain structure on continued growth is a rod. The same result occurs when only two opposite parallel faces of the cubic crystal structure contain irregularities. However, when any two contiguous cubic crystal faces contain an irregularity, continued growth accelerates growth on both faces and produces a tabular grain structure. It is believed that the tabular grains of the emulsions used in this invention are produced by those grain nuclei having two, three or four faces containing growth accelerating irregularities.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is preferably introduced into the dispersing medium concurrently with or, optimally, before opening the silver jet. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In a preferred method silver iodochloride grain nuclei are formed during the nucleation step. Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth previously no additional chloride ion need be added to the dispersing medium during the nucleation step- It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as alkali or alkaline earth halide, such as lithium, sodium and/or potassium chloride, bromide and/or iodide.

It is possible, but not preferred, to introduce silver chloride or silver iodochloride Lippmann grains into the dispersing medium during the nucleation step. In this instance grain nucleation has already occurred and what is referred to previously as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed previously and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., $<7.0$). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England. While synthetic polymeric peptizers of the type disclosed by Maskasky I, cited previously and here incorporated by reference, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky II and King et al, cited herein, the disclosures of which are here incorporated by reference. However, it should be noted that the grain growth modifiers of the type taught for inclusion in the emulsions of Maskasky I and II (e.g., adenine) are not appropriate for inclusion in the dispersing media used in the method described herein, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100} major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described herein for use in the invention.

In its simplest form the process of preparing the desired emulsions can be performed as a single jet precipitation without interrupting silver ion introduction from start to finish. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, single jet precipitation limits halide content and profiles and generally results in more polydisperse grain populations.

It is usually preferred to prepare photographic emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of the desired emulsions it is preferred to interrupt silver and halide salt introductions at the conclusion of the nucleation step and before proceeding to the growth step that brings the emulsions to their desired final size and shape. The emulsions are held within the temperature ranges described above for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, grain growth can proceed according to any convenient conventional precipitation technique for the precipitation of silver halide grains bounded by {100} grain faces. Whereas iodide and chloride ions are required to be incorporated into the grains during nucleation and are therefore present in the completed grains at the internal nucleation site, any halide or combination of halides known to form a cubic crystal lattice structure can be employed during the growth step. Neither iodide nor chloride ions need be incorporated in the grains during the growth step, since the irregular grain nuclei faces that result in tabular grain growth, once introduced, persist during subsequent grain growth independently of the halide being precipitated, provided the halide or halide combination is one that forms a cubic crystal lattice. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride. When silver bromide or silver iodobromide is being deposited during the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing the nucleation step.

It has been discovered quite unexpectedly that up to 20 percent reductions in tabular grain thicknesses can be realized by specific halide introductions during grain growth. Surprisingly, it has been observed that bromide additions during the growth step in the range of from 0.05 to 15 mole percent, preferably from 1 to 10 mole percent, based on silver, produce relatively thinner {100} tabular grains than can be realized under the same conditions of precipitation in the absence of bromide ion. Similarly, it has been observed that iodide additions during the growth step in the range of from 0.001 to $<1$ mole percent, based on silver, produce relatively thinner {100} tabular grains than can be realized under the same conditions of precipitation in the absence of iodide ion.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering*, Vol. 21, No. 1, January/Feburary 1977, p. 14, et seq.

In the simplest form of the grain preparation the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described above. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990).

The emulsions used in the color photographic elements of the invention include silver iodochloride emulsions, silver iodobromochloride emulsions and silver iodochlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium, rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S. Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", *Photographic Science and Engineering*, Vol. 24, NO. 6, November/December 1980, pp. 265–257, and Grzeskowiak et al published European Patent Application 0 264 288.

The novel precipitation process is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to non-tabular forms. Particularly preferred high chloride emulsions are those that contain more than 70 mole percent (optimally more than 90 mole percent) chloride.

Although not essential, a further procedure that can be employed to maximize the population of tabular grains having {100} major faces is to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized pi electron pair. Resonance stabilization prevents protonation of the nitrogen atom under the relatively acid conditions of precipitation.

Aromatic resonance can be relied upon for stabilization of the $\pi$ electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

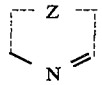

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

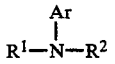

where

Ar is an aromatic ring structure containing from 5 to 14 carbon atoms and $R^1$ and $R^2$ are independently hydrogen, Ar, or any convenient aliphatic group or together complete a five or six membered ring.

Ar is preferably a carbocyclic aromatic ring, such as phenyl or naphthyl. Alternatively any of the nitrogen and carbon containing aromatic rings noted above can be attached to the nitrogen atom of formula II through a ring carbon atom. In this instance, the resulting compound satisfies both formulae I and II. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oxygen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae I and/or II:

R-1

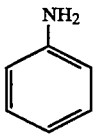

aniline

RA-2

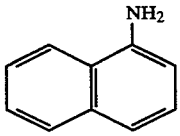

a-naphthylamine

RA-3

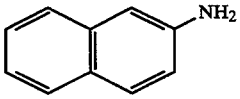

b-naphthylamine

RA-4

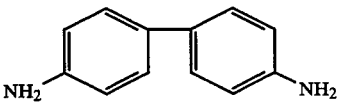

benzidine

-continued

RA-5

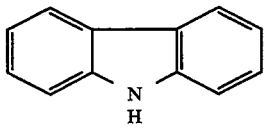

carbazole

RA-6

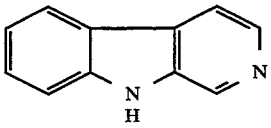

norharman

RA-7

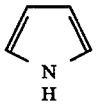

pyrrole

RA-8

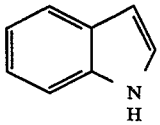

indole

RA-9

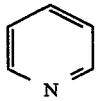

pyridine

RA-10

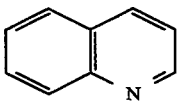

quinoline

RA-11

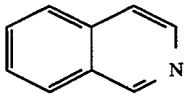

isoquinoline

RA-12

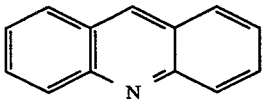

acridine

RA-13

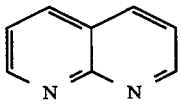

1,8-naphthyridine

-continued

RA-14

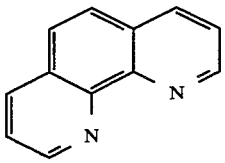

1,10-phenanthroline

RA-15

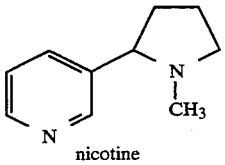

nicotine

RA-16

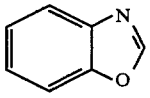

benzoxazole

RA-17

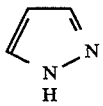

pyrazole

RA-18

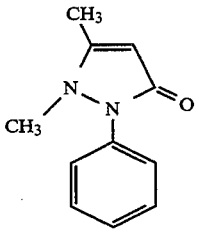

antipyrine

RA-19

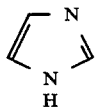

imidazole

RA-20

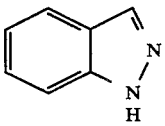

indazole

RA-21

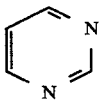

pyrimidine

RA-22

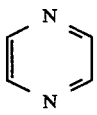

pyrazine

-continued

RA-23

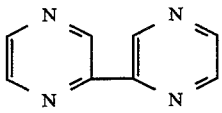

2,2'-bipyrazine

RA-24

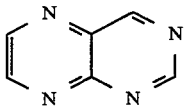

pteridine

RA-25

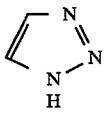

1,2,3-triazole

RA-26

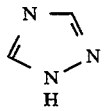

1,2,4-triazole

RA-27

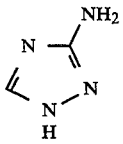

3-amino-1,2,4-triazole

RA-28

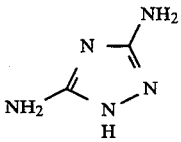

3,5-diamino-1,2,4-triazole

RA-29

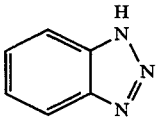

benzotriazole

RA-30

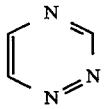

1,2,4-triazine

RA-31

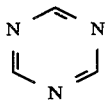

1,3,5-triazine

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by Br−Ions", Parts I and II, *Journal of Colloid and Interface Science*, Vol. 140, No. 2, December 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference.

The emulsions used in this invention can be chemically sensitized with active gelatin as illustrated by T. H. James, *The Theory of the Photographic Process*, 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30 to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent No. 1,396,696; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1

Anhydro-5'-chloro-3'-di-(3-sulfopropyl)naphtho[1,2-d]-thiazolothiacyanine hydroxide, sodium salt

SS-2

Anhydro-5'-chloro-3'-di-(3-sulfopropyl)naphtho[1,2-d]-oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-di-(trifluoromethyl)-3-(4-sulfobuyl)-3'-(2,2,2-trifluoroethyl)benzimidazolocarbocyanine hydroxide

SS-6

Anhydro-3,3'-(2-methoxyethyl)-5,5'-diphenyl-9-ethyloxacarbocyanine, sodium salt

SS-7

Anhydro-11-ethyl-1,1'-di-(3-sulfopropyl)naphtho[1,2-d]-oxazolocarbocyanine hydroxide, sodium salt

SS-8

Anhydro-5,5'-dichloro-9-ethyl-3,3'-di-(3-sulfopropyl)-oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-di-(2-sulfoethylcarbamoylmethyl)thioacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-di-(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)
-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

3-Ethyl-6,6'-dimethyl-3'-pentyl-9.11-neopentylenethiadicarbocyanine bromide

SS-19

Anhydro-3-ethyl-9,11-neopentylene-3'-(3-sulfopropyl)-thiadicarbocyanine hydroxide

SS-20

Anhydro-3-ethyl-11,13-neopentylene-3'-(3-sulfopropyl)-oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, sodium salt

SS-22

Anhydro-5,5'-diphenyl-3,3'-di-(3-sulfobutyl)-9-ethyloxacarbocyanine hydroxide, sodium salt

SS-23

Anhydro-5,5'-dichloro-3,3'-di-(3-sulfopropyl)-9-ethylthiacarbocyanine hydroxide, tetraethylammonium salt

SS-24

Anhydro-5,5'-dimethyl-3,3'-di-(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]-thiazolocarbocyanine hydroxide, triethylammonium salt

SS-26

Anhydro-11-ethyl-1,1'-di-(3-sulfopropyl)naphth[1,2-d]-oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-di-(3-sulfopropyl)-5,5'-bis(trifluoromethyl)benzimidazolocarbocyanine hydroxide, sodium salt

SS-29

Anhydro-5'-chloro-5-phenyl-3,3'-di-(3-sulfopropyl)-oxathiacyanine hydroxide, sodium salt

SS-30

Anhydro-5,5'-dichloro-3,3'-di-(3-sulfopropyl)thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)-ethylidene]-3-phenylthiohydantoin

SS-33

4-[2-((1,4-Dihydro-1-dodecylpyridin-ylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-{2-{3-(2-methoxyethyl)-5-[(2-methoxyethyl)sulfonamido]-benzoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium]dichloride

SS-42

Anhydro-4-{2-[3-(3-sulfopropyl)thiazolin-2-ylidene]-ethylidene}-2-{3-[3-(3-sulfopropyl)thiazolin-2-ylidene]propenyl-5-oxazolium, hydroxide, sodium salt

SS-43

3-Carboxymethyl-5-{3-carboxymethyl-4-oxo-5-methyl1,3,4-thiadiazolin-2-ylidene)ethylidene]thiazolin-2-ylidene}rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)-methyl]-[(1,5-dimethylnaphtho[1,2-d]selenazolin-2-ylidene)methyl]methylene}rhodanine

SS-48

5-{Bis[(3-ethyl-5,6-dimethylbenzothiazolin-2-ylidene)-methyl]methylene}-1,3-diethyl-barbituric acid

SS-49

3-Ethyl-5-{[(3-ethyl-5-methylbenzotellurazolin-2ylidene)methyl][1-ethylnaphtho[1,2-d]-tellurazolin-2-ylidene)methyl]methylene}rhodanine

SS-50

Anhydro-5,5'-diphenyl-3,3'-di-(3-sulfopropyl)thiacyanine hydroxide, triethylammonium salt

SS-51

Anhydro-5-chloro-5'-phenyl-3,3'-di-(3-sulfopropyl)-thiacyanine hydroxide, triethylammonium salt Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified under a few general headings, as illustrated by C. E. K. Mees, *The Theory of the Photographic Process,* 2Nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Poller et al U.K. Pat. No. 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Helmbach U.S. Pat. No. 2,444,605, Knott U.S. Pat. No. 2,933,388, Williams U.S. Pat. No. 3,202,512, *Research Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Pat. No. 2,296,204, polymers of 1,3-dihydroxy(and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Pat. No. 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta- and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 897,497 and Stevens et al U.K. Patent 1,039,471, and quinoline derivatives as illustrated by Dersch et al U.S. Pat. No. 3,446,618.

Among stabilizers useful in protecting the emulsion layers against dichroic-fog are addenda such as salts of nitton as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic Silver Halide Emulsions*, Focal Press, London, 1974, pp. 126–218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives as illustrated by Herz et al U.S. Pat. No. 3,220,839, and thiodiazole derivatives as illustrated by yon Konig U.S. Pat. No. 3,364,028 and yon Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et-al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure*, Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the color photographic element of this invention is to be processed at elevated bath or drying temperatures pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure*, Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et al U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by von Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure*, Vol. 136, August, 1975, Item 13651.

Apart from the features that have been specifically discussed previously for the tabular grain emulsion preparation procedures and the tabular grains that they produce, their further use in the color photographic elements of this invention can take any convenient conventional form. Substitution in color photographic elements for conventional emulsions of the same or similar silver halide composition is generally contemplated, with substitution for silver halide emulsions of differing halide composition, particularly other tabular grain emulsions, being also feasible. The low levels of native blue sensitivity of the high chloride {100} tabular grain emulsions allows the emulsions to be employed in any desired layer order arrangement in multicolor photographic elements, including any of the layer order arrangements disclosed by Kofron et al U.S. Pat. No. 4,439,520, the disclosure of which is here incorporated by reference, both for layer order arrangements and for other conventional features of photographic elements containing tabular grain emulsions. Conventional features are further illustrated by the following incorporated by reference disclosures:

ICBR-1 *Research Disclosure*, Vol. 308, December 1989, Item 308,119;

ICBR-2 *Research Disclosure*, Vol. 225, January 1983, Item 22,534;

ICBR-3 Wey et al U.S. Pat. No. 4,414,306, issued Nov. 8, 1983;

ICBR-4 Solberg et al U.S. Pat. No. 4,433,048, issued Feb. 21, 1984;

ICBR-5 Wilgus et al U.S. Pat. No. 4,434,226, issued Feb. 28, 1984;

ICBR-6 Maskasky U.S. Pat. No. 4,435,501, issued Mar. 6, 1984;

ICBR-7 Maskasky U.S. Pat. No. 4,643,966, issued Feb. 17, 1987;

ICBR-8 Daubendiek et al U.S. Pat. No. 4,672,027, issued Jan. 9, 1987;

ICBR-9 Daubendiek et al U.S. Pat. No. 4,693,964, issued Sept. 15, 1987;

ICBR-10 Maskasky U.S. Pat. No. 4,713,320, issued Dec. 15, 1987;

ICBR-11 Saitou et al U.S. Pat. No. 4,797,354, issued Jan. 10, 1989;

ICBR-12 Ikeda et al U.S. Pat. No. 4,806,461, issued Feb. 21, 1989;

ICBR-13 Makino et al U.S. Pat. No. 4,853,322, issued Aug. 1, 1989; and

ICBR-14 Daubendiek et al U.S. Pat. No. 4,914,014, issued Apr. 3, 1990.

Following is a description of the terms "dye image-forming compound" and "photographically useful group-releasing compound", sometimes referred to simply as "PUG-releasing compound", as used herein.

A dye image-forming compound is typically a coupler compound, a dye redox releaser compound, a dye developer compound, an oxichromic developer compound, or a bleachable dye or dye precursor compound. Dye redox releaser, dye developer, and oxichromic developer compounds useful in color photographic elements that can be employed in image transfer processes are described in *The Theory of the Photographic*

*Process,* 4th edition, T. H. James, editor, Macmillan, New York, 1977, Chapter 12, Section V, and in Section XXIII of *Research Disclosure,* December 1989, Item 308119. Dye compounds useful in color photographic elements employed in dye bleach processes are described in Chapter 12, Section IV, of *The Theory of the Photographic Process,* 4th edition.

Preferred dye image-forming compounds are coupler compounds, which react with oxidized color developing agents to form colored products, or dyes. A coupler compound contains a coupler moiety COUP, which is combined with the oxidized developer species in the coupling reaction to form the dye structure. A coupler compound can additionally contain a group, called a coupling-off group, that is attached to the coupler moiety by a bond that is cleaved upon reaction of the coupler compound with oxidized color developing agent. Coupling-off groups can be halogen, such as chloro, bromo, fluoro, and iodo, or organic radicals that are attached to the coupler moieties by atoms such as oxygen, sulfur, nitrogen, phosphorus, and the like.

A PUG-releasing compound is a compound that contains a photographically useful group and is capable of reacting with an oxidized developing agent to release said group. Such a PUG-releasing compound comprises a carrier moiety and a leaving group, which are linked by a bond that is cleaved upon reaction with oxidized developing agent. The leaving group contains the PUG, which can be present either as a preformed species, or as a blocked or precursor species that undergoes further reaction after cleavage of the leaving group from the carrier to produce the PUG. The reaction of an oxidized developing agent with a PUG-releasing compound can produce either colored or colorless products.

Carrier moieties (CAR) include hydroquinones, catechols, aminophenols, sulfonamidophenols, sulfonamidonaphthols, hydrazides, and the like that undergo cross-oxidation by oxidized developing agents. A preferred carrier moiety in a PUG-releasing compound is a coupler moiety COUP, which can combine with an oxidized color developer in the cleavage reaction to form a colored species, or dye when the carrier moiety is a COUP, the leaving group is referred to as a coupling-off group. As described previously for leaving groups in general, the coupling-off group contains the PUG, either as a preformed species or as a blocked or precursor species. The coupler moiety can be ballasted or unballasted. It can be monomeric, or it can be part of a dimeric, oligomeric or polymeric coupler, in which case more than one group containing PUG can be contained in the coupler, or it can form part of a bis compound in which the PUG forms part of a link between two coupler moieties.

The PUG can be any group that is typically made available in a photographic element in an imagewise fashion. The PUG can be a photographic reagent or a photographic dye. A photographic reagent, which upon release further reacts with components in the photographic element as described herein, is a moiety such as a development inhibitor, a development accelerator, a bleach inhibitor, a bleach accelerator, an electron transfer agent, a coupler (for example, a competing coupler, a dye-forming coupler, or a development inhibitor releasing coupler, a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer, or a desensitizer.

The PUG can be present in the coupling-off group as a preformed species or it can be present in a blocked form or as a precursor. The PUG can be, for example, a preformed development inhibitor, or the development inhibiting function can be blocked by being the point of attachment to the carbonyl group bonded to PUG in the coupling-off group. Other examples are a preformed dye, a dye that is blocked to shift its absorption, and a leuco dye.

A PUG-releasing compound can be described by the formula CAR-$(TIME)_n$-PUG, wherein (TIME) is a linking or timing group, n is 0, 1, or 2, and CAR is a carrier moiety from which is released imagewise a PUG (when n is 0) or a PUG precursor (TIME)l-PUG or $(TIME)_2$-PUG (when n is 1 or 2) upon reacting with oxidized developing agent. Subsequent reaction of $(TIME)_1$-PUG or $(TIME)_2$-PUG produces PUG.

Linking groups (TIME), when present, are groups such as esters, carbamates, and the like that undergo base-catalyzed cleavage, including intramolecular nucleophilic displacement, thereby releasing PUG. Where n is 2, the (TIME) groups can be the same or different. Suitable linking groups, which are also known as timing groups, are shown in U.S. Pat. Nos. 5,151,343; 5,051,345; 5,006,448; 4,409,323; 4,248,962; 4,847,185; 4,857,440; 4,857,447; 4,861,701; 5,021,322; 5,026,628, and 5,021,555, all incorporated herein by reference. Especially useful linking groups are p-hydroxphenylmethylene moieties, as illustrated in the previously mentioned U.S. Pat. No. Nos. 4,409,323; 5,151,343 and 5,006,448, and o-hydroxyphenyl substituted carbamate groups, disclosed in U.S. Pat. Nos. 5,151,343 and 5,021,555, which undergo intramolecular cyclization in releasing PUG.

When TIME is joined to a COUP, it can be bonded at any of the positions from which groups are released from couplers by reaction with oxidized color developing agent. Preferably, TIME is attached at the coupling position of the coupler moiety so that, upon reaction of the coupler with oxidized color developing agent, TIME, with attached groups, will be released from COUP.

TIME can also be in a non-coupling position of the coupler moiety from which it can be displaced as a result of reaction of the coupler with oxidized color developing agent. In the case where TIME is in a non-coupling position of COUP, other groups can be in the coupling position, including conventional coupling off groups. Also, the same or different inhibitor moieties from those described in this invention can be used. Alternatively, COUP can have TIME and PUG in each of a coupling position and a non-coupling position. Accordingly, compounds useful in this invention can release more than one mole of PUG per mole of coupler.

TIME can be any organic group which will serve to connect CAR to the PUG moiety and which, after cleavage from CAR, will in turn be cleaved from the PUG moiety. This cleavage is preferably by an intramolecular nucleophilic displacement reaction of the type described in, for example, U.S. Pat. No. 4,248,962, or by electron transfer along a conjugated chain as described in, for example, U.S. Pat. No. 4,409,323.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have both a nucleophilic group and an electrophilic group spatially related by the configuration of the molecule to promote reactive proximity. Preferably, the nucleophilic group and the electrophilic group are located in the compound so that a cyclic organic ring, or a transient cyclic organic ring, can be easily formed by an intramolecular reaction involving the nucleophilic center and the electrophilic center.

Useful timing groups are represented by the structure:

$$\leftarrow\text{Nu-LINK}\rightarrow\text{E}$$

wherein:

Nu is a nucleophilic group attached to a position on CAR from which it will be displaced upon reaction of CAR with oxidized developing agent;

E is an electrophilic group attached to an inhibitor moiety as described and is displaceable therefrom by Nu after Nu is displaced from CAR; and LINK is a linking group for spatially relating Nu and E, upon displacement of Nu from CAR, to undergo an intramolecular nucleophilic displacement reaction with the formation of a 3- to 7-membered ring and thereby release the PUG moiety.

A nucleophilic group (Nu) is defined herein as a group of atoms one of which is electron rich. Such an atom is referred to as a nucleophilic center. An electrophilic group (E) is defined herein as a group of atoms, one of which is electron deficient. Such an atom is referred to as an electrophilic center.

Thus, in PUG-releasing compounds as described herein, the timing group can contain a nucleophilic group and an electrophilic group, which groups are spatially related with respect to one another by a linking group so that, upon release from CAR, the nucleophilic center and the electrophilic center will react to effect displacement of the PUG moiety from the timing group. The nucleophilic center should be prevented from reacting with the electrophilic center until release from the CAR moiety, and the electrophilic center should be resistant to external attack, such as hydrolysis. Premature reaction can be prevented by attaching the CAR moiety to the timing group at the nucleophilic center or an atom in conjunction with a nucleophilic center, so that cleavage of the timing group and the PUG moiety from CAR unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUGs), or precursors thereof, which may remain attached to the timing group or be released.

It will be appreciated that, in the timing group, for an intramolecular reaction to occur between the nucleophilic group and the electrophilic group, the groups should be spatially related after cleavage from CAR so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It will be further appreciated that for an intramolecular reaction to occur in the aqueous alkaline environment encountered during photographic processing, the thermodynamics should be such and the groups be so selected that an overall free energy decrease results upon ring closure, forming the bond between the nucleophilic group and the electrophilic group, and breaking the bond between the electrophilic group and the PUG. Not all possible combinations of nucleophilic group, linking group, and electrophilic group will yield a thermodynamic relationship favorable to breaking of the bond between the electrophilic group and the PUG moiety. However, it is within the skill of the art to select appropriate combinations taking the above energy relationships into account.

Representative Nu groups contain electron rich oxygen, sulfur and nitrogen atoms. Representative m groups contain electron deficient carbonyl, thiocarbonyl, phosphonyl and thiophosphonyl moieties. Other useful Nu and E groups will be apparent to those skilled in the art.

The linking group can be an acyclic group such as alkylene, for example, methylene, ethylene or propylene, or a cyclic group such as an aromatic group, such as phenylene or naphthylene, or a heterocyclic group, such as furan, thophene, pyridine, quinoline or benzoxazine. Preferably, LINK is alkylene or arylene. The groups Nu and E are attached to LINK to provide, upon release of Nu from CAR, a favorable spatial relationship for nucleophilic attack of the nucleophilic center in Nu on the electrophilic center in E. When LINK is a cyclic group, Nu and E can be attached to the same or adjacent rings. Aromatic groups in which Nu and E are attached to adjacent ring positions are particularly preferred LINK groups.

TIME can be unsubstituted or substituted. The substituents can be those which will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkanesulfonamido, and alkylsulfonyl, solubilizing groups, ballast groups and the like, or they can be substituents which are separately useful in the photographic element, such as a stabilizer, an antifoggant, a dye (such as a filter dye or a solubilized masking dye) and the like. For example, solubilizing groups will increase the rate of diffusion; ballast groups will decrease the rate of diffusion; electron withdrawing groups will decrease the rate of displacement of the PUG.

As used herein, the term "electron transfer down a conjugated chain" is understood to refer to transfer of an electron along a chain of atoms in which alternate single bonds and double bonds occur. A conjugated chain is understood to have the same meaning as commonly used in organic chemistry. This further includes TIME groups capable of undergoing fragmentation reactions where the number of double bonds is zero. Electron transfer down a conjugated chain is described in, for example, U.S. Pat. No. 4,409,323.

As previously described, more than one sequential TIME moiety can be usefully employed. Useful TIME moieties can have a finite half-life or an extremely short half-life. The half-life is controlled by the specific structure of the TIME moiety, and may be chosen so as to best optimize the photographic function intended. TIME moiety half-lives of from less than 0.001 second to over 10 minutes are known in the art. TIME moieties having a half-life of over 0.1 second are often preferred for use in PUG-releasing compounds that yield development inhibitor moieties, although use of TIME moieties with shorter half-lives to produce development inhibitor moieties is known in the art. The TIME moiety may either spontaneously liberate a PUG after being released from CAR, or may liberate PUG only after a further reaction with another species present in a process solution, or may liberate PUG during contact of the photographic element with a process solution.

Following is a listing of patents and publications that describe representative coupler compounds that contain COUP groups useful in the invention:

Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999, "Farbkuppler-eine Literaturubersicht," published in Agfa Mitteilungen, Band III, pp. 156–175 (1961), and Section VII D of *Research Disclosure*, Item 308119, December 1989. Preferably such couplers are phenols and naphthols.

Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573, "Farbkuppler-eine Literaturubersicht," published in Agfa Mitteilungen, Band III, pp. 126–156 (1961), and Section VII D of *Research Disclosure*, Item 308119, December 1989. Preferably such couplers are pyrazolones or pyrazolotriazoles.

Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928, "Farbkuppler-eine Literaturubersicht," published in Agfa Mitteilungen, Band III, pp. 112–126 (1961), and Section VII D of *Research Disclosure*, Item 308119, December 1989. Preferably such couplers are acylacetamides, such as benzoylacetamides and pivaloylacetamides.

Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably, such couplers are cyclic carbonyl-containing compounds which react with oxidized color developing agents but do not form dyes.

PUG groups that are useful in the present invention include, for example:

1. PUG's which form development inhibitors upon release

PUG's which form development inhibitors upon release are described in such representative patents as U.S. Pat. Nos. 3,227,554; 3,384,657; 3,615,506; 3,617,291; 3,733,201 and U.K. Pat. No. 1,450,479. Useful development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, oxadiazoles, benzotriazoles, benzodiazoles, oxazoles, thiazoles, diazoles, triazoles, thiadiazoles, oxathiazoles, thiatriazoles, tetrazoles, benzimidazoles, indazoles, isoindazoles, mercaptooxazoles, mercaptothiadiazoles, mercaptothiazoles, mercaptotriazoles, mercaptooxadiazoles, mercaptodiazoles, mercaptooxathiazoles, tellurotetrazoles, or benzisodiazoles. Structures of typical development inhibitor moieties are:

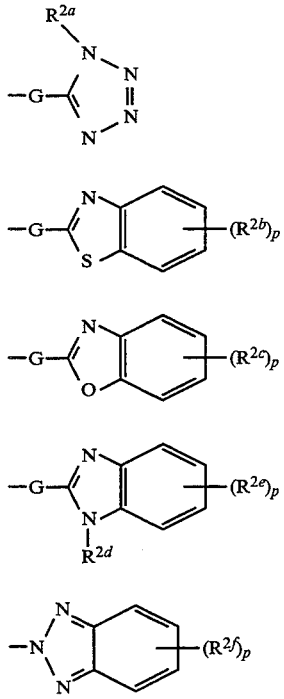

-continued

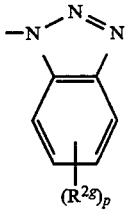

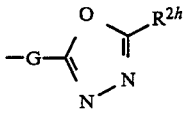

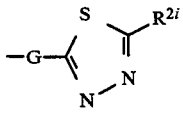

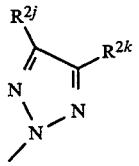

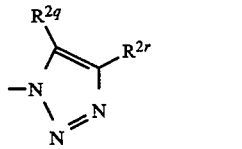

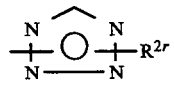

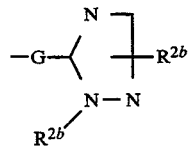

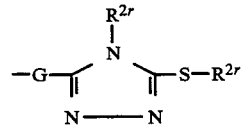

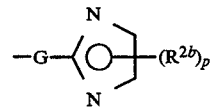

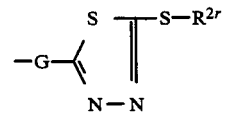

-continued

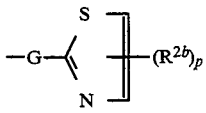

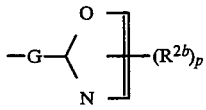

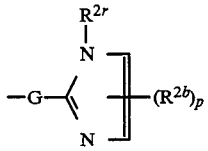

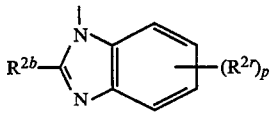

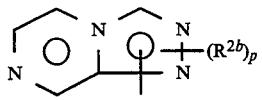

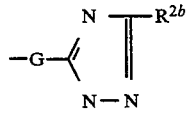

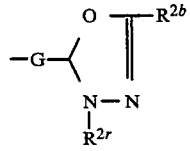

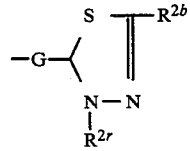

wherein:

G is S, Se, or Te, S being preferred; and wherein $R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms such as methyl, ethyl, propyl, butyl, 1-ethylpentyl, 2-ethoxyethyl, t-butyl or i-propyl; alkoxy or alkylthio, such as methoxy, ethoxy, propoxy, butoxy, octyloxy, methylthio, ethylthio, propylthio, butylthio, or octylthiol; alkyl esters such as $CO_2CH_3$, $CO_2C_2H_5$, $CO_2C_3H_7$, $CO_2C_4H_9$, $CH_2CO_2CH_3$, $CH_2CO_2C_2H_5$, $CH_2CO_2C_3H_7$, $CH_2CO_2C_4H_9$, $CH_2CH_2CO_2CH_3$, $CH_2CH_2CO_2C_2H_5$, $CH_2CH_2CO_2C_3H_7$, and $CH_2CH_2CO_2C_4H_9$; aryl or heterocyclic esters such as $CO_2R^{2s}$, $CH_2CO_2R^{2s}$, and $CH_2CH_2CO_2R^{2s}$ wherein $R^{2s}$ is substituted or unsubstituted aryl, or a substituted or unsubstituted heterocyclic group; substituted or unsubstituted benzyl, such as methoxy-, chloro-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted benzyl; substituted or unsubstituted aryl, such as phenyl, naphthyl, or chloro-, methoxy-, hydroxy-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted phenyl. These substituents may be repeated more than once as substituents. $R^{2a}$, $R^{2d}$, $R^{2h}$, $R^{2i}$, $R^{2j}$, $R^{2k}$, $R^{2q}$ and $R^{2r}$ may also be a substituted or unsubstituted heterocyclic group selected from groups such as pyridine, pyrrole, furan, thiophene, pyrazole, thiazole, imidazole, 1,2,4-triazole, oxazole, thiadiazole, indole, benzthiophene, benzimidazole, benzoxazole and the like wherein the substitutents are as selected from those mentioned previously.

$R^{2b}$, $R^{2c}$, $R^{2e}$, $R^{2f}$, and $R^{2g}$, are as described for $R^{2a}$, $R^{2d}$, $R^{2h}$, $R^{2i}$, $R^{2j}$, $R^{2k}$, $R^{2q}$ and $R^{2r}$; or, are individually one or more halogens such as chloro, fluoro or bromo and p is 0, 1, 2, 3 or 4.

2. PUGs which are dyes, or form dyes upon release

Suitable dyes and dye precursors include azo, azomethine, azophenol, azonaphthol, azoaniline, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381; 3,942,987, and 4,840,884. Preferred dyes and dye precursors are azo, azomethine, azophenol, azonaphthol, azoaniline, and indoaniline dyes and dye precursors. Structures of typical dyes and dye precursors are:

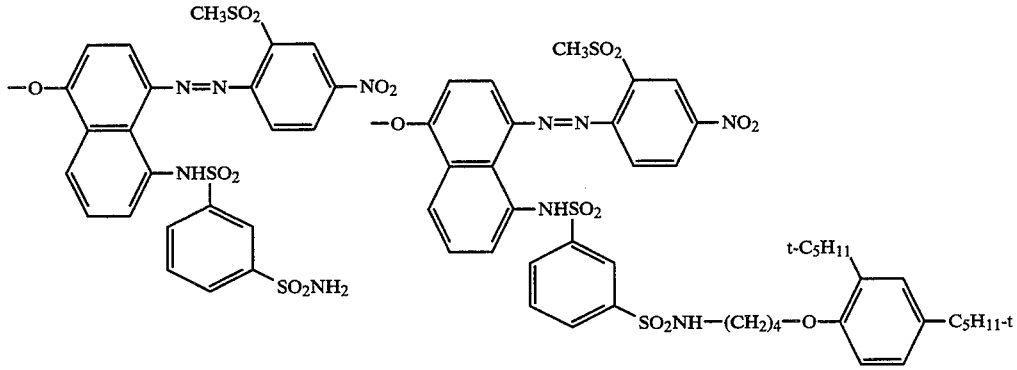

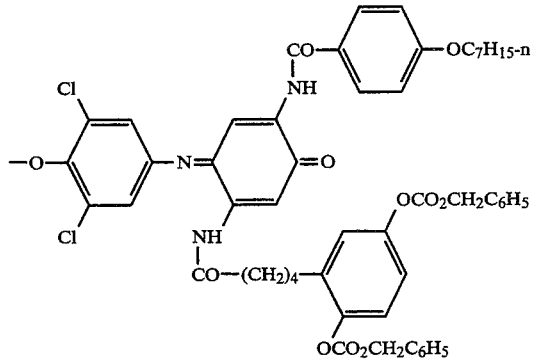

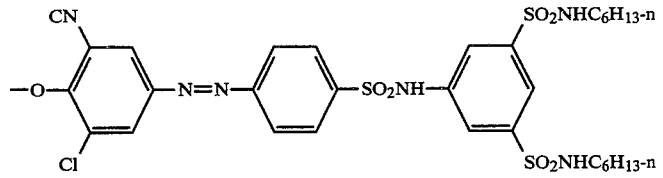

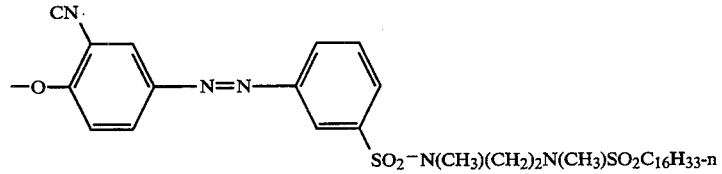

-continued

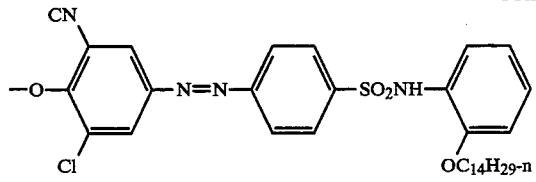

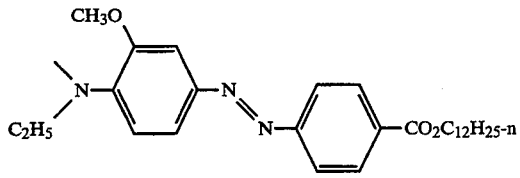

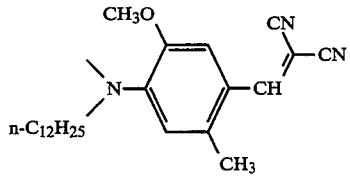

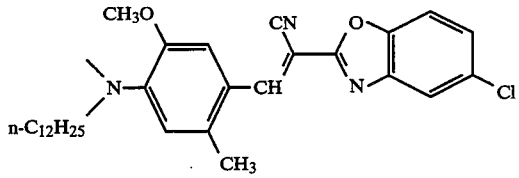

Suitable azo, azamethine and methine dyes are represented by the formulae in U.S. Pat. No. 4,840884, col. 8, lines 1–70.

Dyes can be chosen from those described, for example, in J. Fabian and H. Hartmann, *Light Absorption of Organic Colorants*, published by Springer-Verlag Co., but are not limited thereto.

Typical dyes are azo dyes having a radical represented by the following formula:

—X—Y—N=N—Z wherein X is a hetero atom such as an oxygen atom, a nitrogen atom and a sulfur atom, Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

Furthermore, Y and Z are each preferably an aromatic group or an unsaturated heterocyclic group. As the aromatic group, a substituted or unsubstituted phenyl or naphthyl group is preferred. As the unsaturated heterocyclic group, a 4- to 7-membered heterocyclic group containing at least one hetero atom selected from a nitrogen atom, a sulfur atom and an oxygen atom is preferred, and it may be part of a benzene-condensed ring system. The heterocyclic group means groups having a ring structure such as pyrrole, thiophene, furan, imidazole, 1,2,4-triazole, oxazole, thiadiazole, pyridine, indole, benzthiophene, benzimidazole, or benzoxazole.

Y may be substituted with other groups as well as X and the azo groups. Examples of such other groups include an aliphatic or alicyclic hydrocarbon group, an aryl group, an acyl group, an alkoxycarbonyl group, an aryloxycarbonyl group, an acylamino group, an alkylthio, an arylthio group, a heterocyclic group, a sulfonyl group, a halogen atom, a nitro group, a nitroso group, a cyano group, —COOM (M=H, an alkali metal atom or $NH_4$), a hydroxyl group, a sulfonamido group, an alkoxy group, an aryloxy group, and an acyloxy group. In addition, a carbamoyl group, an amino group, a ureido group, a sulfamoyl group, a carbamoylsulfonyl group and a hydrazino group are included. These groups may be further substituted with a group such as those disclosed above repeatedly, for example once or twice.

In the case where Z is a substituted aryl group or a substituted unsaturated heterocyclic group, groups listed as substituents for Y can be used in the same manner for Z.

When Y and Z contain an aliphatic or alicyclic hydrocarbon moiety as a substituent, any substituted or unsubstituted, saturated, unsaturated or straight or branched groups having, in the case of an aliphatic hydrocarbon moiety, from 1 to 32, preferably from 1 to 20 carbon atoms, and, in the case of an alicyclic hydrocarbon moiety having from 5 to 32, preferably from 5 to 20 carbon atoms, can be used. When substitution is carried out repeatedly, the uppermost number of carbon atoms of the thus obtained substituent is preferably 32.

When Y and Z contain an aryl moiety as a substituent, the number of carbon atoms of the moiety is generally from 6 to 10, and preferably it is a substituted or unsubstituted phenyl group. In the present invention, groups in the formulas shown hereinabove and hereinafter are defined as follows:

An acyl group, a carbamoyl group, an amino group, a ureido group, a sulfamoyl group, a carbamoylsulfonyl group, an urethane group, a sulfonamido group, a hydrazino group, and the like represents unsubstituted groups thereof and substituted groups thereof which are substituted with an aliphatic hydrocarbon group, an alicyclic hydrocarbon group or an aryl group to form mono-, di-, or tri-substituted groups; an acylamino group, a sulfonyl group, a sulfonamido group, an acyloxy group and the like each is aliphatic alicyclic, and aromatic group.

Typical examples of this group represented by formula for azo dyes shown above are contained in, for example, U.S. Pat. Nos. 4,424,156 and 4,857,447, column 6, lines 35–70.

3. PUG's which are couplers

Couplers released can be nondiffusible color-forming couplers, non-color forming couplers or diffusible competing couplers. Representative patents and publications describing competing couplers are: "On the Chemistry of While Couplers," by W. Puschel, Agfa-Gevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Patent No. 1,168,769 and British Patent No. 907,274. Structures of useful competing couplers are:

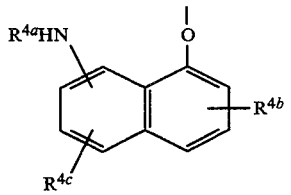

where $R^{4a}$ is hydrogen or alkylcarbonyl, such as acetyl, and $R^{4b}$ and $R^{4c}$ are individually hydrogen or a solubilizing group, such as sulfo, aminosulfonyl, and carboxy

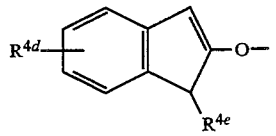

where $R^{4d}$ is as defined above and $R^{4e}$ is halogen, aryloxy, arylthio, or a development inhibitor, such as a mercaptotetrazole, such as phenylmercaptotetrazole or ethylmercaptotetrazole.

4. PUG's which form developing agents

Developing agents released can be color developing agents, black-and-white developing agents or cross-oxidizing developing agents. They include aminophenols, phenylenediamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

Structures of suitable developing agents are:

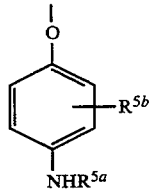

where $R^{5a}$ is hydrogen or alkyl of 1 to 4 carbon atoms and $R^{5b}$ is hydrogen or one or more halogen such as chloro or bromo; or alkyl of 1 to 4 carbon atoms such as methyl, ethyl or butyl groups.

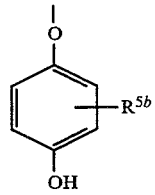

where $R^{5b}$ is as defined above.

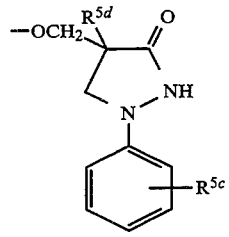

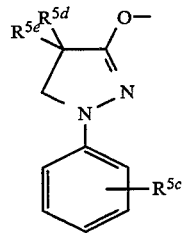

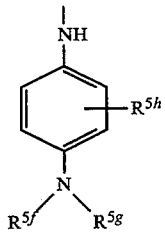

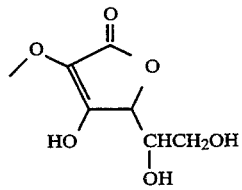

where $R^{5c}$ is hydrogen or alkyl of 1 to 4 carbon atoms and $R^{5d}$, $R^{5e}$, $R^{5f}$, $R^{5g}$, and $R^{5h}$ are individually hydrogen, alkyl of 1 to 4 carbon atoms such as methyl or ethyl; hydroxyalkyl of 1 to 4 carbon atoms such as hydroxymethyl or hydroxyethyl or sulfoalkyl containing 1 to 4 carbon atoms.

5. PUG's which ark..bleach inhibitors

Representative patents are U.S. Pat. Nos.3,705,801 and 3,715,208; and German OLS No. 2,405,279. Structures of typical bleach inhibitors are:

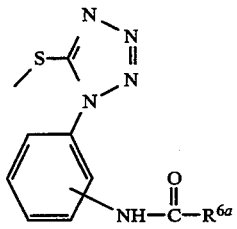

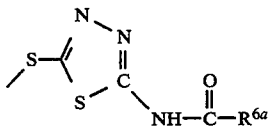

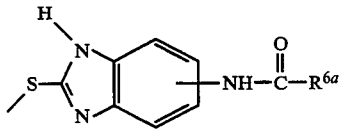

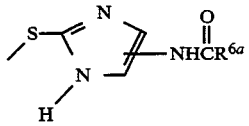

where $R^{6a}$ is alkyl or aryl of 6 to 20 carbon atoms.

6. PUG's which are bleach accelerators

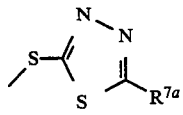

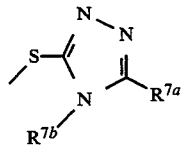

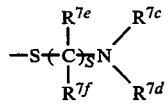

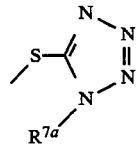

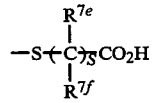

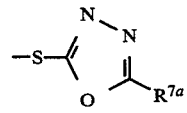

wherein $R^{7a}$ is hydrogen, alkyl, such as methyl, ethyl, and butyl, alkoxy, such as ethoxy and butoxy, or alkylthio, such as ethylthio and butylthio, for example containing 1 to 6 carbon atoms, and which may be unsubstituted or substituted; $R^{7b}$ is hydrogen, substituted or unsubstituted alkyl, or substituted or unsubstituted aryl, such as phenyl; $R^{7c}$, $R^{7d}$, $R^{7e}$ and $R^{7f}$ are individually hydrogen, substituted or unsubstituted alkyl, or substituted or unsubstituted aryl, such as straight chained or branched alkyl containing 1 to 6 carbon atoms, for example methyl, ethyl and butyl; s is 1 to 6; $R^{7c}$ and $R^{7d}$, or $R^{7e}$ and $R^{7f}$ together may form a 5-, 6-, or 7-membered ring.

It is often preferred for $R^{7a}$ and $R^{7b}$ to be solubilizing functions by the structure:

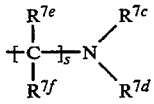

or

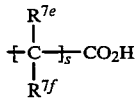

where $R^{7c}$, $R^{7d}$, $R^{7e}$, $R^{7f}$, and s are as defined above.

Other PUGs representative of bleach accelerators, can be found in for example U.S. Pat. Nos. 4,705,021; 4,912,024; 4,959,299; 4,705,021 and 5,063,145, columns 21–22, lines 1–70; and EP Patent No. 0,193,389.

7. PUGs which are electron transfer agents (ETAs)

ETAs useful in the present invention are 1-aryl-3-pyrazolidinone derivatives which, once released, become active electron transfer agents capable of accelerating development under processing conditions used to obtain the desired dye image.

The electron transfer agent pyrazolidinone moieties which have been found to be useful in providing development acceleration function are derived from compounds generally of the type described in U.S. Pat. Nos. 4,209,580;, 4,463,081; 4,471,045; and 4,481,287 and in published Japanese patent application No. 62-123,172. Such compounds comprise 3-pyrazolidinone structures having an unsubstituted or substituted aryl group in the 1-position. Also useful are the combinations disclosed in U.S. Pat. No. 4,859,578. Preferably these compounds have one or more alkyl groups in the 4- or 5-positions of the pyrazolidinone ring.

Electron transfer agents suitable for use in this invention are represented by the following two formulas:

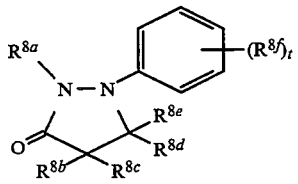

-continued

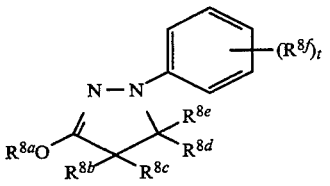

wherein:

$R^{8a}$ is hydrogen;

$R^{8b}$ and $R^{8c}$ each independently represents hydrogen, substituted or unsubstituted alkyl having from 1 to about 8 carbon atoms (such as hydroxyalkyl), carbamoyl, or substituted or unsubstituted aryl having from 6 to about 10 carbon atoms;

$R^{8d}$ and $R^{8e}$ each independently represents hydrogen, substituted or unsubstituted alkyl having from 1 to about 8 carbon atoms or substituted or unsubstituted aryl having from 6 to about 10 carbon atoms;

$R^{8f}$, which may be present in the ortho, meta or para positions of the benzene ring, represents halogen, substituted or unsubstituted alkyl bring from 1 to about 8 carbon atoms, or substituted or unsubstituted alkoxy having from 1 to about 8 carbon atoms, or sulfonamido, and when m is greater than 1, the $R^{8f}$ substituents can be the same or different or can be taken together to form a carbocyclic or a heterocyclic ring, for example a benzene or an alkylenedioxy ring; and t is 0 or 1 to 3.

When $R^{8b}$ and $R^{8c}$ groups are alkyl, it is preferred that they comprise from 1 to 3 carbon atoms. When $R^{8b}$ and $R^{8c}$ represent aryl, they are preferably phenyl.

$R^{8d}$ and $R^{8e}$ are preferably hydrogen.

When $R^{8f}$ represents sulfonamido, it may be, for example, methanesulfonamido, ethanesulfonamido or toluenesulfonamido.

8. PUGs which are development inhibiting redox releasers (DIRRs)

DIRRs useful in the present invention include hydroquinone, catechol, pyrogallol, 1,4-naphthohydroquinone, 1,2-naphthoquinone, sulfonamidophenol, sulfonamidonaphthol and hydrazide derivatives which, once released, become active inhibitor redox releasing agents that are then capable of releasing a development inhibitor upon reaction with a nucleophile such as hydroxide ion under processing conditions used to obtain the desired dye image. Such redox releasers are represented by formula (II) in U.S. Pat. No. 4,985,336; col. 3, lines 10 to 25 and formulas (III) and (IV) col. 14, line 54 to col. 17, line 11. Other redox releasers can be found in European Patent Application No. 0,285,176. Typical redox releasers include the following:

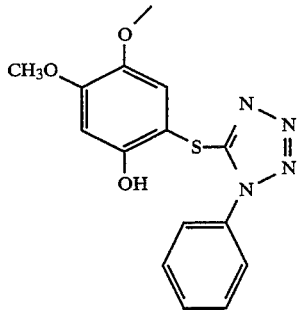

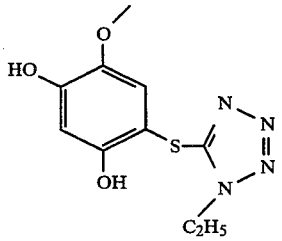

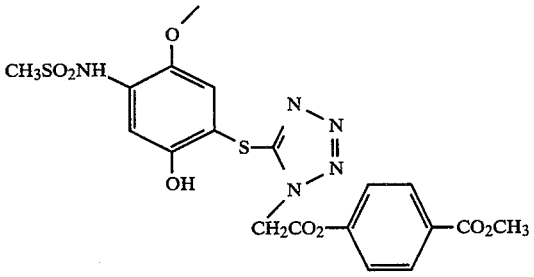

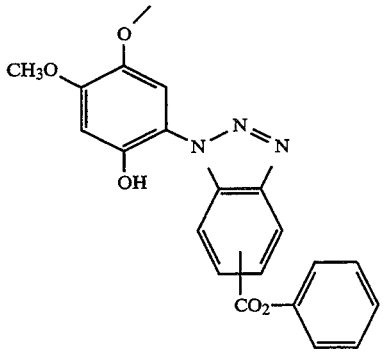

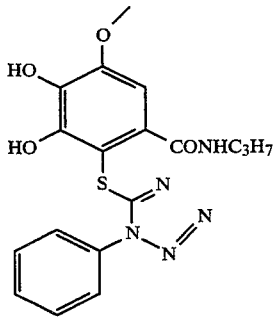

Couplers containing other suitable redox releasers can be found in for example, U.S. Pat. No. 4,985,336; cols. 17 to 62.

The following formula represents a 5-, 6-, or 7-membered nitrogen-containing unsaturated heterocyclic group which has 2 to 6 carbon atoms, which is connected to the carrier moiety through the nitrogen atom and which has a sulfonamido group and a development inhibitor group or a precursor thereof, on the ring carbon atoms. Z represents an atomic group necessary to form a 5-, 6-, or 7-membered nitrogen-containing unsaturated heterocyclic ring containing 2 to 6 carbon atoms together with the nitrogen atom; DI represents a development inhibitor group; and R represents a substituent; and DI is connected to a carbon atom of the heterocyclic ring represented by Z through a hetero atom included therein, and the sulfonamido group is connected to a carbon atom of the heterocyclic ring represented by Z, provided that the nitrogen atom through which the heterocyclic group is connected to the carrier moiety and the nitrogen atom in the sulfonamido group are positioned so as to satisfy the Kendall-Pelz rule as described, for example, in *The Theory Of The Photographic Process,* 4th edition, pp. 298–325.

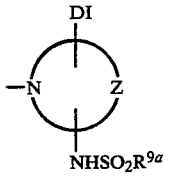

The group represented by the above formula is a group capable of being oxidized by the oxidation product of a developing agent. More specifically, the sulfonamido group thereon is oxidized to a sulfonylimino group from which a development inhibitor is cleaved.

Specific examples of the just described development inhibiting redox releasers are as follows:

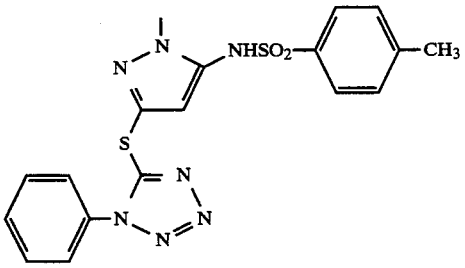

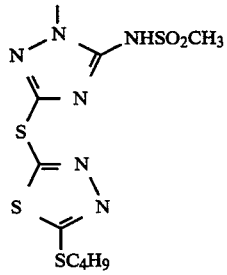

Other examples of development inhibiting redox releasers can be found in the couplers represented in for example European Patent Application 0,362,870; page 13, line 25 to page 29, line 20.

In a preferred embodiment, the PUG-releasing compound is a development inhibitor-releasing (DIR) compound. These DIR compounds may be incorporated in the same layer as the emulsions of this invention, in reactive association with this layer or in a different layer of the photographic material, all as known in the art.

These DIR compounds may be among those classified as "diffusable," meaning that they enable release of a highly transportable inhibitor moiety, or they may be classified as "non-diffusible", meaning that they enable release of a less transportable inhibitor moiety. The DIR compounds may comprise a timing or linking group as known in the art.

The inhibitor moiety of the DIR compound may be unchanged as the result of exposure to photographic processing solution. However, the inhibitor moiety may change in structure and effect in the manner disclosed in U.K. Patent 2,099,167; European Patent Application 167,168; Japanese Kokai 205150/83; or U.S. Pat. No. 4,782,012 as the result of photographic processing.

When the DIR compounds are dye-forming couplers, they may be incorporated in reactive association with complementary color sensitized silver halide emulsions, as for example a cyan dye-forming DIR coupler with a red sensitized emulsion or in a mixed mode, for example, a yellow dye-forming DIR coupler with a green sensitized emulsion, all known in the art.

The DIR compounds may also be incorporated in reactive association with bleach accelerator-releasing couplers, as disclosed in U.S. Pat. Nos. 4,912,024 and 5,135,839, and with the bleach accelerator-releasing compounds disclosed in U.S. Pat. Nos. 4,865,956 and 4,923,784, all incorporated herein by reference.

Specific DIR compounds useful in the practice of this invention are disclosed in the above cited references, in commercial use, and in the examples demonstrating the practice of this invention contained herein.

The dye image-forming compounds and PUG-releasing compounds can be incorporated in photographic elements of the present invention by means and processes known in the photographic art. A photographic element in which the dye image-forming and PUG-releasing compounds are incorporated can be a monocolor element comprising a support and a single silver halide emulsion layer, or it can be a multicolor, multilayer element comprising a support and multiple silver halide emulsion layers. The above described compounds can be incorporated in at least one of the silver halide emulsion layers and/or in at least one other layer, such as an adjacent layer, where they are in reactive association with the silver halide emulsion layer and are thereby able to react with the oxidized developing agent produced by development of silver halide in the emulsion layer. Additionally, the silver halide emulsion layers and other layers of the photographic element can contain addenda conventionally contained in such layers.

A typical multicolor, multilayer photographic element can comprise a support having thereon a red-sensitized silver halide emulsion unit having associated therewith a cyan dye image-forming compound, a green-sensitized silver halide emulsion unit having associated therewith a magenta dye image-forming compound, and a blue-sensitized silver halide emulsion unit having associated therewith a yellow dye image-forming compound. Each silver halide emulsion unit can be composed of one or more layers, and the various units and layers can be arranged in different locations with respect to one another, as known in the prior art and as illustrated by layer order formats hereinafter described.

In an element of the invention, a layer or unit affected by PUG can be controlled by incorporating in appropriate locations in the element a layer that confines the action of PUG to the desired layer or unit. Thus, at least one of the layers of the photographic element can be, for example, a scavenger layer, a mordant layer, or a barrier layer. Examples of such layers are described in, for example, U.S. Pat. Nos. 4,055,429; 4,317,892; 4,504,569; 4,865,946; and 5,006,451. The element can also contain additional layers such as antihalation layers, filter layers and the like. The element typically Will have a total thickness, excluding the support, of from 5 to 30 μm. Thinner formulations of 5 to about 25 μm are generally preferred since these are known to provide improved contact with the process solutions. For the same reason, more swellable film structures are likewise preferred. Further, this invention may be particularly useful with a magnetic recording layer such as those described in *Research Disclosure*, Item 34390, November 1992, p. 869.

In the following discussion of suitable materials for use in the elements of this invention, reference will be made to the previously mentioned *Research Disclosure*, December 1989, Item 308119, the disclosures of which are incorporated herein by reference.

Suitable dispersing media for the emulsion layers and other layers of elements of this invention are described in Section IX of *Research Disclosure*, December 1989, Item 308119, and publications therein.

In addition to the compounds described herein, the elements of this invention can include additional dye image-forming compounds, as described in Sections VII A-E and H, and additional PUG-releasing compounds, as described in Sections VII F and G of *Research Disclosure*, December 1989, Item 308119, and the publications cited therein.

The elements of this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, December 1989, Item 308119.

The elements of the invention can be coated on a variety of supports, as described in Section XVII of *Research Disclosure*, December 1989, Item 308119, and references cited therein.

The elements of this invention can be exposed to actinic radiation, typically in the visible region of the spectrum as described in greater detail hereinafter, to form a latent image and then processed to form a visible dye image, as described in Sections XVIII and XIX of *Research Disclosure*, December 1989, Item 308119. Typically, processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido ethyl-N,N-diethylaniline hydrochloride, and 4-amino-N-ethyl-N-(2-methoxyethyl)m-toluidine di-p-toluenesulfonic acid.

With negative-working silver halide, the processing step described above provides a negative image. The described elements are preferably processed in the known Kodak Flexicolor® C-41 color process described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak® E-6 Process is a typical reversal process.

Development is followed by the conventional steps of bleaching, fixing, or bleach-fixing, to remove silver or silver halide, washing, and drying.

In the following tables are shown compounds useful in the practice of the present invention.

Table 1 contains the formulas of typical dye image-forming coupler compounds.

Table 2 contains the formulas of typical PUG-releasing compounds that release development inhibitor groups or precursors thereof. In Table 3 are shown the formulas of representative examples of other kinds of PUG-releasing compounds.

Table 4 provides the formulas of miscellaneous exemplary photographic compounds that can be used in elements of the invention.

TABLE 1

Typical Dye Image-Forming Coupler Compounds

C-1

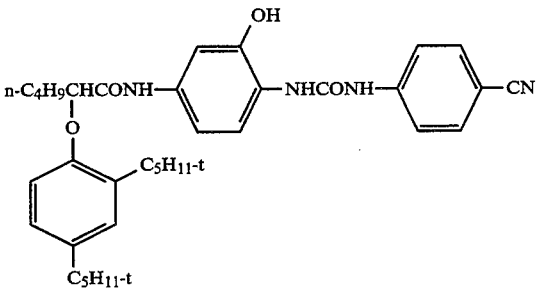

TABLE 1-continued
Typical Dye Image-Forming Coupler Compounds
C-2
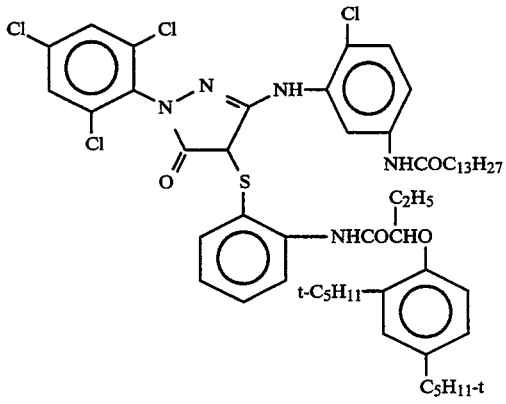
C-3
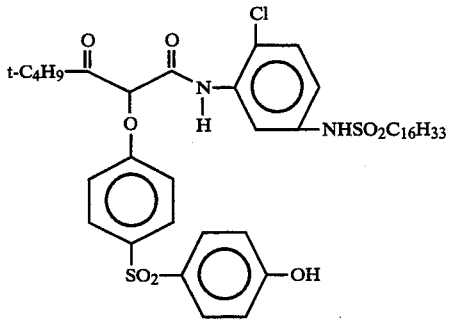
C-4
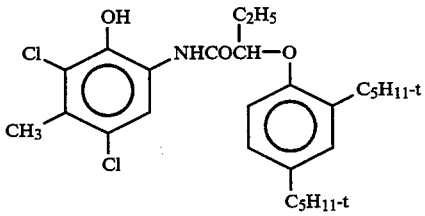
C-5
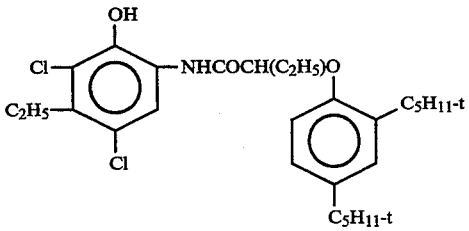
C-6
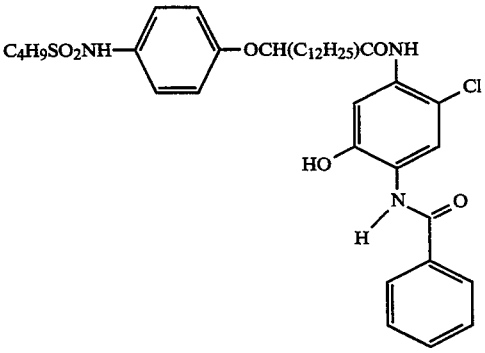
TABLE 1-continued
Typical Dye Image-Forming Coupler Compounds
C-7
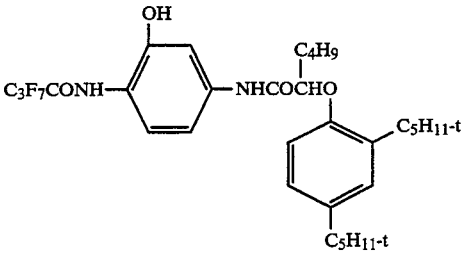
C-8
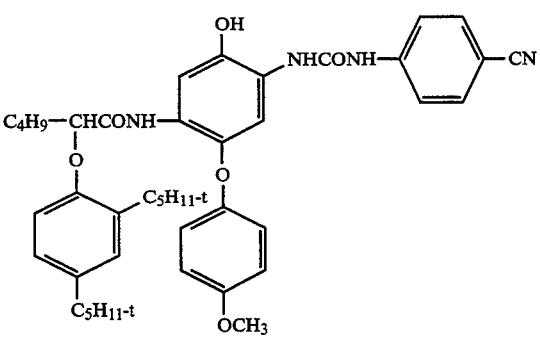
C-9
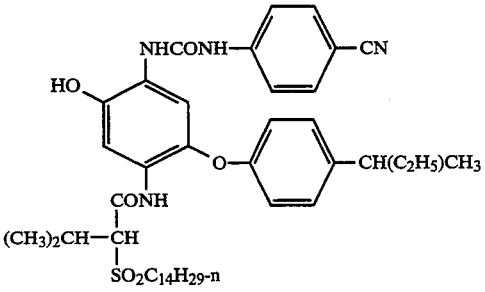
C-10
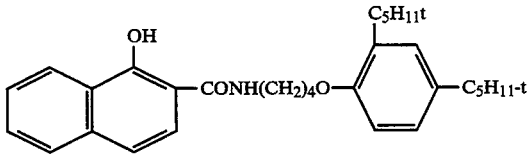
C-11
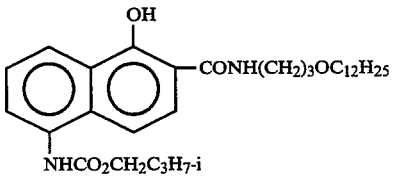
C-12
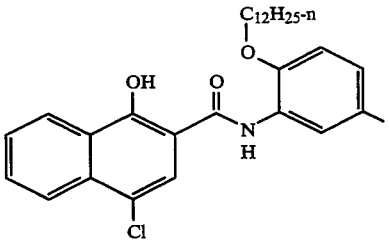

TABLE 1-continued
Typical Dye Image-Forming Coupler Compounds
C-13
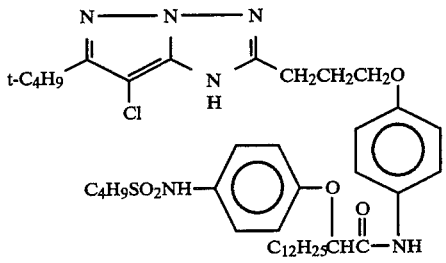
C-14
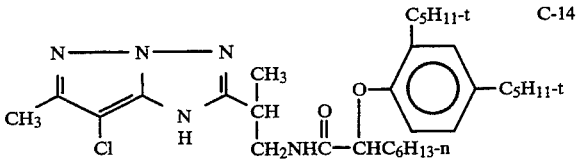
C-15
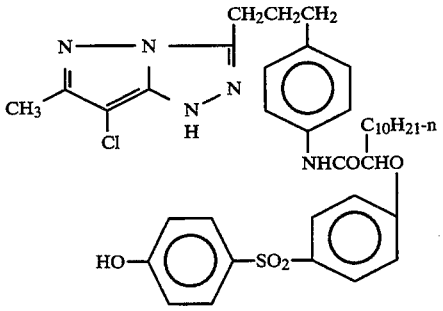
C-16
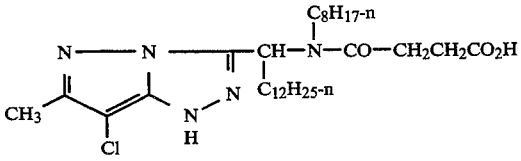
C-17
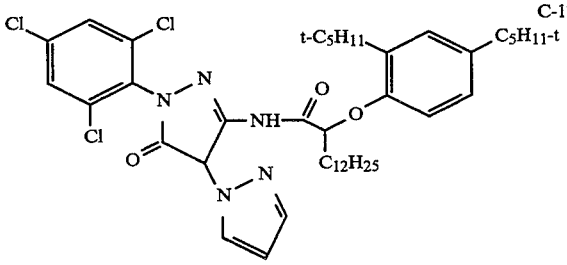
C-18
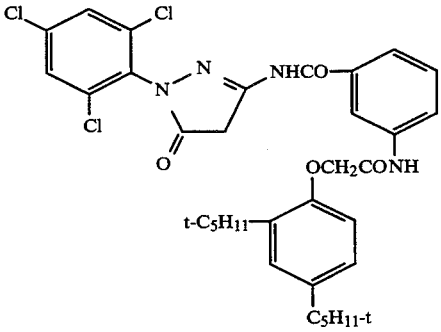
TABLE 1-continued
Typical Dye Image-Forming Coupler Compounds
C-19
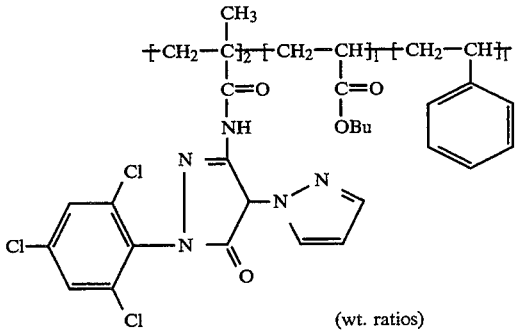
(wt. ratios)
C-20
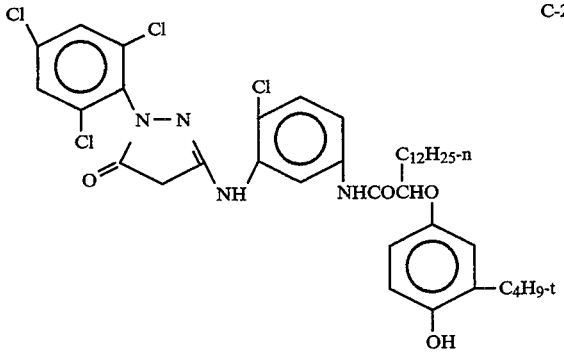
C-21
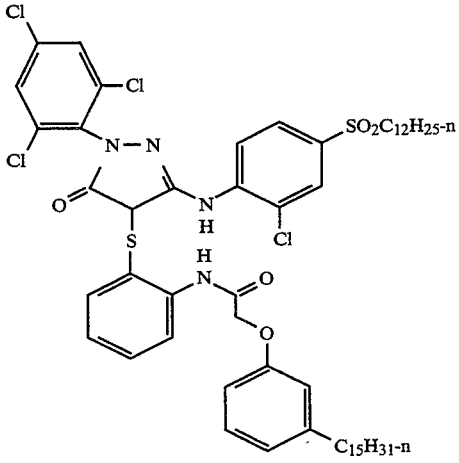
C-22
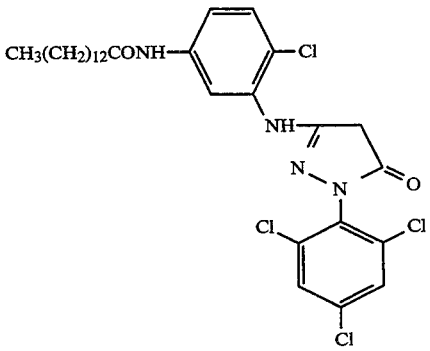

TABLE 1-continued
Typical Dye Image-Forming Coupler Compounds
C-23
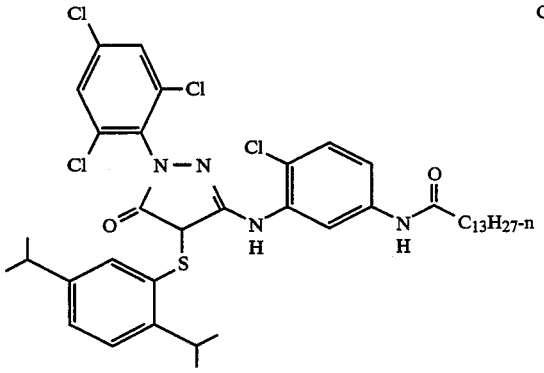
C-24
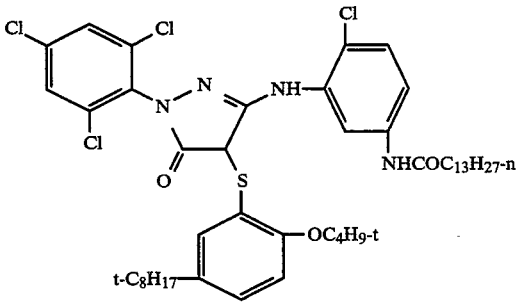
C-25
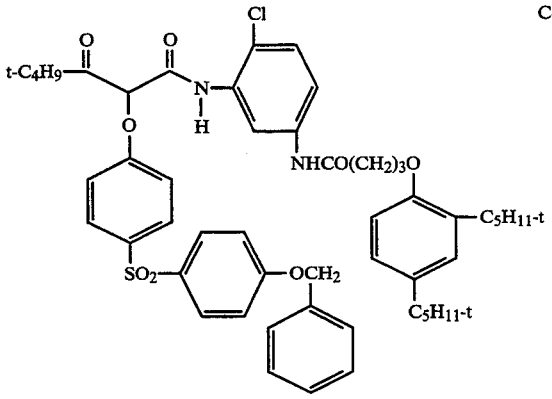
C-26
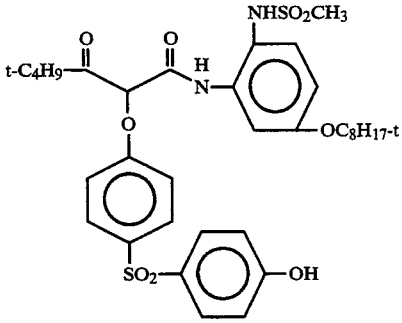
C-27
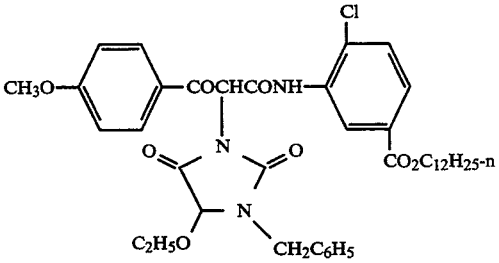
TABLE 1-continued
Typical Dye Image-Forming Coupler Compounds
C-28
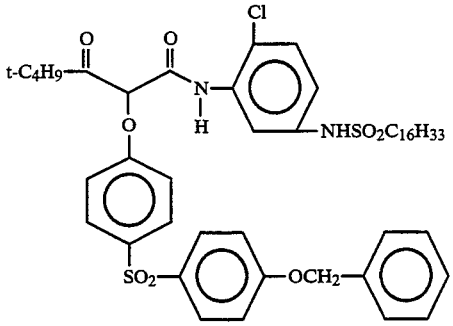
C-29
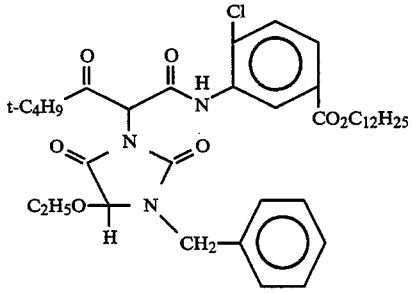
C-30
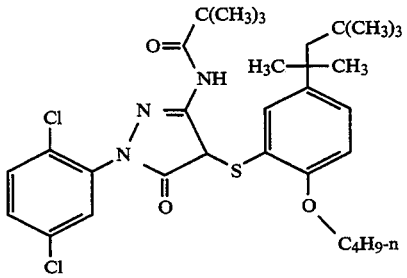
C-31
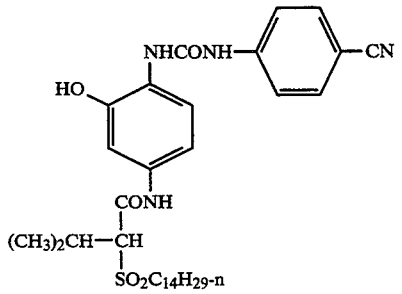
C-32
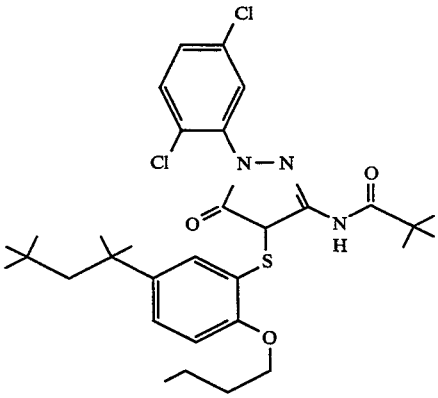

TABLE 1-continued
Typical Dye Image-Forming Coupler Compounds
C-33
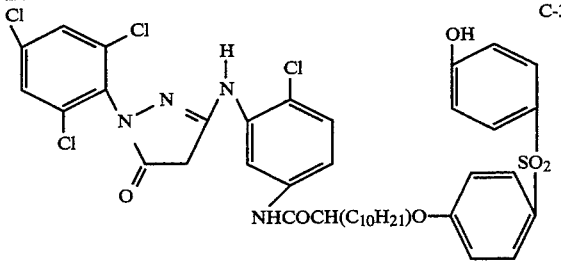
C-34
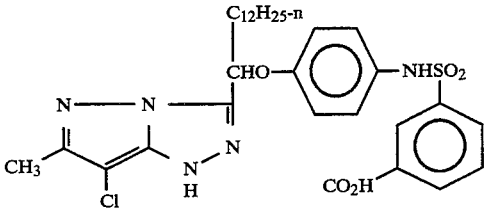
TABLE 1-continued
Typical Dye Image-Forming Coupler Compounds
C-35
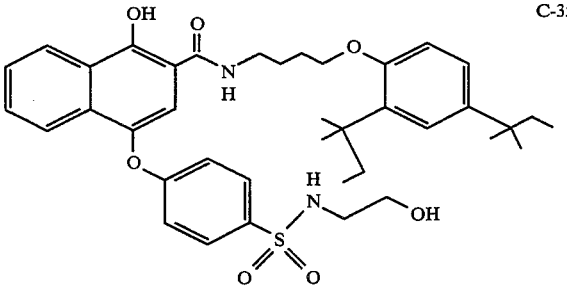
C-36
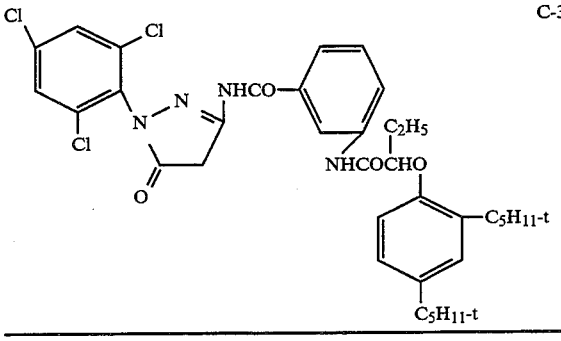
TABLE 2
Typical PUG-Releasing Compounds That Release Development Inhibitor Groups or Precursors Thereof
D-1
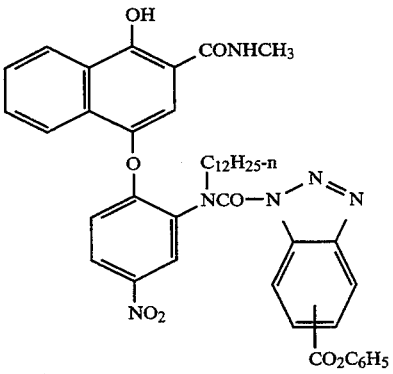
D-2
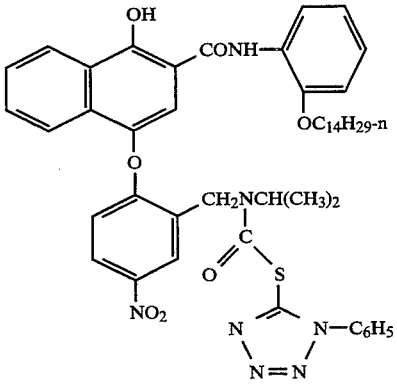

TABLE 2-continued
Typical PUG-Releasing Compounds That Release Development Inhibitor Groups or Precursors Thereof
D-3
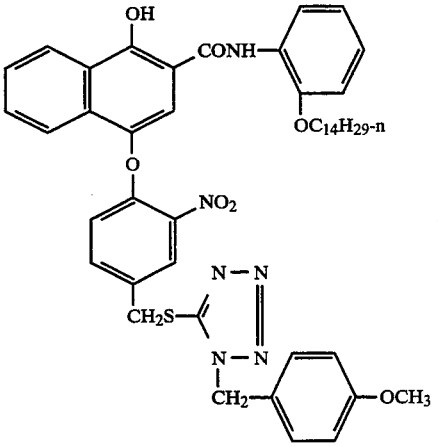
D-4
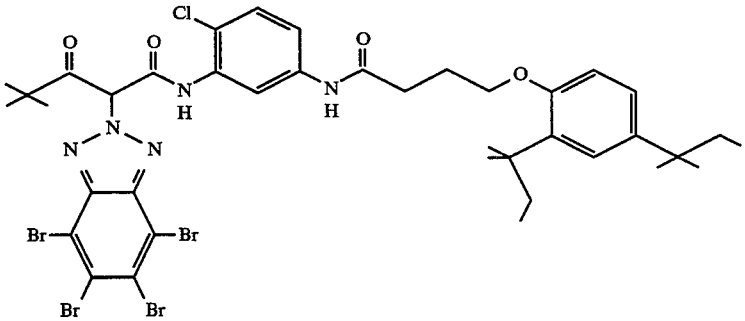
D-5
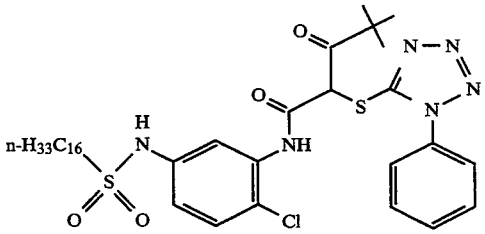
D-6
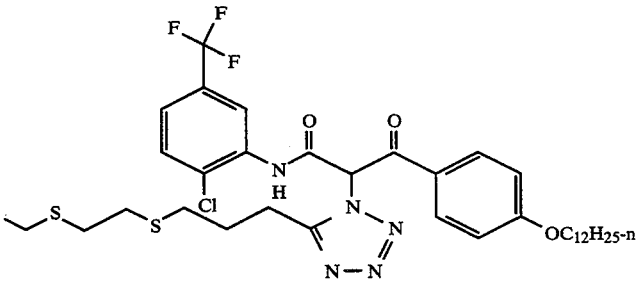
D-7
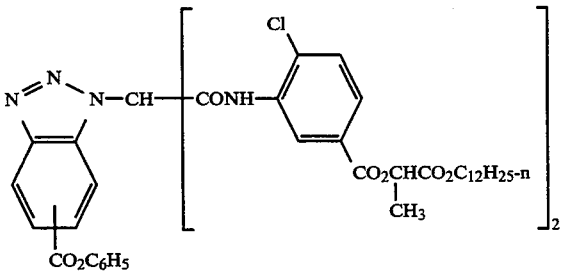

TABLE 2-continued
Typical PUG-Releasing Compounds That Release Development Inhibitor Groups or Precursors Thereof
D-8
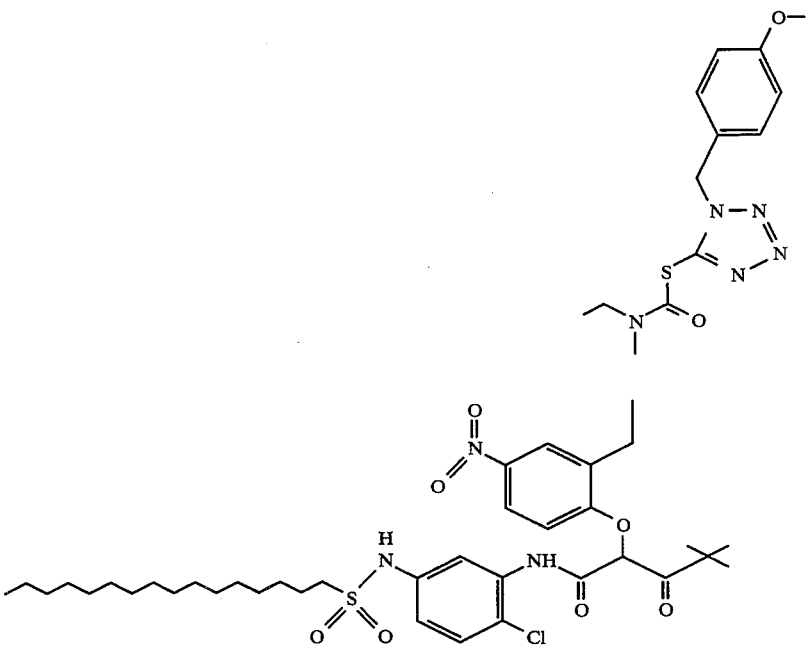
D-9
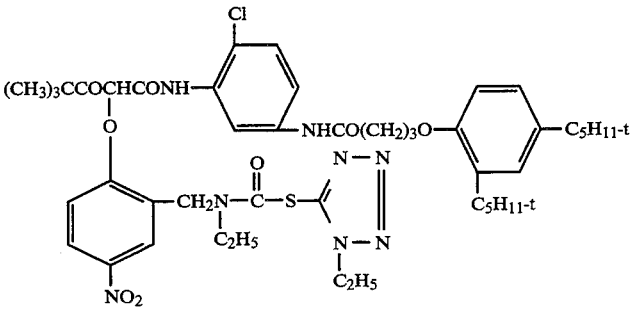
D-10
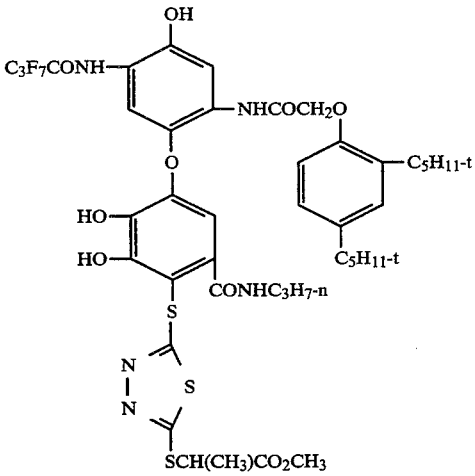

TABLE 2-continued
| Typical PUG-Releasing Compounds That Release Development Inhibitor Groups or Precursors Thereof | |
|---|---|
| 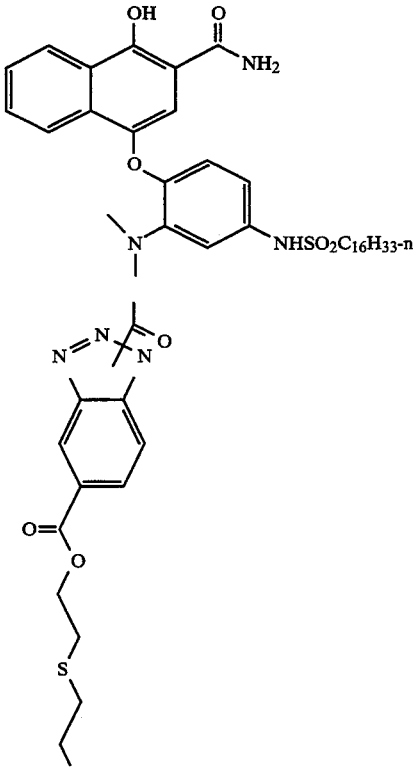 | D-12 |
| 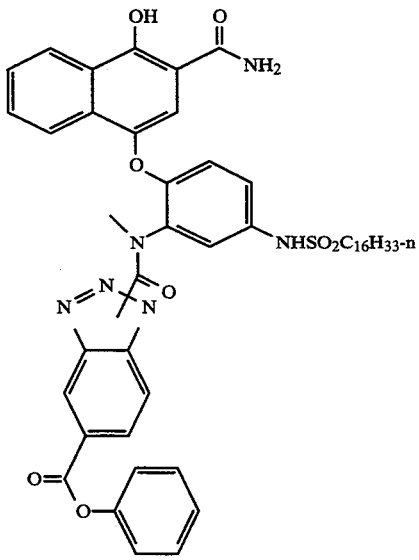 | D-13 |
| 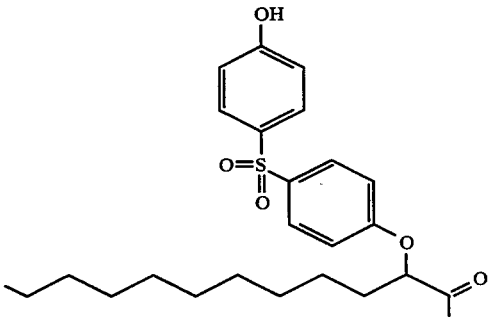 | D-14 |

TABLE 2-continued
| Typical PUG-Releasing Compounds That Release Development Inhibitor Groups or Precursors Thereof | |
|---|---|
| 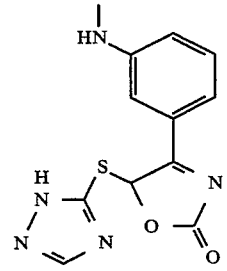 | |
| 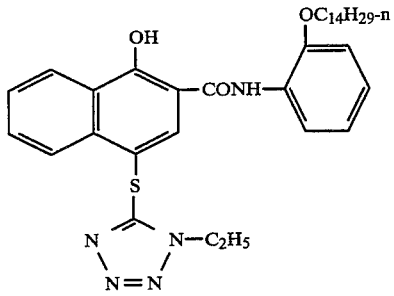 | D-15 |
| 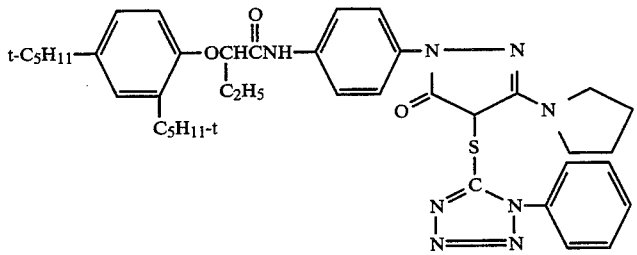 | D-16 |
| 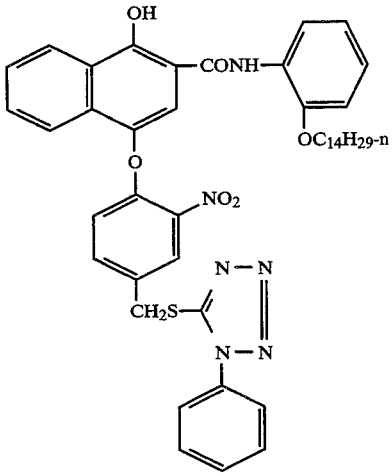 | D-17 |
| 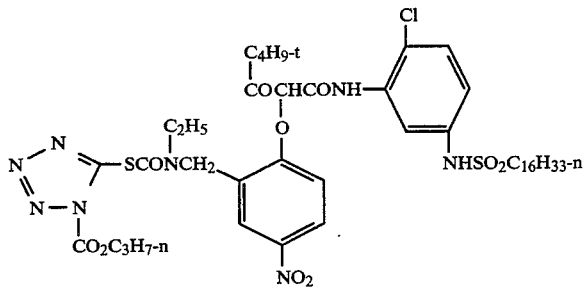 | D-18 |

TABLE 2-continued
Typical PUG-Releasing Compounds That Release Development Inhibitor Groups or Precursors Thereof
D-19
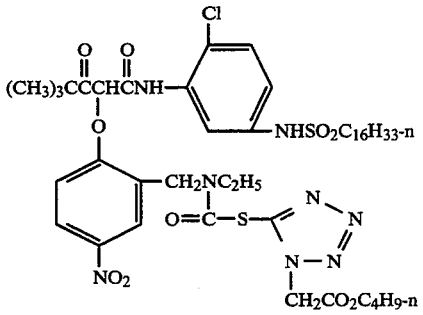
D-20
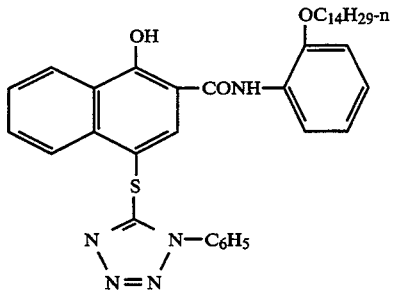
D-21
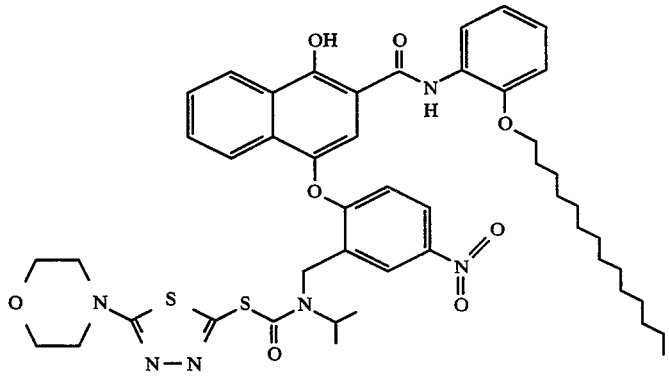
D-22
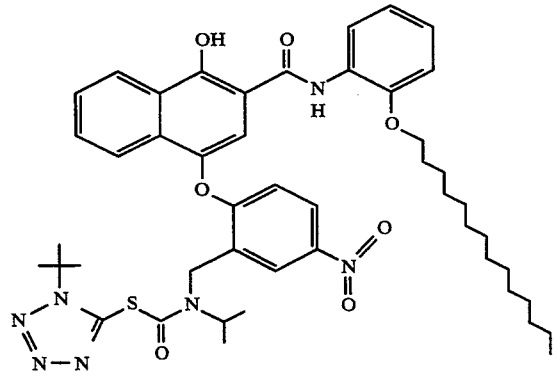

TABLE 2-continued
Typical PUG-Releasing Compounds That Release Development Inhibitor Groups or Precursors Thereof
D-23
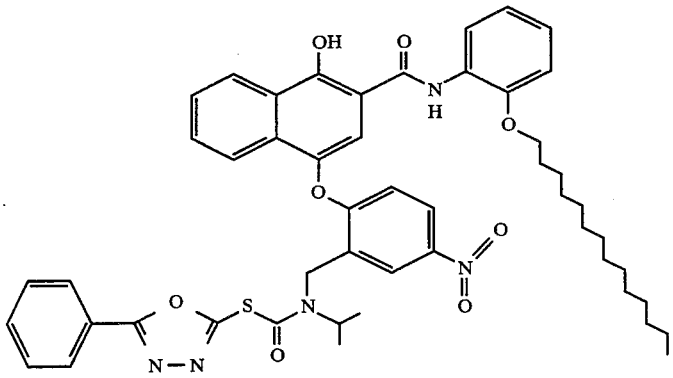
D-24
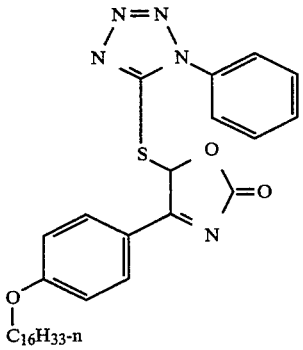
D-25
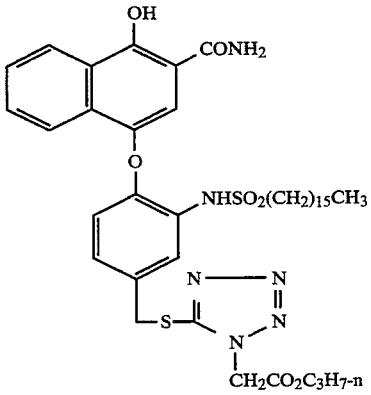
D-26
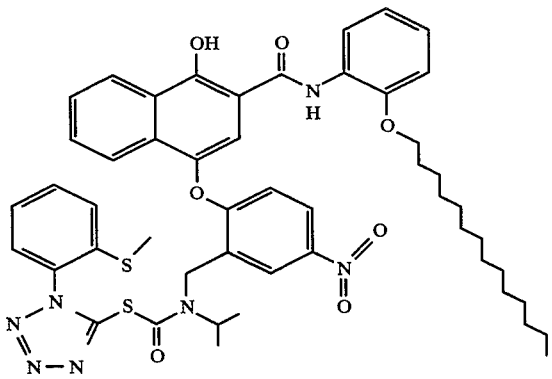

TABLE 2-continued
Typical PUG-Releasing Compounds That Release Development Inhibitor Groups or Precursors Thereof
D-27
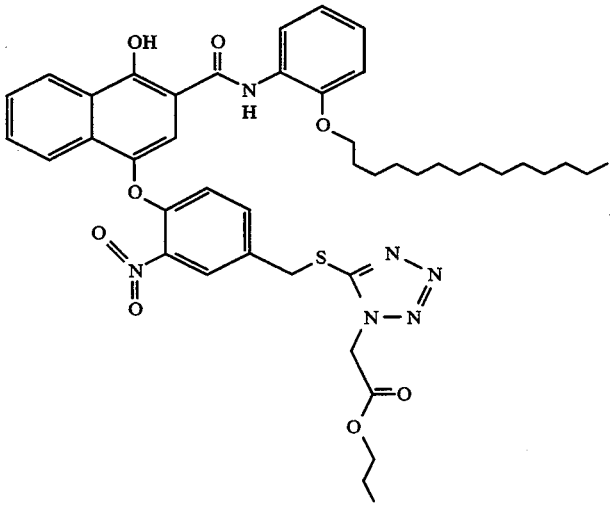
D-30
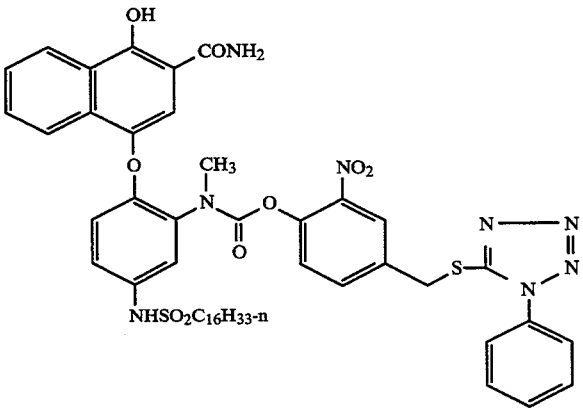
D-31
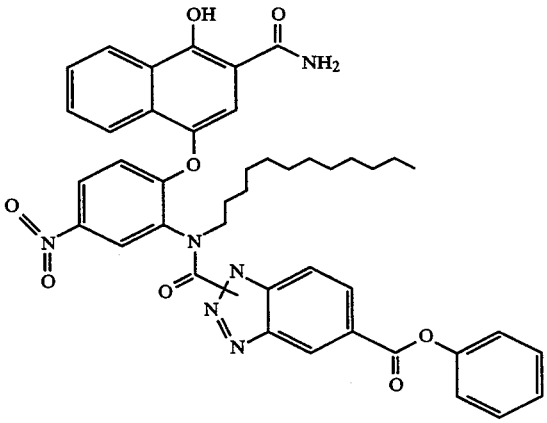
D-32
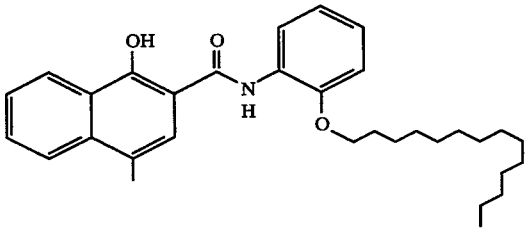

TABLE 2-continued
Typical PUG-Releasing Compounds That Release Development Inhibitor Groups or Precursors Thereof
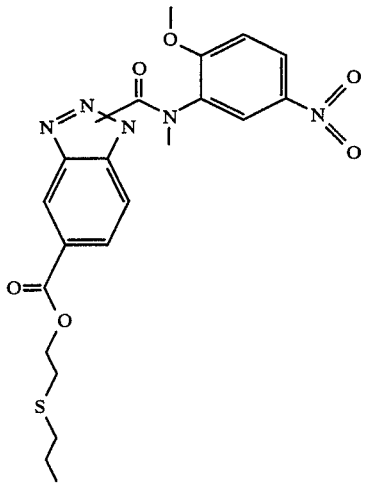
D-33
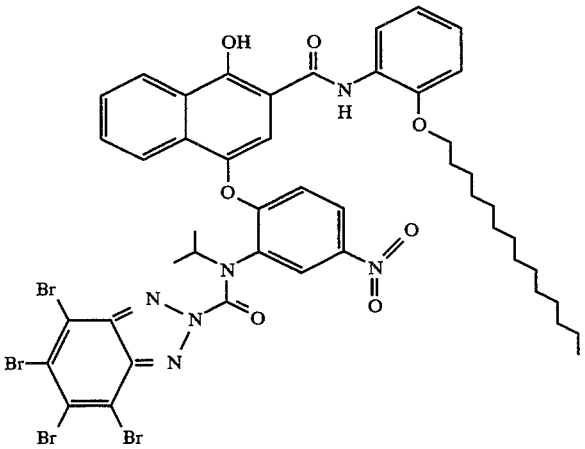
C-45
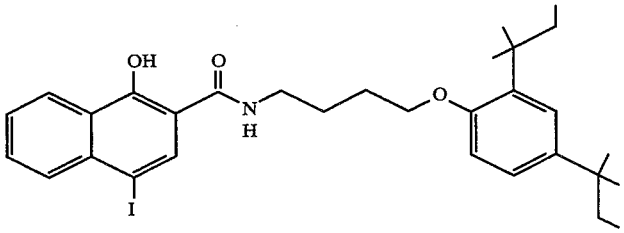

TABLE 3
Typical PUG-Releasing Compounds That Release Groups Other Than Development Inhibitors
| Compound | PUG |
|---|---|
| 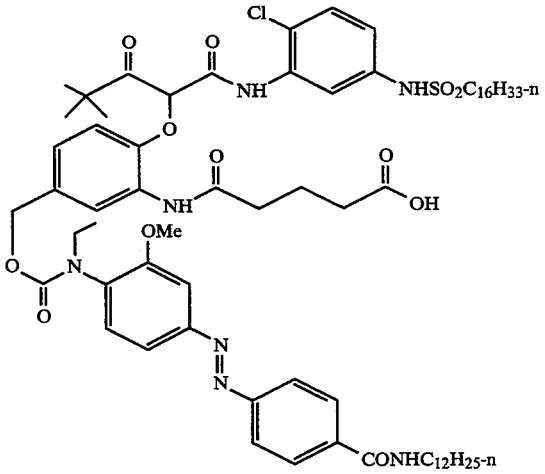 C-37 | Dye |
| 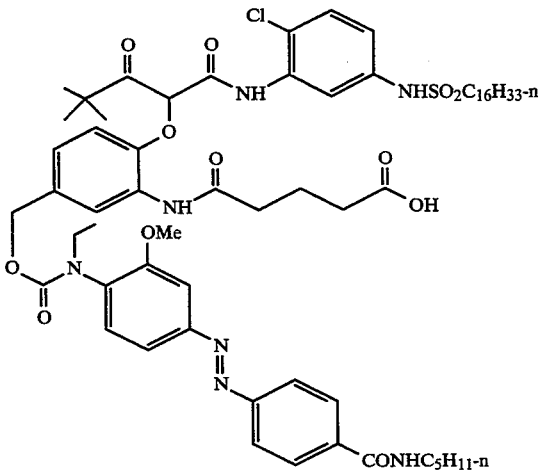 C-38 | Dye |
| 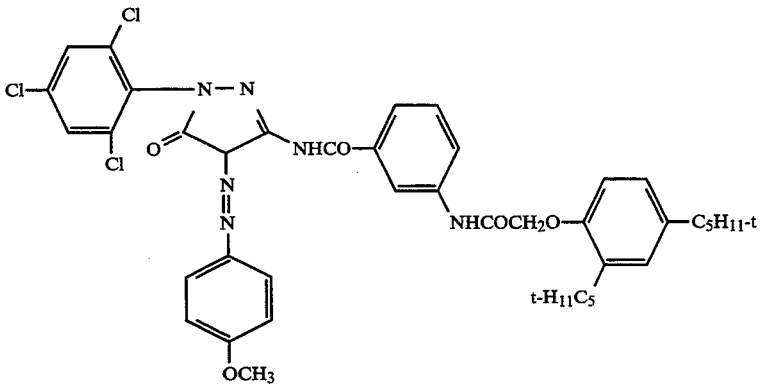 C-39 | Dye |

TABLE 3-continued
Typical PUG-Releasing Compounds That Release Groups Other Than Development Inhibitors
| Compound | PUG |
|---|---|
| 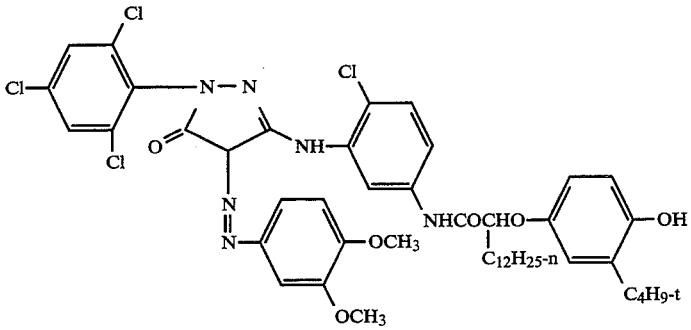 C-40 | Dye |
| 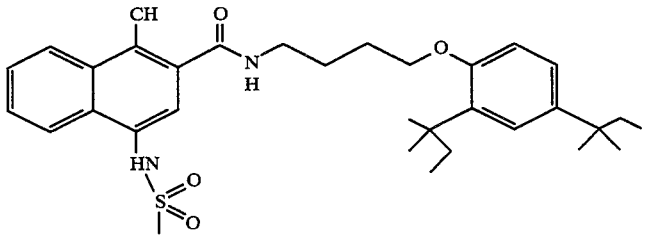 | Dye |
| 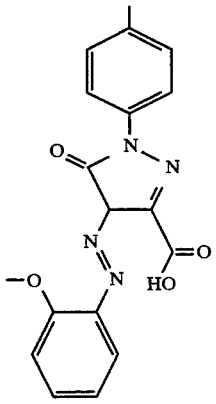 C-41 | |
| 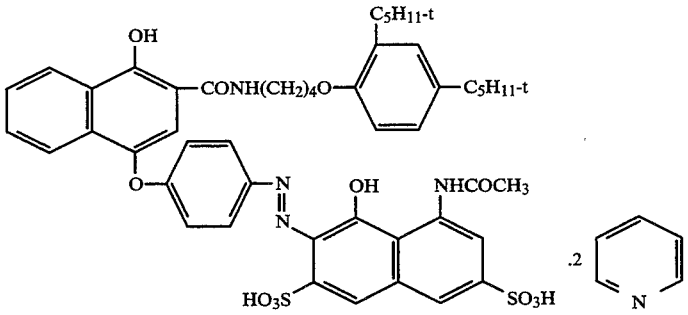 C-42 | Dye |

TABLE 3-continued
Typical PUG-Releasing Compounds That Release Groups Other Than Development Inhibitors
| Compound | PUG |
|---|---|
| 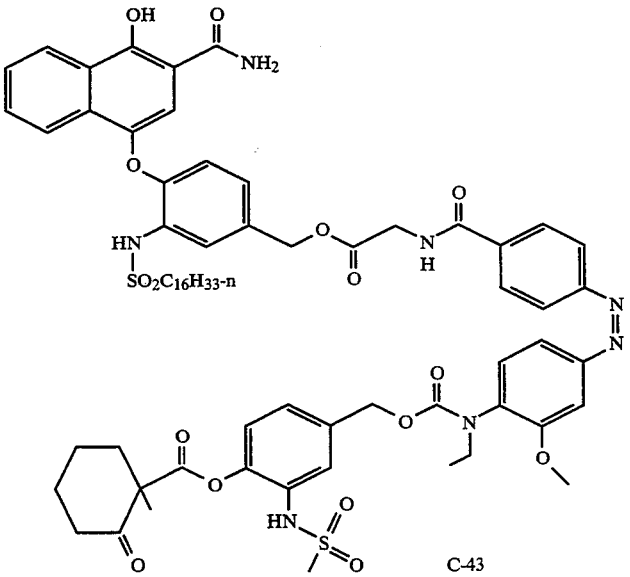 C-43 | Shifted Dye |
| 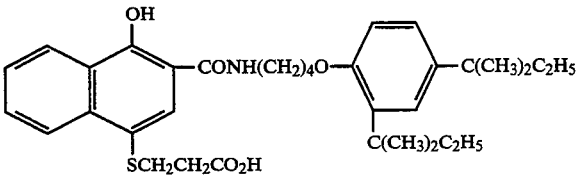 B-1 | Bleach Accelerator |
| 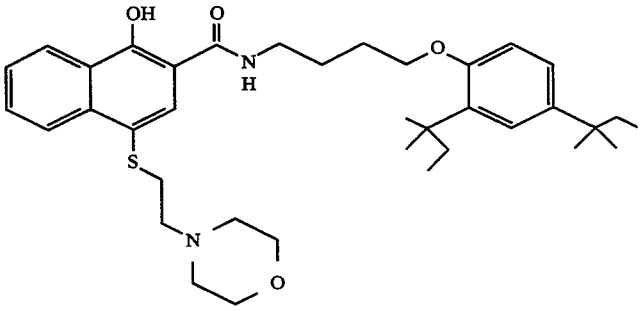 B-6 | Bleach Accelerator |
| 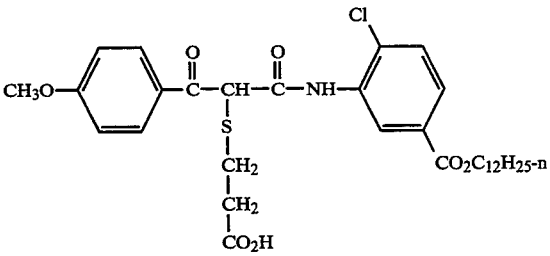 B-32 | Bleach Accelerator |

TABLE 3-continued
Typical PUG-Releasing Compounds That Release Groups Other Than Development Inhibitors
| Compound | PUG |
|---|---|
| 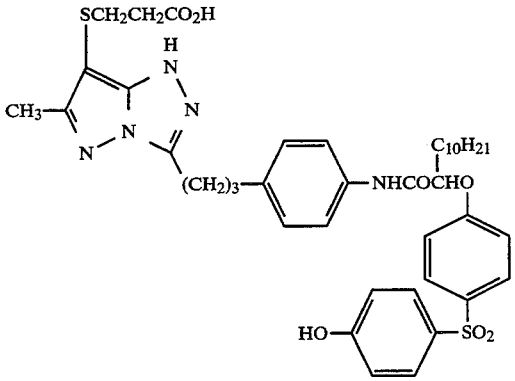 B-36 | Bleach Accelerator |
| 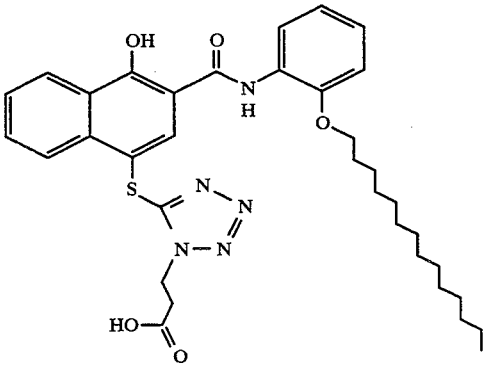 D-28 | Bleach Accelerator |
| 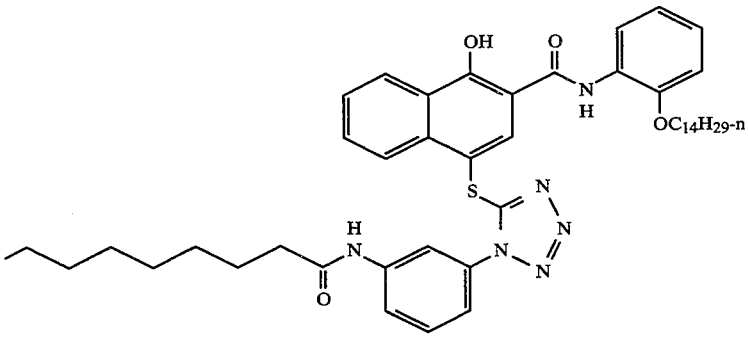 D-29 | Bleach Inhibitor |

TABLE 3-continued
Typical PUG-Releasing Compounds That Release Groups Other Than Development Inhibitors
| Compound | PUG |
|---|---|
| 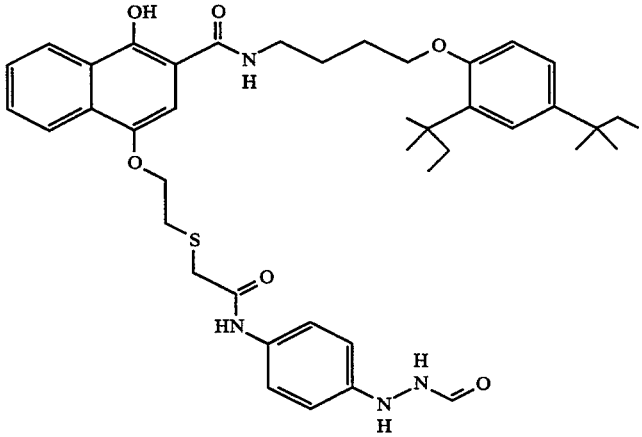 C-49 | Development Accelerator |
| 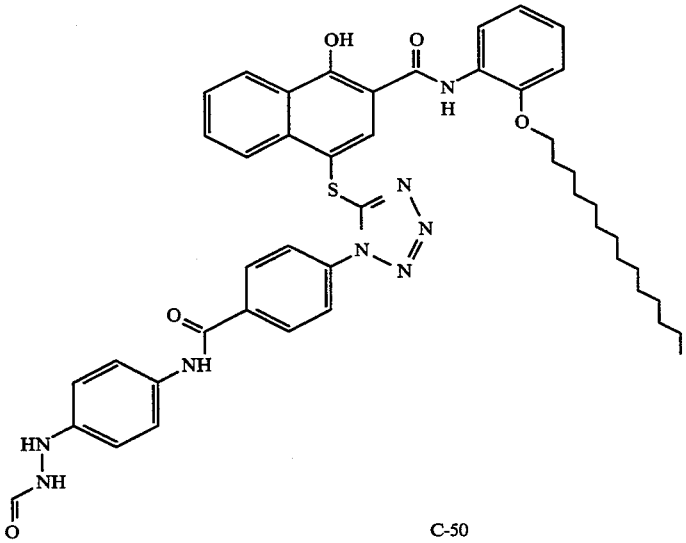 C-50 | Development Accelerator |
| 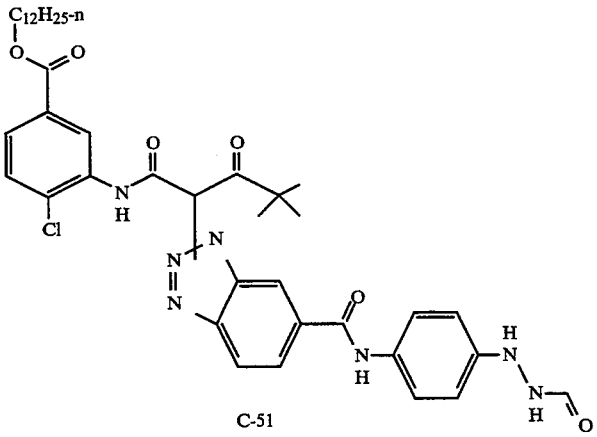 C-51 | Development Accelerator |

TABLE 3-continued
| Typical PUG-Releasing Compounds That Release Groups Other Than Development Inhibitors | |
|---|---|
| Compound | PUG |
| 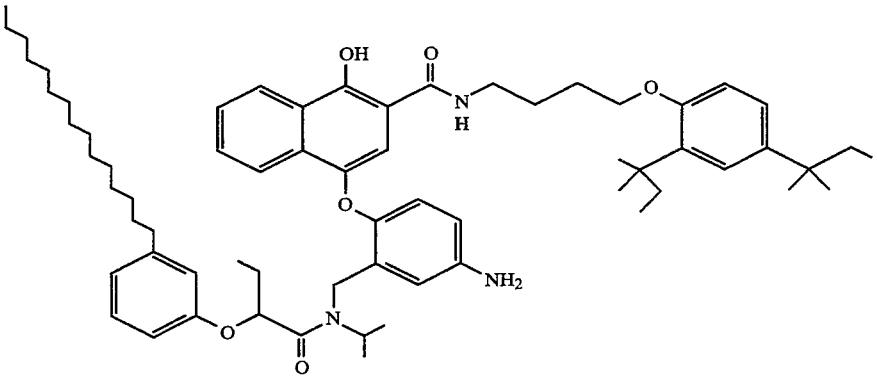 C-46 | Competing Coupler |
| 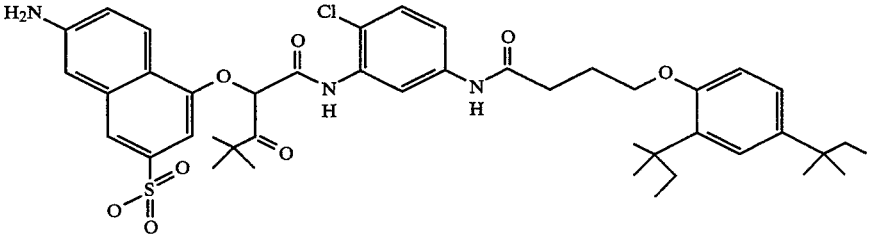 C-47 | Competing Coupler |
| 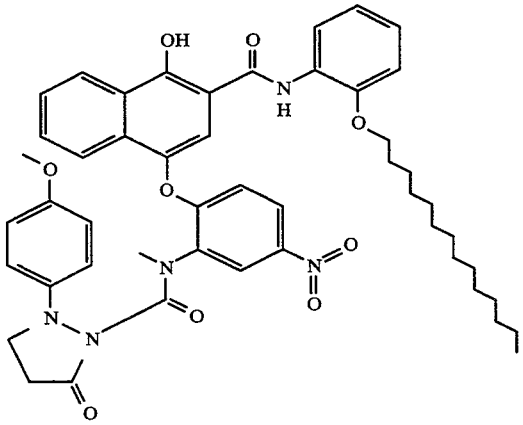 C-52 | Electron Transfer Agent |
TABLE 4
| Miscellaneous Exemplary Photographic Compounds | |
|---|---|
| 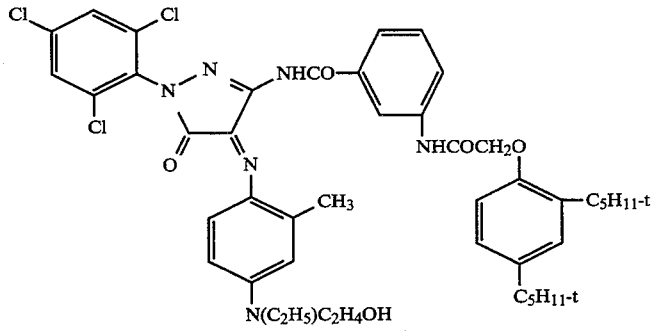 | DYE-1 |

TABLE 4-continued
Miscellaneous Exemplary Photographic Compounds
DYE-2
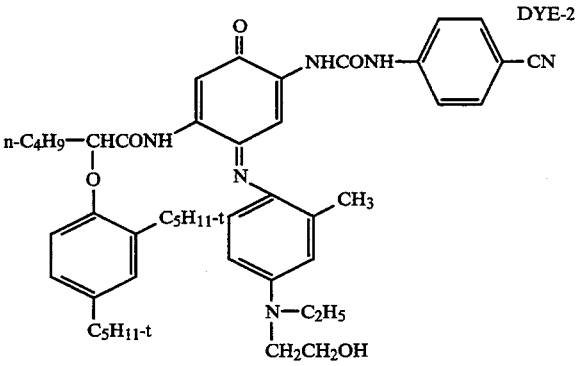
DYE-3
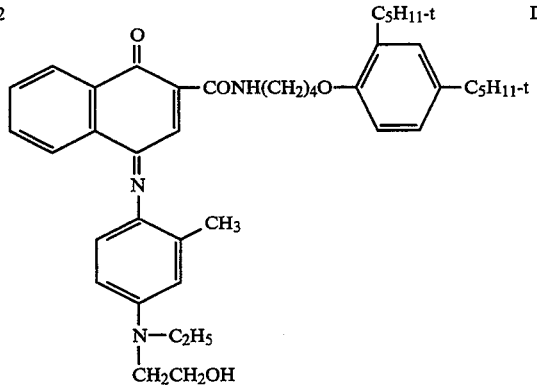
DYE-4
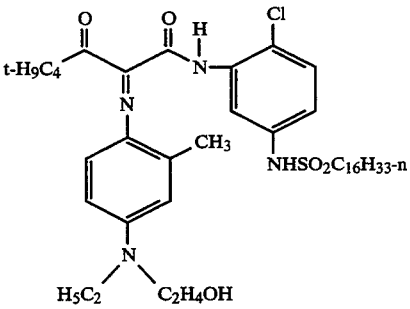
DYE-6
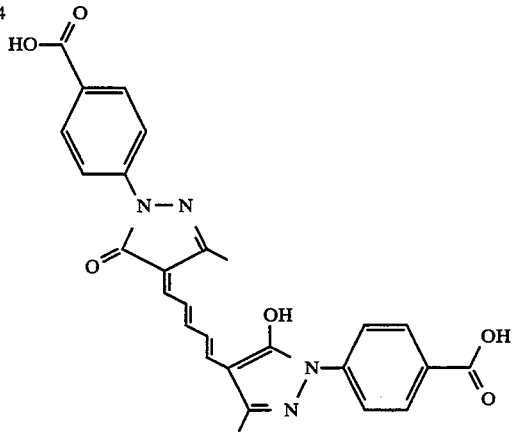
DYE-7
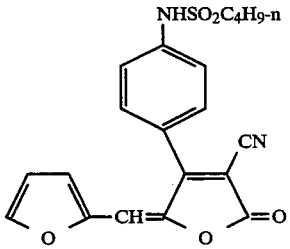
DYE-8
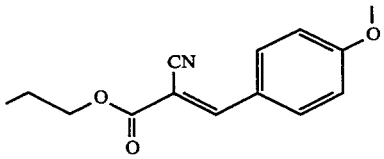
DYE-9
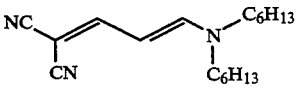
DYE-10
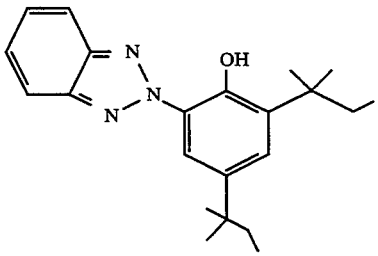

TABLE 4-continued

Miscellaneous Exemplary Photographic Compounds

DYE-11

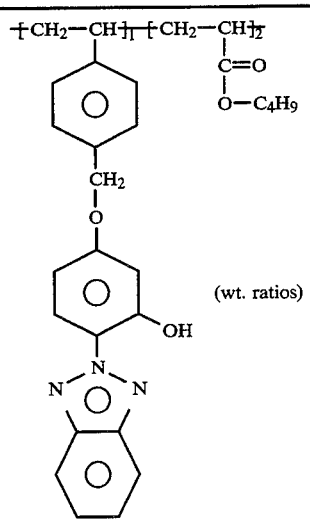

SOL-1

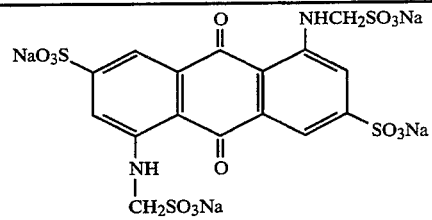

SOL-2

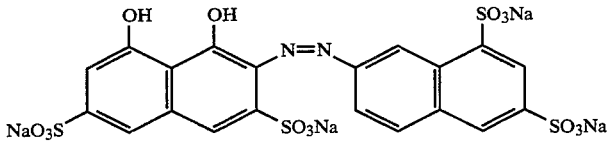

Mixture of Isomeric Didodecylhydroquinones

S-1

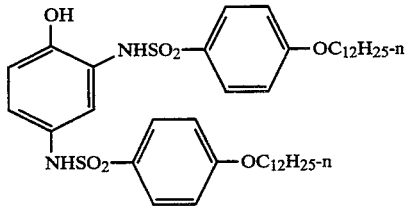

S-2

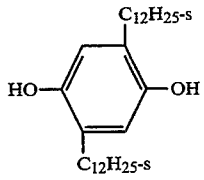

S-3

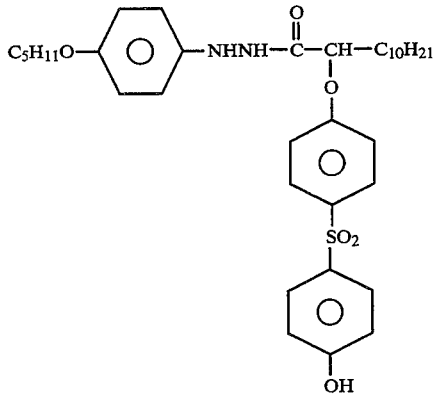

S-4

BA-1

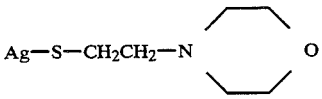

BA-2

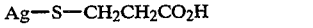

Of course, the color photographic elements of this invention can contain any of the optional additional layers and components known to be useful in color photographic elements in general, such as, for example, subbing layers, overcoat layers, surfactants and plasticizers, some of which are discussed in detail hereinbefore. They can be coated onto appropriate supports using any suitable technique, including, for example, those described in *Research Disclosure*, December 1989, Item-308117, Section XV Coating and Drying Procedures, the disclosure of which is incorporated herein by reference.

The photographic elements containing radiation sensitive {100} tabular grain emulsion layers according to this invention can be imagewise-exposed with various forms of energy which encompass the ultraviolet and visible (e.g., actinic) and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. Exposures can be monochromatic, orthochromatic or panchromatic. Imagewise exposures at ambient, elevated or reduced temperatures and/or pressures, including high-or low-intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18 and 23.

ILLUSTRATIVE EMULSION PREPARATIONS

PREPARATION I

This Preparation demonstrates the preparation of an ultrathin tabular grain silver iodochloride emulsion satisfying the requirements for use in a color photographic element of this invention.

A 2030 mL solution containing 1.75% by weight low methionine gelatin (gelatin that has been treated with an oxidizing agent to reduce its methionine content to less than 30 micromoles per gram), 0.011M sodium chloride and $1.48\times10^{-4}$M potassium iodide was provided in a stirred reaction vessel. The contents of the reaction vessel were maintained at 40° C. and the pCl was 1.95.

While this solution was vigorously stirred, 30 mL of 1.0M silver nitrate solution and 30 mL of a 0.99M sodium chloride and 0.01M potassium iodide solution were added simultaneously at a rate of 30 mL/min each. This achieved grain nucleation to form crystals with an initial iodide concentration of 2 mole percent, based on total silver.

The mixture was then held 10 minutes with the temperature remaining at 40° C. Following the hold, a 1.0M silver nitrate solution and a 1.0M NaCl solution were then added simultaneously at 2 mL/min for 40 minutes with the pCl being maintained at 1.95.

The resulting emulsion was a tabular grain silver iodochloride emulsion containing 0.5 mole percent iodide, based on silver. Fifty percent of total grain projected area was provided by tabular grains having {100} major faces having an average ECD of 0.84 μm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 23 and an average tabularity (ECD/$t^2$) of 657. The ratio of major face edge lengths of the selected tabular grains was 1.4. Seventy two percent of total grain projected area was made up of tabular grains having {100} major faces and aspect ratios of at least 7.5. These tabular grains had a mean ECD of 0.75 μm, a mean thickness of 0.045 μm, a mean aspect ratio of 18.6 and a mean tabularity of 488.

A representative sample of the grains of the emulsion is shown in FIG. 1.

PREPARATION II

This Preparation demonstrates the importance of iodide in the precipitation of the initial grain population (nucleation).

This emulsion was precipitated identically to that of Example 1, except no iodide was intentionally added.

The resulting emulsion consisted primarily of cubes and very low aspect ratio rectangular grains ranging in size from about 0.1 to 0.5 μm in edge length. A small number of large rods and high aspect ratio {100} tabular grains were present, but did not constitute a useful quantity of the grain population.

A representative sample of the grains of this emulsion is shown in FIG. 2.

A color photographic element of the present invention can comprise a single radiation-sensitive emulsion layer on a support. Alternatively, the element can contain a radiation-sensitive layer coated on each side of a support, a so-called Duplitized TM format. Particularly useful embodiments, however, are multicolor multilayer elements that contain a red light-sensitized, a green light-sensitized, and a blue light-sensitized unit, each unit containing at least one dye image-forming compound in reactive association with a radiation-sensitive silver halide emulsion.

If desired, the color photographic element of the invention can be used in conjunction with an applied magnetic layer as described in Research Disclosure, November 1992, Item 34390.

Following are some preferred layer order arrangements for multicolor elements of the invention. Not shown in these formats are antihalation layers, which are applied in immediate proximity to, and on either side of, the support. Also not shown are protective overcoat layers, which can contain gelatin, dyes, ultraviolet light absorbers, polymeric beads, and the like, and are applied above the uppermost dye image-forming unit.

A typical multicolor, multilayer format for an element of the invention is represented by Structure I.

STRUCTURE I

| | | |
|---|---|---|
| Blue-sensitized yellow dye image-forming silver halide emulsion unit | fast / slow | fast / medium / slow |
| Interlayer | | |
| Green-sensitized magenta dye image-forming siliver halide emulsion unit | fast / slow | fast / medium / slow |
| Interlayer | | |
| Red-sensitized cyan dye image-forming silver halide emulsion unit | fast / slow | fast / medium / slow |
| ////// Support ////// | | |

The red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are typically separated from each other by interlayers, as shown.

Each of the image-forming units can contain a single radiation-sensitive silver halide emulsion layer. Alternatively, each unit can independently contain two or three layers of differing sensitivity, referred to, respectively, as slow, fast or slow, medium, fast in order of increasing radiation sensitivity. In the practice of the present invention, a tabular silver chloride emulsion containing grains bounded by {100} major faces and in reactive association with a dye image-forming compound and a PUG-releasing compound can be contained in the blue-sensitized silver halide emulsion unit only, or it can be contained in each of the silver halide emulsion units. Where a unit contains more than one radiation-sensitive layer, the tabular silver chloride emulsion can be in the layer of lowest sensitivity (the slow layer), or it can be in other or all the emulsion layers in the unit.

Another useful multicolor, multilayer format for an element of the invention is the so-called inverted layer order represented by Structure II.

| STRUCTURE II | | |
|---|---|---|
| Green-sensitized magenta dye image-forming silver halide emulsion unit | fast / slow | fast / medium / slow |
| Interlayer | | |
| Red-sensitized cyan dye image-forming silver halide emulsion unit | fast / slow | fast / medium / slow |
| Interlayer | | |
| Blue-sensitized yellow dye image-forming silver halide emulsion unit | fast / slow | fast / medium / slow |
| ////// Support ////// | | |

The blue-sensitized, yellow dye image-forming silver halide unit is situated nearest the support, followed next by the red-sensitized, cyan dye image-forming unit, and uppermost the green-sensitized, magenta dye image-forming unit. As shown, the individual units are typically separated from one another by interlayers.

As described above for Structure I, each of the image-forming units can comprise a single radiation-sensitive layer, or each can independently include two (slow, fast) or three (slow, medium, fast) silver halide emulsion layers of differing sensitivity. Again, as described for Structure I, a tabular silver chloride emulsion containing grains bounded by {100} major faces can be located in the blue-sensitized silver halide emulsion unit only, or it can be in each of the units. Where a unit comprises more than one radiation-sensitive layer, the tabular silver chloride emulsion can be in the layer of lowest sensitivity, or in other or all of the layers in the unit.

Another suitable layer order arrangement for the practice of the present invention is described by Structure III.

| STRUCTURE III | | |
|---|---|---|
| Blue-sensitized yellow dye image-forming silver halide emulsion unit | fast / slow | fast / medium / slow |
| Interlayer | | |
| Green-sensitized magenta dye image-forming silver halide emulsion unit | fast | |
| Interlayer | | |
| Red-sensitized cyan dye image-forming silver halide emulsion unit | fast | |

-continued

| STRUCTURE III | | |
|---|---|---|
| Interlayer | | |
| Green-sensitized magenta dye image-forming silver halide emulsion unit | slow | medium / slow |
| Interlayer | | |
| Red-sensitized cyan dye image-forming silver halide emulsion unit | slow | medium / slow |
| ////// Support ////// | | |

In Structure III a slower red-sensitized silver halide emulsion layer of the cyan dye image-forming unit is situated nearest the support, followed in order by a slower green-sensitized silver halide emulsion layer of the magenta dye image-forming unit, a fast red-sensitized silver halide emulsion layer of the cyan dye image-forming unit, and a fast green-sensitized silver halide emulsion layer of the magenta dye image-forming unit. Uppermost is the blue-sensitized yellow dye image-forming silver halide emulsion unit, which can comprise one, two, or three emulsion layers. As with the previously described structures, image-forming units are typically separated from each other by interlayers. Elements of the present invention having the layer order shown in Structure III can contain tabular silver chloride emulsions having grains bounded by {100} major faces in the slow emulsion layer of the yellow dye image-forming unit, as well as in the faster emulsion layers of this unit. Tabular silver halide emulsions can also be employed in the layers of lowest sensitivity in the green- and/or red-sensitized emulsion units, as well as in all of the other radiation-sensitive layers of the element.

Still another useful format for a color element of the invention is represented by Structure IVa.

| STRUCTURE IVa | | |
|---|---|---|
| Green-sensitized magenta dye image-forming silver halide emulsion unit | fast | |
| Interlayer | | |
| Red-sensitized cyan dye image-forming silver halide emulsion unit | fast | |
| Interlayer | | |
| Blue-sensitized yellow dye image-forming silver halide emulsion unit | fast / slow | fast / medium / slow |
| Interlayer | | |
| Green-sensitized magenta dye image-forming silver halide emulsion unit | slow | medium / slow |
| Interlayer | | |
| Red-sensitized cyan dye image-forming silver halide emulsion unit | slow | medium / slow |
| ////// Support ////// | | |

In Structure IVa the slower silver halide emulsion layers of the red-sensitized and the green-sensitized emulsion units are separated from the fast silver halide emulsion layers of these units by the blue-sensitized emulsion unit, which can comprise one, two, or three emulsion layers. In accordance with the present invention, emulsions with silver halide grains bounded by {100} major faces can be employed in the overlying fast layers in the green- and red-sensitized silver halide emulsion units, as well as in the blue-sensitized silver halide emulsion unit, or they can be used in all of the radiation-sensitive layers of the element.

A variant of Structure IVa is Structure IVb (not shown), in which the positions of the slower and the fast silver halide emulsion layers are transposed in both the red-sensitized and in the green-sensitized emulsion units; i.e., the positions of the slower and the fast green-sensitized emulsion layers are reversed from their positions in Structure IVa, as are the positions of the red-sensitized emulsion layers. In Structure IVb, the emulsions with tabular {100}-faced silver chloride grains can be situated in the overlying slower layers in the green- and red-sensitized silver halide emulsion units, or they can be utilized in all of the radiation-sensitive layers of the element.

Other layer order arrangements suitable for multicolor elements of the invention are described on pages 35 to 37 of *Research Disclosure*, January 1983, Item 22534.

The invention can be better appreciated by reference to the following Examples. In each of the following Examples, the color photographic elements exhibited an unexpectedly high level of image sharpness. This image sharpness is sufficiently striking to be evident upon simple observation of the processed elements. Such sharpness is believed to be attributable to the unique morphology of the tabular {100} silver halide grains which provides refractive index values that are very close to those of the dispersing medium present in the emulsion layers.

EXAMPLE 1

Preparation and Description Of Silver Halide Emulsions

Control silver halide emulsions and tabular silver chloride emulsions bounded by {100} major faces in accordance with the present invention were prepared and sensitized as described below. The emulsions and a summary of their characteristics are listed in Table 5.

The cubic silver chloride control emulsions, whose grains have predominantly {100} faces, were prepared according to procedures described in U.S. Pat. No. 4,952,491 and in Section I of *Research Disclosure*, Item 308119, December 1989. These emulsions were sensitized to green, blue, or red light by methods known in the art.

The cubic silver iodobromide emulsions were prepared by the procedures contained in Section I of *Research Disclosure*, Item 308119, December 1989. Sensitization was carried out by methods known in the art.

Tabular silver iodobromide emulsions were prepared and sensitized by procedures recorded in U.S. Pat. No. 4,439,520, *Research Disclosure*, Item 22534, January 1983, and *Research Disclosure*, Item 308119, December 1989.

Following are illustrative procedures for the preparation of tabular silver chloride emulsions bounded by {100} major faces that are useful in the practice of the present invention.

TABLE 5

Characteristics of exemplary silver halide emulsions

| Emulsion ID | | Characteristics | Sensitization |
|---|---|---|---|
| EM-1c | Control | Cubic AgCl<br>Average edge length 0.28 μm | Green |
| EM-2c | Control | Cubic AgCl<br>Average edge length 0.6 μm | Green |
| EM-3c | Control | Cubic AgCl<br>Average edge length 0.96 μm | Green |
| EM-4 | Invention | Tabular grain AgCl<br>Average ECD 1.2 μm<br>Average Thickness 0.12 μm | Green |
| EM-5 | Invention | Tabular AgCl<br>Average ECD 1.4 μm<br>Average Thickness 0.14 μm | Green |
| EM-6c | Control | Cubic grain AgCl<br>Average edge length 0.28 μm | Red |
| EM-7 | Invention | Tabular AgCl<br>Average ECD 1.2 μm<br>Average Thickness 0.12 μm | Red |
| EM-8 | Invention | Tabular AgCl<br>Average ECD 1.4 μm<br>Average Thickness 0.14 μm | Red |
| EM-9c | Control | Cubic grain AgCl<br>Average edge length 0.28 μm | Blue |
| EM-10 | Invention | Tabular grain AgCl<br>Average ECD 1.2 μm<br>Average thickness 0.12 μm | Blue |
| EM-11 | Invention | Tabular AgCl<br>Average ECD 1.4 μm<br>Average thickness 0.14 μm | Blue |
| EM-12c | Control | Cubic AgCl<br>Average edge length 0.6 μm | Blue |
| EM-13c | Control | Cubic AgIBr<br>4 mol % I<br>Average edge length 0.55 μm | Red |
| EM-14c | Control | Tabular AgIBr<br>4 mol % I<br>Average ECD 1.3 μm<br>Average thickness 0.12 μm | Green |

A. Preparation of emulsions EM-4, EM-7, and EM-10
Six solutions were prepared as follows:

| | |
|---|---|
| **Solution 1** | |
| Gelatin (bone) | 105 g |
| NaCl | 1.96 g |
| Distilled water | 5798 g |
| **Solution 2** | |
| KI | 0.36 g |
| Distilled water | 180 g |
| **Solution 3** | |
| NaCl | 199 g |
| Distilled water | 6730 mL |
| **Solution 4** | |
| $AgNO_3$ 5.722 molar | 510 g |
| Distilled water to total volume | 6300 mL |
| **Solution 5** | |
| Gelatin (phthalated) | 100 g |
| Distilled water | 1000 g |
| **Solution 6** | |
| Gelatin (bone) | 80 g |
| Distilled water | 1000 g |

Solution 1 was charged into a reaction vessel equipped with a stirrer. Solution 2 was added to the reaction vessel. While the mixture, which was at a pH of 6.0 and a temperature of 40° C. , was vigorously stirred, Solution 3 and Solution 4 were added at 80 mL/min. for 0.5 minute. The VAg was adjusted to 175 mV, and the mixture was held for ten minutes. Following this hold, Solution 3 and Solution 4 were added simultaneously at 24 mL/in. for 40 minutes; then the flow was linearly accelerated from 24 mL/min. to 48 mL/min. over 130 minutes, while the VAg was maintained at 175 mV. Solution 5 was added and stirred for 5 minutes. The pH was then adjusted to 3.8, and the gel was allowed to settle while the temperature was lowered to 15° C. . The liquid layer was decanted, and the depleted volume was restored with distilled water. The pH was adjusted to 4.5, and the mixture held at 40° C. for 5 minutes before the pH was adjusted to 3.8 and the settling and decanting steps were repeated. Solution 6 was added, and the pH and VAg were adjusted to 5.6 and 130 mV, respectively.

The resulting emulsion contained tabular silver chloride grains having predominantly {100} faces, an average equivalent circular diameter (ECD) of 1.2 μm, and an average thickness of 0.12 μm.

The emulsion thus produced was sensitized to green light by treating it with 1 percent NaBr, holding for 5 minutes, adding spectral sensitizing dyes SS-22 and SS-26 at a 3:1 ratio, holding for 10 minutes, adding $Na_2S_2O_3.5H_2O$ at 1.0 mg per mol and $KAuCl_4$ at 1.3 mg per mol, and heating for 10 minutes at 60° C. to produce EM-4, a green light sensitized emulsion. Similarly, red light sensitized emulsion EM-7 was obtained using spectral sensitizing dyes SS-25 and SS-23 at 1:2 ratio, and blue light sensitized emulsion EM-10 was obtained using spectral sensitizing dye SS-1.

B. Preparation of emulsions EM-5, EM-8, and EM-11
Eight solutions were prepared as follows:

| | |
|---|---|
| **Solution 1** | |
| Gelatin (bone) | 211 g |
| NaCl | 1.96 g |
| Distilled water | 5800 g |
| **Solution 2** | |
| KI | 0.15 g |
| Distilled water | 90 g |
| **Solution 3** | |
| NaCl | 207 g |
| Distilled water | 7000 mL |
| **Solution 4** | |
| NaCl | 13.1 g |
| Distilled water | 108 mL |
| **Solution 5** | |
| $AgNO_3$ 5.722 molar | 69.8 g |
| Distilled water | 5425 mL |
| **Solution 6** | |
| $AgNO_3$ 5.722 molar | 69.8 g |
| Distilled water | 73.7 mL |
| **Solution 7** | |
| Gelatin (phthalated) | 100 g |
| Distilled water | 1000 g |
| **Solution 8** | |
| Gelatin (bone) | 80 g |
| Distilled water | 1000 g |

Solution 1 was charged into a reaction vessel equipped with a stirrer at 40° C. Solution 2 was added to the reaction vessel, and the pH was adjusted to 5.7. While the mixture was vigorously stirred, Solution 4 and Solution 6 were added at 180 mL/min. for 30 seconds. The reaction mixture was then held for 10 minutes. Following this hold, Solution 3 and Solution 5 were added simultaneously at 24 mL/min. for 40 minutes, while the pCl was maintained at 1.91. The rate was then accelerated to 48 mL/min. over 130 minutes. The mixture was cooled to 40° C.; Solution 7 was added, and the mixture was stirred for 5 minutes. The pH was then adjusted to 3.8, and the gel was allowed to settle while the temperature was lowered to 15° C. The liquid layer was decanted, and the depleted volume was restored with distilled water. The pH was adjusted to 4.5, and the mixture was held at 40° C. for 20 minutes before the pH was adjusted to 3.8 and the settling and decanting steps were repeated. Solution 8 was added, and the pH and pCl were adjusted to 5.6 and 1.6, respectively.

The resulting emulsion contained tabular silver chloride grains having predominantly {100} faces, and average equivalent circular diameter (ECD) of 1.4 μm, and an average thickness of 0.14 μm.

The emulsion thus produced was sensitized to green light by treating it with 1 percent NaBr, holding for 5 minutes, adding spectral sensitizing dyes SS-22 and SS-26 at a 3:1 ratio, holding for 10 minutes, adding $Na_2S_2O_3.5H_2O$ at 1.0 mg per mol and $KAuCl_4$ at 1.3 mg per mol, and heating for 10 minutes at 60° C. to produce EM-5. Similarly, red light sensitized emulsion EM-8 was obtained using spectral sensitizing dyes SS-25 and SS-23 at a 1:2 ratio, and blue light sensitized emulsion EM-11 was obtained using spectral sensitizing dye SS-1.

C. Preparation of large tabular silver chloride emulsions

Following is an exemplary procedure for the preparation of large (ECD greater than 2 μm) tabular silver chloride emulsions.

To a stirred reaction vessel containing 2945 mL of a solution at 55° C. and pH 6.5 that contained 1.77 percent by weight bone gelatin, 0.0056M sodium chloride, $1.86\times10^{-4}$M potassium iodide, 15 mL of a 4.0M silver nitrate solution and 15 mL of a 4.0M sodium chloride solution were each added concurrently at a rate of 30 mL/min.

The mixture was then held for 5 minutes; 7000 mL of distilled water was added and the temperature was raised to 65° C. , while the pCl was adjusted to 2.15 and the pH to 6.5. Following the hold, the size of the resulting grains was increased through growth using a dual-zone process. In this process, a solution of 0.67M silver nitrate was premixed with a 0.67M solution of sodium chloride and a solution of 0.5 percent by weight bone gelatin at a pH of 6.5, in a well-agitated continuous reactor with a total volume of 30 mL. The effluent from this premixing reactor was then added to the original reaction vessel, which during this step acted as a growth reactor. During the growth step, the fine crystals from the continuous reactor were ripened onto the original crystals through Ostwald ripening. The total suspension volume of the growth reactor during this growth step was maintained constant at 13.5 L using ultrafiltration.

The flow rates of the 0.67M silver nitrate solution and the 0.67M sodium chloride solution were linearly increased from 20 to 80 mL/min, 150 mL/min, and 240 mL/min in 25 minute intervals. The flow rate of the 0.5 percent gelatin reactant was maintained constant at 500 mL/min. The continuous reactor in which these reactants were premixed was kept at 30° C. and a pCl of 2.45, while the growth reactor was maintained at a temperature of 65° C. , a pCl of 2.15, and a pH of 6.5.

This procedure resulted in 6 moles of a high aspect ratio tabular grain iodochloride emulsion containing 0.01 mole % iodide. More than 90% of the total projected grain area was provided by tabular grains having {100} major faces, an average ECD of 2.55 μm, and an average thickness of 0.165 μm. Therefore, the tabular grain population had an average aspect ratio of 15.5 and an average tabularity of 93.7.

This emulsion was sensitized to red light by treating it with 1 percent NaBr, holding for 5 minutes, adding spectral sensitizing dye (SS-103 and SS-104 at 2:1 ratio), holding for 10 minutes, adding $Na_2S_2O_3.5H_2O$ at 1.0 mg per mol and $KAuCl_4$ at 1.3 mg per mol, and heating for 10 minutes at 60° C.

EXAMPLE 2

Preparation and Processing of Photographic Elements

A. Preparation of elements

Sample 101 was prepared by applying the following layers to a clear support in the order indicated. Quantities of components are expressed in grams per square meter.

Layer 1 (antihalation layer) comprising gray silver and gelatin.

Layer 2 (light sensitive layer) comprising 0.32 g of EM-1c, 0.54 g of image dye forming coupler C-1 and 1.54 g gelatin.

Layer 3 (protective layer) comprising 2.15 g of gelatin.

The layers additionally comprised α-(4-nonylphenyl)-ω-hydroxypropyl[oxy(2-hydroxyl-1,3-propanediyl] propanediyl)) and (para-t-octylphenyl)-di(oxy-1,2-ethanediyl) sulfonate as surfactants.

This film was hardened at coating with 2% by weight to total gelatin of bis(vinylsulfonylmethane.

Sample 102 was prepared like sample 101 except that emulsion EM-1c was replaced by an equal quantity of emulsion EM-2c.

Sample 103 was prepared like sample 101 except that emulsion EM-1c was replaced by an equal quantity of emulsion EM-3c.

Sample 104 was prepared like sample 101 except that emulsion EM-1c was replaced by an equal quantity of emulsion EM-4.

Sample 105 was prepared like sample 101 except that emulsion EM-1c was replaced by an equal quantity of emulsion EM-5.

Sample 106 was prepared like sample 105 except that image dye forming coupler C-1 was replaced by 0.32 g of image dye forming coupler C-2.

Sample 107 was prepared like sample 101 except that emulsion EM-1c was replaced by an equal quantity of emulsion EM-6c.

Sample 108 was prepared like sample 101 except that emulsion EM-1c was replaced by an equal quantity of emulsion EM-7.

Sample 109 was prepared like sample 101 except that emulsion EM-1c was replaced by an equal quantity of emulsion EM-8.

Sample 110 was prepared like sample 101 except that emulsion EM-1c was replaced by an equal quantity of emulsion EM-9c and image dye-forming coupler C-1 was replaced by 1.08 g of image dye-forming coupler C-3.

Sample 111 was prepared like sample 110 except that emulsion EM-9c was replaced by an equal quantity of emulsion EM-10.

Sample 112 was prepared like sample 110 except that emulsion EM-9c was replaced by an equal quantity of emulsion EM-11.

Coupler C-1 is a cyan image dye-forming coupler; C-2 is a magenta image dye-forming coupler; and C-3 is a yellow image dye-forming coupler. The couplers were provided as photographic coupler dispersions, as known in the art.

B. Measurement of relative sensitivity and dye density yield for processed elements Samples 101–112 were exposed to white light through a graduated density test object and processed using the KODAK® C-41 process. The process was modified in that the bleach solution comprised ferric propylenediamine-tetraacetate.

The photographic sensitivity was measured as the exposure required to enable a Status M density of 0.15 above Dmin after processing. The Status M density at a Dmax value was also measured.

Table 6, below, lists for each sample: the emulsion identity; surface area per grain; color sensitization; dye image-forming coupler; the experimentally observed relative sensitivity; the relative sensitivity expected assuming that, for a spectrally sensitized emulsion, the sensitivity is a linear function of grain surface area; and the Status M dye density formed at Dmax per gram of coupler coated per square meter per gram of silver per square meter in each sample, i.e., the normalized dye-density yield (DDY).

TABLE 6

Sensitivity and dye yield in a color process.

| Sample | Emulsion ID | Emulsion Sensitization | Image-Forming Coupler | Surface Area ($\mu m^2$) | Relative-Sensitivity Found | Relative-Sensitivity Expected | DDY | |
|---|---|---|---|---|---|---|---|---|
| 101 | EM-1c | green | C-1 | 0.47 | 1.00 | 1.0x | 7.41 | control |
| 102 | EM-2c | green | C-1 | 2.16 | 1.29x | 4.6x | 5.69 | control |
| 103 | EM-3c | green | C-1 | 5.59 | 1.95x | 11.8x | 3.61 | control |
| 104 | EM-4 | green | C-1 | 2.71 | 6.91x | 5.8x | 5.85 | invention |
| 105 | EM-5 | green | C-1 | 3.69 | 14.12x | 7.8x | 5.50 | invention |
| 106 | EM-5 | green | C-2 | 3.69 | 19.05x | 7.8x | 13.66 | invention |
| 107 | EM-6c | red | C-1 | 0.47 | 1.00x | 1.0x | 7.12 | control |
| 108 | EM-7 | red | C-1 | 2.71 | 6.45x | 5.8x | 5.50 | invention |
| 109 | EM-8 | red | C-1 | 3.69 | 8.51x | 7.8x | 5.17 | invention |

TABLE 6-continued

| Sample | Emulsion ID | Emulsion Sensitization | Image-Forming Coupler | Surface Area ($\mu m^2$) | Relative-Sensitivity Found | Relative-Sensitivity Expected | DDY | |
|---|---|---|---|---|---|---|---|---|
| | | | Sensitivity and dye yield in a color process. | | | | | |
| 110 | EM-9c | blue | C-3 | 0.47 | 1.00x | 1.0x | 3.01 | control |
| 111 | EM-10 | blue | C-3 | 2.71 | 16.59x | 5.8x | 3.35 | invention |
| 112 | EM-11 | blue | C-3 | 3.69 | 21.41x | 7.8x | 3.27 | invention |

The results obtained with control samples 101, 102 and 103 illustrate the difficulty of achieving either high photographic sensitivity or high values of dye-density yield with cubic shaped {100} AgCl grains. As the grain size (and surface area) increases, photographic sensitivity hardly increases at all while dye density yield falls dramatically. Although the photographic sensitivity would be expected to increase directly as a function of surface area per grain for spectrally sensitized emulsions, this expectation was not fulfilled for the control samples. Conversely, samples 104 and 105 of the invention showed photographic sensitivity greatly exceeding that expected based on relative grain surface area. Moreover, the dye density yield achieved in these samples exceeded that available from even less photographically sensitive control samples.

The results from sample 106 of the invention demonstrates that both the sensitivity and dye density yield can be further improved by choosing image dye-forming couplers that require a lower stoichiometric quantity of oxidized developer for dye formation (coupler C-2 is a 2-equivalent image coupler; coupler C-1 is a 4-equivalent image coupler), or by choosing an image coupler that forms a high extinction image dye.

The results from samples 107 through 109 and from samples 110 through 112 show that these beneficial effects were also obtained from samples of the invention that are sensitive to red and blue light, respectively.

As can be readily appreciated, the photographic samples according to this invention provide not only greatly improved photographic sensitivity compared to the control samples but also provide surprisingly high dye density formation relative to the control samples.

The above-described samples were exposed to white light through a graduated density test object and developed for 195 seconds using the color paper developer described in U.S. Pat. No. 4,892,804. Results like those shown in Table 1 were obtained.

The exposure and processing procedures using the Kodak® C-41 process as described above were repeated with samples 101–112, using development times of one minute, two minutes, three minutes, four minutes, and five minutes. Improved performance of elements of the invention relative to those of the control samples was again observed in all cases.

Changes in contact time of a photographic material with a processing solution are typically employed by those skilled in the art to approximate the effects of changes in temperature or the concentration of components in the processing solution. Thus, a longer process time approximates the effect of increased component concentration or temperature, or both, whereas a shorter process time approximates the effect of decreased component concentration or temperature, or both. These effects are well known to skilled practitioners of the photographic arts, who are thus able to choose process compositions and temperatures to achieve desirable results for particular applications from elements of the present invention.

EXAMPLE 3

Preparation and Processing of Photographic Elements Containing PUG-Releasing Compounds That Release Development Inhibitors A. Preparation of elements Control samples 201 through 205 were prepared by applying the following layers to a clear support in the order indicated. Quantities of components are expressed in grams per square meter.

Layer 1 (antihalation layer) comprising gray silver and gelatin.

Layer 2 (light sensitive layer) comprising 0.54 g of EM-13c, 0.54 g of image dye forming coupler C-1, 1.54 g gelatin, and amounts of various DIR compounds as listed in Table 7, below.

Layer 3 (protective layer) comprising 2.15 g of gelatin.

The layers additionally comprised α-(4-nonylphenyl)-ω-hydroxy-poly[oxy(2-hydroxy-1,3-propanediyl] and (para-t-ocytlphenyl)-di(oxy-1,2-ethanediyl) sulfonate as surfactants.

These films were hardened at coating with 2% by weight to total gelatin of bis(vinylsulfonylmethane.

Control samples 206 through 211 were prepared like samples 201–205, except that emulsion EM-13c was replaced by an equal weight of emulsion EM-14c.

Control samples 301 through 303 were prepared like samples 201–205, except that emulsion EM-13c was replaced by an equal weight of emulsion EM-6c.

Control samples 304 through 306 were prepared like samples 201–205, except that emulsion EM-13c was replaced by an equal weight of emulsion EM-9c.

Control samples 307 through 311 were prepared like samples 201–205, except that emulsion EM-13c was replaced by an equal weight of emulsion EM-12c.

Control samples 312 through 315 were prepared like samples 201–205, except that emulsion EM-13c was replaced by an equal weight of emulsion EM-3c.

Samples 316 through 321 were prepared like samples 201–205, except that emulsion EM-13c was replaced by an equal weight of emulsion EM-4.

Samples 322 through 329 were prepared like samples 201–205, except that emulsion EM-13c was replaced by an equal weight of emulsion EM-4.

B. Effects of PUG-releasing compounds that release development inhibitors on processed elements Samples 201 through 329 were exposed to light through a graduated density test object and processed as color negative films according to the KODAK® C-41 process. The process was modified in that the bleach solution comprised ferric propylenediamine-tetraacetate.

The useful latitude of each sample was quantified by determining the exposure required to enable a Status M density 0.10 above Dmin and the exposure required to enable a Status M density 0.10 below Dmax for each sample. The larger the difference in exposure, the greater the useful latitude of the sample. Combinations of emulsions and development inhibitor-releasing (DIR) compounds that enable a large increase in latitude can be especially useful. In addition, the photographic gamma of each sample was quantified as the rate of change of the Status M density obtained after processing as a function of log exposure, at exposure values towards the center of the samples' useful latitude. Combinations of emulsions and DIR compounds that enable a significant decrease in gamma can also be especially useful.

Table 7, below, lists for each sample: the emulsion identification; the DIR compound identification and amount (in grams per square meter); the relative gamma of the processed element (in each case normalized to the corresponding control sample prepared without a DIR compound); and, the relative latitude of the processed element (in each case normalized to the corresponding control sample prepared without a DIR compound).

Samples 201 through 211 contain either cubic or tabular shaped silver iodobromide emulsions similar to those typically employed in combination with DIR compounds. The results illustrate the large increase in latitude and the large decrease in gamma enabled by these combinations. Thus, it is well within the skill of photographic practitioners to combine particular quantities and identities of DIR compounds with silver iodobromide emulsions to achieve a variety of latitude and gamma positions as needed for specific applications.

Samples 301 through 315 contain cubic shaped silver chloride emulsions known in the art. The results demonstrate that combinations of these cubic silver chloride emulsions with a variety of DIR compounds typically leads to, at best, a very modest increase in useful latitude and a modest reduction in gamma. In some cases latitude was truncated, while in others gamma was increased. This behavior can be related to gross sensitivity losses encountered with these combinations, or to changes in Dmin.

Samples 317–321 and 323–329 illustrate the combination of tabular shaped {100} surface AgCl crystals and DIR compounds, in accordance with the present invention.

TABLE 7

Effects of DIR compounds on gamma and latitude

| Sample | Emulsion | DIR Compound and quantity | Relative Gamma | Relative Latitude |
|---|---|---|---|---|
| 201 control | EM-13c (AgIBr cube) | none | 100.0 | 100.0 |
| 202 control | EM-13c | D-2 (0.032) | 30.5 | 457.0 |

TABLE 7-continued

Effects of DIR compounds on gamma and latitude

| Sample | Emulsion | DIR Compound and quantity | Relative Gamma | Relative Latitude |
|---|---|---|---|---|
| 203 control | EM-13c | D-1 (0.029) | 79.0 | 339.0 |
| 204 control | EM-13c | D-3 (0.031) | 80.0 | 240.0 |
| 205 control | EM-13c | D-4 (0.037) | 79.0 | 427.0 |
| 206 control | EM-14c (AgIBr tabular) | none | 100.0 | 100.0 |
| 207 control | EM-14c | D-2 (0.032) | 40.9 | 776.0 |
| 208 control | EM-14c | D-1 (0.058) | 81.3 | 331.0 |
| 209 control | EM-14c | D-4 (0.074) | 52.3 | 550.0 |
| 210 control | EM-14c | D-6 (0.061) | 77.3 | 537.0 |
| 211 control | EM-14c | D-7 (0.081) | 79.5 | 219.0 |
| 301 control | EM-6c (AgCl cube) | none | 100.0 | 100.0 |
| 302 control | EM-6c | D-1 (0.043) | 89.5 | 96.6 |
| 303 control | EM-6c | D-2 (0.043) | 107.2 | 106.8 |
| 304 control | EM-9c (AgCl cube) | none | 100.0 | 100.0 |
| 305 control | EM-9c | D-1 (0.058) | 110.0 | 132.0 |
| 306 control | EM-9c | D-2 (0.032) | 169.0 | 50.0 |
| 307 control | EM-12c (AgCl cube) | none | 100.0 | 100.0 |
| 308 control | EM-12c | D-1 (0.058) | 96.0 | 132.00 |
| 309 control | EM-12c | D-2 (0.032) | 109.5 | 112.0 |
| 310 control | EM-12c | D-3 (0.031) | 104.8 | 112.0 |
| 311 control | EM-12c | D-4 (0.037) | 89.7 | 120.0 |
| 312 control | EM-3c (AgCl cube) | none | 100.0 | 100.0 |
| 313 control | EM-3c | D-2 (0.032) | 104.3 | 181.0 |
| 314 control | EM-3c | D-1 (0.058) | 108.6 | 178.0 |
| 315 control | EM-3c | D-4 (0.073) | 87.0 | 100.0 |
| 316 control | EM-4 (AgCl {100} tabular) | none | 100.0 | 100.0 |
| 317 invention | EM-4 | D-2 (0.032) | 73.6 | 281.8 |
| 318 invention | EM-4 | D-1 (0.058) | 54.9 | 288.4 |
| 319 invention | EM-4 | D-3 (0.031) | 73.6 | 302.0 |
| 320 invention | EM-4 | D-4 (0.037) | 58.2 | 316.0 |
| 321 invention | EM-4 | D-5 (0.027) | 89.0 | 174.0 |
| 322 control | EM-5 (AgCl {100} tabular) | none | 100.0 | 100.0 |
| 323 invention | EM-5 | D-2 (0.032) | 73.3 | 525.0 |
| 324 invention | EM-5 | D-1 (0.058) | 61.4 | 1072.0 |
| 325 invention | EM-5 | D-4 (0.073) | 52.3 | 575.0 |
| 326 invention | EM-5 | D-6 (0.055) | 59.6 | 355.0 |
| 327 invention | EM-5 | D-7 (0.081) | 90.4 | 468.0 |
| 328 invention | EM-5 | D-3 (0.031) | 86.8 | 218.0 |
| 329 invention | EM-5 | D-5 (0.032) | 75.0 | 121.0 |

It will be readily appreciated that the samples comprising combinations of light sensitive {100}-faced tabular silver chloride emulsions and DIR compounds in accordance with the present invention produce useful reductions in gamma simultaneously with large increases in latitude. These results are very surprising since the known {100}-faced cubic silver chloride emulsions typically exhibit increased gamma (an undesirable effect) and only modest increases in latitude when employed in combination with DIR compounds. It is especially noteworthy that the elements of the present invention simultaneously enable both larger increases in latitude and greater suppression of gamma than is achieved with combinations of emulsions and DIR compounds that have been optimized over many years by many practitioners of the photographic arts.

The exposure and processing procedures using the Kodak® C-41 process and analysis of data as described above were repeated with samples 201–211 and 301–329, using development times of one minute, two minutes, three minutes, four minutes, and five minutes. The improvements in latitude and decreases in gamma previously observed for elements of the invention relative to the control samples were maintained.

As previously discussed in Example 2, changes in contact time of a photographic material with a processing solution are typically employed by those skilled in the photographic art to approximate the effects of changes in temperature or the concentration of components in the processing solution. By such means, skilled practioners of the photographic arts are able to choose, in accordance with the present invention, a process time and composition, DIR compound, dye image-forming compound, and sensitized {100}-faced silver chloride tabular grain emulsion for a particular application.

EXAMPLE 4

Preparation and Processing of Elements Containing Various Image Dye-Forming and PUG-releasing Coupler Compounds A. Preparation of elements Samples 901 through 969 were prepared generally as described for sample 101 of Example 2. All of these samples were coated on a transparent support. Samples 970 through 972 were coated on a reflective support. All of these elements represent further illustrations of the practice of this invention. The identification and quantity of the silver halide emulsion and the identification and quantity of the image dye-forming and PUG-releasing coupler compounds employed in each sample are provided in Table 8 below.

B. Dye density yields from processed elements

The samples were exposed to light through a graduated density test object and processed using the Kodak® C-41 process. The process was modified in that the bleach solution comprised ferric propylenediaminetetraacetate. In each case the status M density in the red, green or blue band corresponding to the peak absorption wavelength exhibited by the sample was employed. Transmission density was measured for samples 901 through 969; reflection density was measured for samples 970 through 972.

Table 8 shows the identity and quantity of the emulsion and coupler compounds employed in each element. The normalized dye density yield (DDY) observed for each sample and the wavelength band employed (R, G or B) is also shown.

TABLE 8

Normalized dye density (DDY) from processed samples. Quantities of couplers and other compounds are listed in grams per meter squared.

| Sample | Emulsion (quantity) | | Image Dye-Forming and PUG Releasing; Coupler Compounds (quantity) | | | | | | DDY |
|---|---|---|---|---|---|---|---|---|---|
| 901 | EM-5 | (0.538) | C-5 | (0.646) | | | | | 7.20 R |
| 902 | EM-5 | (0.538) | C-6 | (0.646) | | | | | 4.95 R |
| 903 | EM-5 | (0.538) | C-7 | (0.646) | | | | | 5.03 R |
| 904 | EM-5 | (0.538) | C-8 | (0.646) | | | | | 6.15 R |
| 905 | EM-5 | (0.538) | C-31 | (0.646) | | | | | 5.37 R |
| 906 | EM-5 | (0.538) | C-10 | (0.646) | | | | | 4.01 R |
| 907 | EM-5 | (0.538) | C-12 | (0.646) | | | | | 7.00 R |
| 908 | EM-5 | (0.538) | B-1 | (0.646) | | | | | 6.54 R |
| 909 | EM-5 | (0.538) | C-1 | (0.323) | +C-3 | (0.323) | | | 5.89 R<br>+4.76 B |
| 910 | EM-5 | (0.538) | C-25 | (0.323) | +C-20 | (0.323) | | | 2.49 B<br>+7.11 G |
| 911 | EM-5 | (0.538) | C-2 | (0.323) | +C-12 | (0.323) | | | 7.99 G<br>+7.69 R |
| 912 | EM-5 | (0.538) | C-41 | (0.215) | | | | | 3.56 R |
| 913 | EM-5 | (0.538) | C-42 | (0.215) | | | | | 4.17 R |
| 914 | EM-5 | (0.538) | C-13 | (0.646) | | | | | 3.64 G |
| 915 | EM-5 | (0.538) | C-14 | (0.646) | | | | | 8.61 G |
| 916 | EM-5 | (0.538) | C-26 | (0.646) | | | | | 3.67 B |
| 917 | EM-5 | (0.538) | B-32 | (0.646) | | | | | 4.70 B |
| 918 | EM-5 | (0.538) | C-3 | (0.646) | +D-18 | (0.065) | +B-1 | (0.005) | 4.17 B |
| 919 | EM-5 | (0.538) | C-2 | (0.646) | +D-18 | (0.065) | +B-1 | (0.005) | 7.11 G |
| 920 | EM-5 | (0.538) | C-31 | (0.646) | +D-18 | (0.065) | +B-1 | (0.005) | 5.58 R |
| 921 | EM-5 | (0.538) | C-17 | (0.646) | | | | | 7.95 G |
| 922 | EM-5 | (0.538) | C-31 | (0.646) | +B-1 | (0.054) | | | 4.97 R |
| 923 | EM-5 | (0.538) | C-31 | (0.646) | +B-1 | (0.054) | +D-26 | (0.054) | 4.96 R |
| 924 | EM-5 | (0.538) | C-31 | (0.646) | +B-6 | (0.054) | +D-26 | (0.054) | 4.68 R |
| 925 | EM-5 | (0.538) | C-31 | (0.646) | +D-19 | (0.054) | | | 5.66 R |
| 926 | EM-5 | (0.538) | C-31 | (0.646) | +D-19 | (0.054) | +C-41 | (0.054) | 4.89 R |
| 927 | EM-5 | (0.538) | C-31 | (0.646) | +D-25 | (0.054) | | | 5.24 R |
| 928 | EM-5 | (0.538) | C-31 | (0.646) | +D-27 | (0.054) | | | 5.23 R |
| 929 | EM-5 | (0.538) | C-31 | (0.646) | +B-1 | (0.054) | +D-3<br>+D-3 | (0.054)<br>(0.054) | 4.83 R |
| 930 | EM-5 | (0.538) | C-31 | (0.646) | +B-1 | (0.054) | +C-52 | (0.032) | |
| 931 | EM-10 | (0.430) | C-1 | (0.323) | | | | | 8.13 R |
| 932 | EM-10 | (0.430) | C-1 | (0.323) | +D-28 | (0.054) | | | 7.15 R |
| 933 | EM-10 | (0.430) | C-1 | (0.323) | +C-45 | (0.108) | | | 6.37 R |
| 934 | EM-10 | (0.430) | C-1 | (0.323) | +D-20 | (0.054) | | | 7.89 R |
| 935 | EM-10 | (0.430) | C-1 | (0.323) | +D-3 | (0.054) | | | 7.77 R |
| 936 | EM-10 | (0.430) | C-1 | (0.323) | +D-1 | (0.054) | | | 6.48 R |
| 937 | EM-10 | (0.430) | C-1 | (0.323) | +C-46 | (0.054) | | | 6.79 R |
| 938 | EM-10 | (0.430) | C-1 | (0.323) | +C-47 | (0.054) | | | 7.27 R |
| 939 | EM-10 | (0.430) | C-1 | (0.323) | +B-1 | (0.054) | +D-1 | (0.054) | 5.88 R |
| 940 | EM-10 | (0.430) | C-1 | (0.323) | +B-1 | (0.054) | +D-20 | (0.054) | 7.12 R |

TABLE 8-continued

| Sample | Emulsion (quantity) | Image Dye-Forming and PUG Releasing; Coupler Compounds (quantity) | | | | | | DDY |
|---|---|---|---|---|---|---|---|---|
| | | Normalized dye density (DDY) from processed samples. Quantities of couplers and other compounds are listed in grams per meter squared. | | | | | | |
| 941 | EM-10 (0.430) | C-1 (0.323) | +B-1 | (0.054) | +D-3 | (0.054) | | 6.86 R |
| 942 | EM-10 (0.430) | C-1 (0.323) | +D-29 | (0.108) | | | | 5.45 R |
| 943 | EM-10 (0.430) | C-1 (0.323) | +C-49 | (0.005) | | | | 7.98 R |
| 944 | EM-10 (0.430) | C-1 (0.323) | +C-50 | (0.005) | | | | 7.98 R |
| 945 | EM-10 (0.430) | C-1 (0.323) | +C-51 | (0.005) | | | | 7.99 R |
| 946 | EM-11 (0.538) | C-27 (1.078) | | | | | | 4.04 B |
| 947 | EM-11 (0.538) | C-3 (0.807) | +C-27 | (0.269) | | | | 3.33 B |
| 948 | EM-11 (0.538) | C-29 (1.078) | | | | | | 3.08 B |
| 949 | EM-11 (0.538) | C-28 (1.078) | | | | | | 2.58 B |
| 940 | EM-11 (0.538) | C-25 (1.078) | | | | | | 1.29 B |
| 951 | EM-11 (0.538) | C-37 (1.078) | | | | | | 4.39 B |
| 952 | EM-11 (0.538) | C-38 (1.078) | | | | | | 4.70 B |
| 953 | EM-11 (0.538) | C-3 (1.078) | +D-30 | (0.054) | | | | 3.49 B |
| 954 | EM-11 (0.538) | C-3 (1.078) | +D-19 | (0.054) | | | | 3.73 B |
| 955 | EM-11 (0.538) | C-3 (1.078) | +B-1 | (0.054) | | | | 3.47 B |
| 956 | EM-4 (0.538) | C-18 (0.430) | | | | | | 5.06 G |
| 957 | EM-4 (0.538) | C-15 (0.430) | | | | | | 8.08 G |
| 958 | EM-4 (0.538) | C-33 (0.430) | | | | | | 8.56 G |
| 959 | EM-4 (0.538) | C-16 (0.430) | | | | | | 11.59 G |
| 960 | EM-4 (0.538) | C-16 (0.323) | +C-15 | (0.107) | | | | 9.55 G |
| 961 | EM-4 (0.538) | C-34 (0.430) | | | | | | 11.67 G |
| 962 | EM-4 (0.538) | C-36 (0.430) | | | | | | 6.53 G |
| 963 | EM-4 (0.538) | C-22 (0.430) | | | | | | 6.01 G |
| 964 | EM-4 (0.538) | C-40 (0.430) | | | | | | 5.58 G |
| 965 | EM-4 (0.538) | C-15 (0.430) | +B-1 | (0.032) | | | | 7.95 G |
| 966 | EM-4 (0.538) | C-15 (0.430) | +D-30 | (0.032) | | | | 8.00 G |
| 967 | EM-4 (0.538) | C-15 (0.430) | +D-16 | (0.032) | | | | 7.56 G |
| 968 | EM-4 (0.538) | C-15 (0.430) | +C-40 | (0.032) | | | | 7.48 G |
| 969 | EM-4 (0.538) | C-15 (0.430) | +C-39 | (0.032) | | | | 7.28 G |
| 970 | EM-4 (0.538) | C-5 (0.430) | | | | | | 10.54 R |
| 971 | EM-4 (0.538) | C-20 (0.430) | | | | | | 11.32 G |
| 972 | EM-4 (0.538) | C-25 (0.430) | | | | | | 4.29 B |

The above-described results demonstrate the excellent dye density yields obtained with {100}-faced silver chloride tabular grain emulsions and a wide variety of dye image-forming coupler compounds, in combination with various PUG-releasing coupler compounds.

Samples 901 through 969 were exposed to white light through a graduated density test object and developed for 45 seconds in the color paper developer described in U.S. Pat. No. 4,892,804, then bleached and fixed. Good dye density formation from these elements was again observed.

EXAMPLE 5

Preparation and Processing of Elements Containing Various Development Inhibitor-Releasing (DIR) Coupler Compounds A. Preparation of elements Samples 401 through 412 were prepared by applying the following layers to a clear support in the order indicated. Quantities of components are expressed in grams per square meter.

Layer 1 (antihalation layer) comprising gray silver and gelatin.

Layer 2 (light sensitive layer) comprising 0.33 g of EM-5, 1.82 g gelatin, an image dye forming coupler and (0.54 g) and a DIR compound as listed in Table 9, below.

Layer 3 (protective layer) comprising 2.15 g of gelatin.

The layers additionally comprised α-(4-nonylphenyl)-ω-hydroxy-poly[oxy(2-hydroxy-1,3-propanediyl] and (para-t-octylphenyl)-di(oxy-1,2-ethanediyl) sulfonate as surfactants.

These films were hardened at coating with 2% by weight to total gelatin of bis(vinylsulfonylmethane).

B. Effects of DIR coupler compounds on resolving power of processed elements

Samples 401 through 412 were exposed to sinusoidal patterns of white light to determine the Modulation Transfer Function (MTF) Percent Response as a function of spatial frequency in the film plane. The samples were then processed using the KODAK® C-41 process. The bleach used in the process was modified to comprise 1,3-propylenediamine-tetraacetic acid. The exposed and processed elements were evaluated to determine the MTF Percent Response as a function of spatial frequency in the film plane. Specific details of this exposure—evaluation cycle can be found at R. L. Lamberts and F. C. Eisen, "A System for the Automatic Evaluation of Modulation Transfer Functions of Photographic Materials", in the *Journal of Applied Photographic Engineering*, vol. 6, pages 1–8, February 1980.

The MTF Percent Response of the light sensitive layers of these samples was monitored at several spatial frequencies. Higher values for MTF Percent Response indicate a sharper image. Additionally, the spatial frequency at which the MTF Percent Response dropped to 70%, which is a measure of resolving power, was determined. Higher spatial frequencies indicate a film with superior resolving power. The results of this test are also listed in Table 9.

TABLE 9

| Sample | Image-Forming Coupler | DIR Compound (quantity) | MTF Percent Response 5 c/mm | 10 c/mm | 20 c/mm | 50 c/mm | Resolving Power |
|---|---|---|---|---|---|---|---|
| 401 | C-1 | none | 90% | 82% | 86% | 61% | 38 c/mm |
| 402 | C-1 | D-2 (0.032) | 98% | 90% | 101% | 79% | 60 c/mm |
| 403 | C-1 | D-1 (0.058) | 98% | 93% | 104% | 79% | 70 c/mm |
| 404 | C-1 | D-3 (0.031) | 100% | 90% | 97% | 74% | 58 c/mm |
| 405 | C-1 | D-4 (0.037) | 100% | 95% | 102% | 78% | 72 c/mm |
| 406 | C-1 | D-6 (0.058) | 91% | 85% | 92% | 70% | 52 c/mm |
| 407 | C-1 | D-7 (0.081) | 103% | 93% | 94% | 67% | 38 c/mm |
| 408 | C-2 | D-31 (0.058) | 105% | 108% | 105% | 82% | 61 c/mm |
| 409 | C-2 | D-3 (0.027) | 97% | 97% | 100% | 79% | 61 c/mm |
| 410 | C-2 | D-4 (0.032) | 98% | 98% | 103% | 80% | 86 c/mm |
| 411 | C-2 | D-32 (0.030) | 98% | 100% | 108% | 89% | 78 c/mm |
| 412 | C-2 | D-33 (0.037) | 90% | 92% | 90% | 69% | 49 c/mm |

As can be seen, elements of the invention containing a variety of DIR compounds all exhibited enhanced sharpness and generally improved resolving power. The specific spatial frequencies enhanced and the degree of enhancement varies with the choice of dye image-forming and DIR coupler compounds. Combinations suitable for specific applications are readily ascertained by those skilled in the art.

EXAMPLE 6

Preparation and Processing of Elements Containing Development Accelerator-Releasing Compounds A. Preparation of elements Samples 501 through 504 were prepared by applying the following layers to a clear support in the order indicated. Quantities of components are expressed in grams per square meter.

Layer 1 (antihalation layer) comprising gray silver and gelatin.

Layer 2 (light sensitive layer) comprising 0.43 g of EM-10, 1.82 g gelatin, image dye forming coupler C-1 at 0.54 g and a development accelerator releasing (DAR) compound as listed in Table 10, below.

Layer 3 (protective layer) comprising 2.15 g of gelatin.

The layers additionally comprised α-(4-nonylphenyl)-ω-hydroxy-poly[oxy(2-hydroxy-1,3-propanediyl] and (para-t-octylphenyl)-di)oxy-1,2-ethanediyl) sulfonate as surfactants.

These films were hardened at coating with 2% by weight to total gelatin of bis(vinylsulfonylmethane).

B. Effect of development accelerator-releasing (DAR) compounds on sensitivity of elements Samples 501 through 504 were exposed to white light through a graduated density test object, then processed using the KODAK ® C-41 process. The bleach used in the process was modified to comprise 1,3-propylenediamine-tetraacetic acid. The relative photographic sensitivities of the samples were then evaluated by determining the exposure required to produce a density of 0.15 above Dmin at a normalized gamma of 1.0.

These values are reported in Table 10.

TABLE 10

Effect on photographic sensitivity produced by development accelerator releasing (DAR) compounds.

| Sample | Image-Forming Coupler | DAR Compound (quantity) | Relative Sensitivity |
|---|---|---|---|
| 501 | C-1 | none | 100.0% |
| 502 | C-1 | C-49 (0.005) | 102.3% |
| 503 | C-1 | C-50 (0.005) | 177.8% |
| 504 | C-1 | C-51 (0.005) | 198.5% |

As can be seen, all of the DAR compounds produced increased photographic sensitivity in elements of the invention. Of course, the amount of increased sensitivity depends on the selection and quantities of the dye image-forming and DAR compounds. Combinations suitable for specific applications are readily ascertained by those skilled in the art. DAR compounds can also be used in combination with other PUG-releasing compounds described elsewhere herein.

EXAMPLE 7

Preparation and Processing of Elements Containing a Bleach Accelerator-Releasing Compound A. Preparation of Elements Samples 505 through 511 were prepared in a manner similar to that used to prepare sample 501 of Example 6, except that the quantity and identity of the bleach accelerator-releasing (BAR) compound indicated in Table 11 was added to the light sensitive layer. Development inhibitor-releasing (DIR) compounds were also added to some samples to further illustrate the practice of the invention.

B. Effect of bleach accelerator-releasing (BAR) compound

Samples 501 and 505–511 were exposed to white light through a graduated density on silver removal from processed elements test object, then processed using the process described in U.S. Pat. No. 4,892,804. The quantity of metallic silver (in grams per square meter) remaining in the processed elements was determined by X-ray fluorescence techniques. These values are reported in Table 11.

TABLE 11

Effect on silver removal produced by a bleach accelerator releasing (BAR) compound.

| Sample | Image-Forming Coupler | BAR Compound (quantity) | DIR Compound (quantity) | Metallic Silver |
|---|---|---|---|---|
| 501 | C-1 | none | none | 0.038 |
| 505 | C-1 | D-28 (0.054) | | |
| 506 | C-1 | none | D-20 (0.054) | 0.214 |
| 507 | C-1 | B-1 (0.054) | D-20 (0.054) | 0.067 |
| 508 | C-1 | none | D-3 (0.054) | 0.250 |
| 509 | C-1 | B-1 (0.054) | D-3 (0.054) | 0.076 |
| 510 | C-1 | none | D-1 (0.054) | 0.025 |
| 511 | C-1 | B-1 (0.054) | D-1 (0.054) | 0.003 |

As can be seen, the BAR compound functions to accelerate the removal of metallic silver deposits which greatly detract from the color quality of images viewed or printed from these films. Especially noteworthy is the capability of the BAR compound to remove silver from elements of the invention that also contain DIR compounds, whose presence typically cause large amounts of metallic silver to remain in processed elements.

EXAMPLE 8

Preparation and Processing of Elements Containing Competing Coupler-Releasing Compounds A. Preparation of elements Samples 512 and 513 were prepared in a manner similar to that used to prepare sample 501 of Example 6, except that the quantities and identities of competing coupler releasing (CCR) compounds indicated in Table 12 were added to the light sensitive layer.

B. Effect of competing coupler-releasing (CCR) compounds on sensitivity and gamma of elements Samples 501, 512, and 513 were exposed to white light through a graduated density test object, then processed using the KODAK ® C-41 process. The bleach used in the process was modified to comprise 1,3-propylenediamine-tetraacetic acid. The relative photographic sensitivities, gammas and maximum densities of the processed elements were determined. These values are reported in Table 12.

TABLE 12

Decreased photographic sensitivity, gamma and density formation enabled by competing coupler releasing (CCR) compounds.

| Sample | Image-Forming Coupler | CCR Compound (quantity) | Sensitivity | Relative Gamma | Density |
|---|---|---|---|---|---|
| 501 | C-1 | none | 100.0% | 100.0% | 100.0% |
| 512 | C-1 | C-46 (0.054) | 97.7% | 94.4% | 97.3% |
| 513 | C-1 | C-47 (0.054) | 95.5% | 86.0% | 89.4% |

As can be seen from the above results, the CCR compounds competitively reacted with oxidized developing agent, thereby reducing sensitivity, density, and gamma in the elements of the invention. The magnitude of these effects depends, of course, on the choice of image-forming and CCR compounds, and the quantities of each employed. Combinations suitable for specific applications are readily ascertained by those skilled in the art. CCR compounds can also be used in combination with other PUG-releasing compounds described elsewhere herein.

EXAMPLE 9

Preparation and Processing of an Element Containing an Electron Transfer Agent-Releasing Compound A. Preparation of Elements Samples 514 and 515 were prepared by applying the following layers to a clear support in the order indicated. Quantities of components are expressed in grams per square meter.

Layer 1 (antihalation layer) comprising gray silver and gelatin.

Layer 2 (light sensitive layer) comprising 0.538 g of EM-5; 1.82 g gelatin; image dye forming coupler C-31 at 0.646 g; DIR compound D-3 at 0.054 g; and compound B-1 at 0.054 g; and, in sample 515, the electron transfer agent-releasing (ETAR) compound C-52 at 0.032 g.

Layer 3 (protective layer) comprising 2.15 g of gelatin.

The layers additionally comprised α-(4-nonylphenyl)-ω-hydroxy-poly[oxy(2-hydroxy-1,3-propanediyl] and (para-t-octylphenyl)-di(oxy-1,2-ethanediyl) sulfonate as surfactants.

These films were hardened at coating with 2% by weight to total gelatin of bis(vinylsulfonylmethane.

B. Effect of an electron transfer agent-releasing (ETAR) compound on sensitivity, gamma, and density of an element Samples 514 and 515 were exposed to white light through a graduated density test object and processed using the KODAK ® C-41 process. The bleach used in the process was modified to comprise 1,3-propylenediamine-tetraacetic acid. The relative sensitivities, gammas, and maximum densities of the processed elements were determined. These values are reported in Table 13.

TABLE 13

Effect on photographic sensitivity, gamma and density formation produced by electron transfer agent releasing (ETAR) compound.

| Sample | Image-Forming Coupler | ETAR Compound (quantity) | Sensitivity | Relative Gamma | Density |
|---|---|---|---|---|---|
| 514 | C-31 | none | 100.0% | 100.0% | 100.0% |
| 515 | C-31 | C-52 (0.032) | 407.4% | 115.1% | 113.8% |

As can be seen, the ETAR compound improved the sensitivity, density, and gamma of the element of the invention containing it. As illustrated in this example, ETAR compounds can also be used in combination with other PUG-releasing compounds described elsewhere herein.

EXAMPLE 10

Preparation and Processing of an Element Containing a Bleach Inhibitor-Releasing Compound A. Preparation of element Sample 516 was prepared in a manner similar to that used to prepare sample 501 of Example 6, except that the quantity and identity of the bleach inhibitor releasing compound indicated in Table 14 was added to the light sensitive layer.

B. Effect of a bleach inhibitor-releasing (BIR) compound on a processed element

Samples 501 and 516 were exposed to white light through a graduated density test object, then processed using the process described in U.S. Pat. No. 4,892,804. The infra-red density and quantity of metallic silver (in grams per square meter) in the samples was determined. These values are reported in Table 14.

TABLE 14

Effect of a bleach inhibitor-releasing (BIR) compound on retention of metallic silver and production of infra-red density in a processed element

| Sample | Image-Forming Coupler | BIR Compound (quantity) | Infra-Red Density | Metallic Silver |
|---|---|---|---|---|
| 501 | C-1 | none | 0.02 | 0.038 |
| 516 | C-1 | D-29 (0.108) | 0.35 | 0.350 |

As can be seen, the BIR compound retarded bleaching in the processed element containing it, thereby enabling the imagewise formation of IR-readable density, which can be employed for applications such as motion picture sound tracks. BIR compounds can also be used in combination with other PUG-releasing compounds described herein.

EXAMPLE 11

Preparation and Testing of Multicolor Multilayer Photographic Elements

A. Preparation of elements

A color photographic element, sample ML-101, was prepared by applying the following layers in the given sequence to a transparent support of cellulose triacetate. The quantities of silver halide are given in g of silver per $m^2$. The quantities of other materials are given in g per $m^2$.

The organic compounds were employed as used as emulsions containing coupler solvents, surfactants and stabilizers or as solutions, both as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxazole and so forth. The silver halide emulsions were stabilized with 4-hydroxy-6-methyl-1,3,3a,7-tetraazaindene.

Layer 1 {Antihalation Layer}: DYE-1 at 0.043 g; DYE-2 at 0.021 g; C-39 at 0.065 g; DYE-6 at 0,215 g; with 2.15 g gelatin.

Layer 2 {Lowest Sensitivity Red-Sensitized Layer}: Red sensitized silver chloride cubic emulsion, average edge length 0.28 μm at 0.215 g; Red sensitized silver chloride {100}-faced tabular emulsion, average equivalent circular diameter 1.2 μm, average grain thickness 0.14 μm at 0.592 g; C-1 at 0.70 g; D-3 at 0.075; with gelatin at 2.04 g.

Layer 3 {Highest Sensitivity Red-Sensitized Layer}: Red sensitized silver chloride {100}-faced tabular emulsion, average equivalent circular diameter 1.4 μm, average grain thickness 0.14 μm at 0.538 g; C-1 at 0.129 g; D-15 at 0.032 g; with gelatin at 2.15 g.

Layer 4 {Interlayer}: 1.29 g of gelatin.

Layer 5 {Lowest Sensitivity Green-Sensitized Layer}: Green sensitized silver chloride cubic emulsion, average edge length 0.28 μm at 0.215 g; green sensitized silver chloride {100}-faced tabular emulsion, average equivalent circular diameter 1.2 μm, average grain thickness 0.14 μm at 0.592 g; C-2 at 0.323 g; D-17 at 0.022 g; with gelatin at 1.72 g.

Layer 6 {Highest Sensitivity Green-Sensitized Layer}: Green sensitized silver chloride {100}-faced tabular emulsion, average equivalent circular diameter 1.4 μm, average grain thickness 0.14 μm at 0.538 g; C-2 at 0.086 g; D-16 at 0.011 g, with gelatin at 1.72 g.

Layer 7 {Interlayer}: 1.29 g of gelatin.

Layer 8 {Lowest Sensitivity Blue-Sensitized Layer}: Blue sensitized silver chloride cubic emulsion, average edge length 0.28 μm at 0.215 g; Blue sensitized silver chloride {100}-faced tabular emulsion, average equivalent circular diameter 1.2 μm, average grain thickness 0.12 μm at 0.215 g; C-3 at 1.08 g; D-18 at 0.065 g; with gelatin at 1.72 g.

Layer 9 {Highest Sensitivity Blue-Sensitized Layer}: Blue sensitized silver chloride {100} faced tabular emulsion, average equivalent circular diameter 1.4 μm, average grain thickness 0.14 μm at 0.323 g; C-3 at 0,129 g; D-18 at 0.043 g; with gelatin at 1.72 g.

Layer 10 {Protective Layer}: DYE-8 at 0.108 g; unsensitized silver bromide Lippman emulsion at 0.108 g; silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 1.61 g.

This film was hardened at coating with 2% by weight to total gelatin of bis-vinylsulfonylmethane. Surfactants, coating aids, scavengers, soluble absorber dyes and stabilizers were added to the various layers of this sample as is commonly practiced in the art. The total dry thickness of the light sensitized layers was about 13.7 μm and the total dry thickness of all the applied layers was about 19.5 μm.

Sample ML-102 was like sample ML-101 except that compound B-1 was added to layer 2 at 0.043 g.

Sample ML-103 was like sample ML-102 except that compound C-42 was added to layer 2 at 0.065 g and layer 3 at 0.043 g; and compound C-40 was added to layer 5 at 0.065 g and layer 6 at 0.043 g.

Sample ML-104 was like sample ML-101 except that compounds D-3, D-15, D-16, D-17 and D-18 were omitted and the following compounds added instead: to layer 2 add 0.075 g of D-4; to layer 3 add 0.032 g of D-1; to layer 5 add 0.032 g of D-1; to layer 6 add 0.011 g of D-1; to layer 8 add 0.065 g of D-7; and to layer 9 add 0.043 g of D-7.

Sample ML-105 was like sample ML-104 except that compound B-1 was added to layer 2 at 0.043 g.

Sample ML-107 was like sample ML-104 except that the quantity of silver chloride emulsions in layers 2, 3, 5 and 6 was doubled and the quantities of compounds D-1 and D-4 in these layers was also doubled.

Sample ML-108 was like sample ML-101 except that the quantity of silver chloride emulsions in layers 2, 3, 5 and 6 was doubled and the quantities of compounds D-3, D-15, D-16 and D-17 in these layers was also doubled. This change added about 1.0 μm to the film thickness.

Samples ML-201–205 and ML-207–208 were prepared analogously to samples ML-101–105 and ML-107–108, except that the silver chloride emulsions were replaced in the light sensitive layers by sensitized silver iodobromide emulsions comprising about 3.7 mole percent iodide as follows:

in Layer 2: Red sensitized silver iodobromide emulsion average equivalent circular diameter 0.5 μm, average thickness 0.08 μm at 0.215 g; Red sensitized silver iodobromide emulsion, average equivalent circular diameter 1.0 μm, average grain thickness 0.09 μm.

in Layer 3: (ML-201–205 and ML-207–208) Red sensitized silver iodobromide emulsion, average equivalent circular diameter 1.2 μm, average grain thickness 0.13 μm at 0.538 g.

Layer 5: Green sensitized silver iodobromide emulsion, average equivalent circular diameter 0.5 μm, average grain thickness 0.09 μm at 0.215 g; green sensitized silver iodobromide emulsion, average equivalent circular diameter 1.0 μm , average grain thickness 0.09 μm at 0.592 g.

in Layer 6: Green sensitized silver iodobromide emulsion, average equivalent circular diameter 1.2 μm, average grain thickness 0.13 μm at 0.538 g.

in Layer 8: Blue sensitized silver iodobromide emulsion, average equivalent circular diameter 0.5 μm, average grain thickness 0.08 at 0,215 g; Blue sensitized silver iodobromide emulsion, average equivalent circular diameter 1.05 μm, average grain thickness 0.11 μm at 0.215 g.

in Layer 9: Blue sensitized silver iodobromide emulsion, average equivalent circular diameter 1.35 μm, average grain thickness 0.13 μm at 0.323 g.

B. Density measurements of exposed and processed elements

The samples were exposed to white light through a graduated density test object, then processed using the KODAK ® C-41 process. The bleach used in the process was modified to comprise 1,3-propylenediaminetetraacetic acid.

The Status M density produced in an unexposed and undeveloped area of each sample was measured after processing. The Status M density produced after processing at an exposure level ten stops (i.e. 3.0 log E) higher than the ISO speed-point was measured. The ISO speed-point is the exposure required to produce a Status M density 0.15 above Dmin. The difference in density production was calculated by subtraction. The difference represents the density production of each sample. The values are shown in Table 15.

TABLE 15

| Status M density production. | | | |
|---|---|---|---|
| Sample | Red Density | Green Density | Blue Density |
| ML-101 invention | 2.27 | 2.23 | 2.00 |
| ML-201 control | 1.37 | 1.88 | 2.53 |
| ML-102 invention | 2.33 | 2.26 | 1.95 |
| ML-202 control | 1.67 | 2.01 | 2.70 |
| ML-103 invention | 2.43 | 2.31 | 1.64 |
| ML-203 control | 1.74 | 2.01 | 2.38 |
| ML-104 invention | 1.87 | 2.21 | 2.54 |
| ML-204 control | 1.45 | 2.07 | 2.78 |
| ML-105 invention | 1.93 | 2.27 | 2.59 |
| ML-205 control | 1.60 | 2.17 | 2.74 |
| ML-107 invention | 2.17 | 2.17 | 2.78 |
| ML-207 control | 1.60 | 2.27 | 2.89 |
| ML-108 invention | 2.81 | 2.19 | 2.69 |
| ML-208 control | 1.33 | 1.87 | 2.36 |

As can be seen, the density producing ability of multilayer, multicolor elements of the invention generally equaled or exceeded that of otherwise similar control samples that contain silver iodobromide emulsions. Additionally, the elements prepared in accordance with the invention produced more uniform density production in the three color records than did the control samples. This greater uniformity in density formation is presumably attributable to improved development in the underlying red-sensitized layers in the elements of the invention relative to those in the control elements. This decreased dependence of dye density formation in a particular layer on the position of that layer in the element is an important benefit of the invention.

C. Measurement of photo-abrasion and pressure-desensitization effects

The pressure and abrasion sensitivities of samples ML-101–105 and ML-207–208 were evaluated by subjecting portions of each sample to ca. 42 psi ($2.9\times10^5$ pascals) pressure in a roller apparatus fitted with a sandblasted steel wheel. The indentations and ridges on the sandblasted wheel mimic the effect of dirt particles or other imperfections on, for example, film transport mechanisms in cameras and so forth.

Both pressured and unpressured portions of each sample were exposed to white light through a graduated density test object. The samples were then processed using the KODAK ® C-41 process. The bleach used in the process was modified to comprise 1,3-propylenediamine-tetraacetic acid.

The magnitude of the pressure-fog effect was quantified by comparing the blue Status M Dmin of an unpressured portion of each sample to that of a pressured portion of the same sample. The increase in density caused by the abrasive wheel is the pressure-fog or photo-abrasion. Smaller values of pressure-fog are superior in that they indicate that a particular film composition is less susceptible to forming unsightly marks and blemishes due, for example, to dirt or to imperfections in film transport apparatus during use. This indicates improved quality for prints made from such a color film.

In a related test, the samples were separately evaluated for pressure-desensitization by subjecting portions of each sample to ca. 25 psi ($1.7\times10^5$ pascals) pressure in a roller apparatus fitted with a polished wheel. These samples were exposed and processed as just described and the maximum difference in blue Status M density between a pressure and an unpressured sample was noted. The pressure from the polished wheel mimics the effect of compression on the film sample, as for example, occurs during spooling and tightly winding a film or during transport on a tightly fitting, clean roller mechanism. Compression tends to cause emulsion desensitization or density loss. Large density losses in a taking film are to be avoided since they result in unsightly marks and blemishes in a print made from such a film. For this reason small values of pressure-desensitization are desirable.

Results of these photo-abrasion and pressure-desensitization test are listed in Table 16.

TABLE 16

Photo-abrasion and pressure-desensitization results. Changes in Blue Status M Dmin

| Sample | Photo-Abrasion | Pressure-Desensitization |
|---|---|---|
| ML-101 invention | +0.06 | −0.04 |
| ML-201 control | +0.19 | −0.02 |
| ML-102 invention | +0.05 | −0.02 |
| ML-202 control | +0.20 | −0.02 |
| ML-103 invention | +0.04 | −0.02 |
| ML-203 control | +0.15 | −0.03 |
| ML-104 invention | +0.06 | −0.02 |
| ML-204 control | +0.12 | −0.04 |
| ML-105 invention | +0.06 | −0.02 |
| ML-205 control | +0.12 | −0.02 |
| ML-107 invention | +0.05 | −0.02 |
| ML-207 control | +0.14 | −0.02 |
| ML-108 invention | +0.04 | −0.02 |
| ML-208 control | +0.16 | −0.04 |

As can be seen, the samples prepared according to the invention showed little pressure-desensitization and exhibited greatly improved resistance to photo-abrasion when compared to control samples employing similarly sized silver iodobromide emulsions.

D. Measurement of effects of masking couplers 1. Use of a cyan dye-forming, preformed magenta dye-releasing coupler Photographic samples ML-102 and ML-103 were exposed to light through a graduated density test object and a KODAK WRATTEN 29 filter. This arrangement enables a red-light separation exposure. The samples were then processed using the KODAK® C-41 process. The bleach used in the process was modified to comprise 1,3-propylenediamine-tetraacetic acid The change in green Status M density as a function of red-light exposure between Dmin and Dmax was measured This change in green density is shown in Table 17.

TABLE 17

Change in green density as a function of red-light exposure.

| Sample | Masking Coupler | Change in Green Density |
|---|---|---|
| ML-102 | none | +0.39 |
| ML-103 | C-42 | +0.15 |

Sample ML-103, which incorporates the masking coupler, showed improved color separation properties; the undesired green density associated with exposure and development of the red light sensitized layers was reduced by the presence of the masking coupler C-42 in sample ML-103.

2. Use of a magenta dye-forming, preformed yellow dye-releasing coupler

Photographic samples ML-102 and ML-103 were exposed to light through a graduated density test object and a KODAK WRATTEN 74 filter. This arrangement enables a green-light separation exposure. The samples were then processed using the KODAK® C-41 process. The bleach used in the process was modified to comprise 1,3-propylenediamine-tetraacetic acid. The change in blue Status M density as a function of green-light exposure between Dmin and Dmax was measured. This change in blue density is listed in Table 18.

TABLE 18

Change in blue density as a function of green-light exposure.

| Sample | Masking Coupler | Change in Blue Density |
|---|---|---|
| ML-102 | none | +0.39 |
| ML-103 | C-40 | +0.15 |

Sample ML-103, which incorporates the masking coupler, showed improved color separation properties; the undesired blue density associated with exposure and development of the green light sensitized layers was reduced by the presence of the masking coupler C-40 in sample ML-103.

E. Color reversal processing

Photographic sample ML-101 was exposed to white light through a graduated density test object and processed according to the KODAK® E-6 reversal film process.

A reversal image suitable for direct viewing was formed.

EXAMPLE 12

Preparation and Testing of Multicolor Multilayer Photographic Elements

A. Preparation of elements

A color photographic element, sample ML-301, was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents, surfactants and stabilizers or as solutions both as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargylaminobenzoxazole and so forth. The silver halide emulsions were stabilized with 2 grams of 4-hydroxy-6-methyl-1,3,3a,7-tetraazaindene per mole of silver.

Layer 1 {Antihalation Layer}: grey silver at 0.323 g with 2.44 g gelatin.

Layer 2 {Lowest Sensitivity Red-Sensitized Layer}: Red sensitized silver iodobromide emulsion, ca. 4 mole percent iodide, average equivalent circular diameter 0.5 μm, average grain thickness 0.08 μm at 0.269 g; red sensitized silver iodobromide emulsion, ca. 3.7 mole percent iodide, average equivalent circular diameter 1.0 μm, average grain thickness 0.09 μm at 0.538 g; C-1 at 0.70 g; D-3 at 0.075; with gelatin at 2.04 g.

Layer 3 {Highest Sensitivity Red-Sensitized Layer}: Red sensitized silver iodobromide emulsion, ca. 3.7 mole percent iodide, average equivalent circular diameter 1.2 μm, average grain thickness 0.12 μm at 0.538 g; C-1 at 0.129 g; D-3 at 0.065 g; with gelatin at 2.15 g.

Layer 4 {Interlayer}: 1.29 g of gelatin.

Layer 5 {Lowest Sensitivity Green-Sensitized Layer}: Green sensitized silver iodobromide emulsion, ca. 4 mole percent iodide, average equivalent circular diameter 0.5 μm, average grain thickness 0.08 μm at 0.269 g; green sensitized silver iodobromide emulsion, ca. 3.7 mole percent iodide, average equivalent circular diameter 1.0 μm, average grain thickness 0.09 μm at 0.538 g; C-2 at 0.323 g; D-2 at 0.108 g; with gelatin at 2.15 g.

Layer 6 {Highest Sensitivity Green-Sensitized Layer}: Green sensitized silver iodobromide emulsion, ca. 3.7 mole percent iodide, average equivalent circular diameter 1.2 μm, average grain thickness 0.12 μm at 0.538 g; magenta dye-forming image coupler C-2 at 0.086 g; DIR compound D-16 at 0.065 g, with gelatin at 1.72 g.

Layer 7 {Interlayer}: 1.29 g of gelatin.

Layer 8 {Lowest Sensitivity Blue-Sensitized Layer}: Blue sensitized silver iodobromide emulsion, ca. 4 mole percent iodide, average grain thickness 0.5 μm, average grain thickness 0.08 μm at 0.161 g; blue sensitized silver iodobromide emulsion, ca. 3.7 mole percent iodide, average equivalent circular diameter 0.72 μm, average grain thickness 0.09 μm at 0.269 g; C-3 at 1.08 g; D-8 at 0.065 g; with gelatin at 1.72 g.

Layer 9 {Highest Sensitivity Blue-Sensitized Layer}: Blue sensitized silver iodobromide emulsion, ca. 9 mole percent iodide, average equivalent circular diameter 1.3 μm at 0.646 g; C-3 at 0.129 g; D-8 at 0.043 g; with gelatin at 1.72 g.

Layer 10 {Protective Layer-1}: DYE-8 at 0.108 g; DYE-9 at 0.161 g; unsensitized silver bromide Lippman emulsion at 0.108 g; N,N,N-trimethyl-N-(2-perfluoro-octylsulfonamido-ethyl) ammonium iodide; sodium tri-isopropylnaphthalene sulfonate; and gelatin at 0.54 g.

Layer 11 {Protective Layer-2}: silicone lubricant at 0.026 g; tetraethylammonium perfluoro-octanesulfonate; t-octylphenoxyethoxyethylsulfonic acid sodium salt; anti-matte polymethylmethacrylate beads at 0.0538 g; and gelatin at 0.54 g.

This film was hardened at coating with 2% by weight to total gelatin of bis-vinylsulfonylmethane. Surfactants, coating aids, scavengers, soluble absorber dyes and stabilizers were added to the various layers of this sample as is commonly practiced in the art. The total dry thickness of the light sensitized layers was about 16.4 μm while the total dry thickness of all the applied layers was about 21.7 μm.

Sample ML-302 was like sample ML-301 except that the silver iodobromide emulsions were removed from layers 8 and 9 and replaced with equal weights of silver chloride emulsions as follows:

to Layer 8: cubic blue sensitized silver chloride emulsion, average edge length 0.28 μm, at 0.43 g.

to Layer 9: cubic blue sensitized silver chloride emulsion, average edge length 0.6 μm at 0.646 g.

Photographic sample ML-303 was like photographic sample ML-301 except that the silver iodobromide emulsions were removed from layers 8 and 9 and replaced with equal weights of silver chloride emulsions as follows:

to Layer 8: {100}-faced tabular blue sensitized silver chloride emulsion, average equivalent circular diameter 1.2 μm, average grain thickness 0.14 μm at 0.43 g.

to Layer 9: {100}-faced tabular blue sensitized silver chloride emulsion, average equivalent circular diameter 1.4 μm, average grain thickness 0.14 μm at 0.646 g.

B. Measurement of film optics in underlying layers of processed elements

Samples ML-301, ML-302 and ML-303 were exposed to sinusoidal patterns of white light to determine the Modulation Transfer Function (MTF) Percent Response as a function of spatial frequency in the film plane. The samples were then processed using the KODAK® C-41 process. The bleach used in the process was modified to comprise 1,3-propylenediaminetetraacetic acid. The exposed and processed samples were evaluated to determine the MTF Percent Response as a function of spatial frequency in the film plane. Specific details of this exposure—evaluation cycle can be found in R. L. Lamberts and F. C. Eisen, "A System for the Automatic Evaluation of Modulation Transfer Functions of Photographic Materials", in the Journal of Applied Photographic Engineering, vol. 6, pages 1–8, February 1980. A more general description of the determination and meaning of MTF Percent Response curves can be found in the articles cited within this reference.

The MTF Percent Response of the green and red light sensitized layers of these multilayer, multicolor films was monitored and the spatial frequency at which the MTF Percent Response dropped to 50% was noted. Higher spatial frequencies indicate a film with superior resolving power. Also listed is the average MTF percent response of the combined red and green color records. The results of this test are listed in Table 19.

TABLE 19

Resolving power as a function of emulsion type in overlying layers.

| Sample | Emulsions in Blue Light Sensitized Layers | Spatial Frequency (c/mm) at 50% MTF Response | | Underlying Layer Average MTF % Response | |
|---|---|---|---|---|---|
| | | Green | Red | @ 10 c/mm | @ 15 c/mm |
| ML-301 | Tabular AgIBr | 58 | 42 | 114% | 112% |
| ML-302 | Cubic AgCl | 43 | 38 | 113% | 108% |
| ML- | {100}-faced | 62 | 58 | 116% | 118% |

TABLE 19-continued

| | |
|---|---|
| 303 | Tabular AgCl |

Samples ML-301 through ML-303 are identical except for the morphology and iodide content of the emulsions incorporated in the blue light sensitized layers. In these samples, the blue light sensitized layer is closer to an exposure source than are the green light or red light sensitized layers. Incorporation of sensitized {100}-faced tabular AgCl emulsions in the blue light sensitized layers in accordance with the present invention greatly improved the resolving power of the underlying layers, as can be seen by comparison with the results from the control elements containing either a cubic silver chloride emulsion or a tabular silver iodobromide emulsion in the overlying blue sensitized layers. The MTF percent response at low spatial frequencies is also greatly improved.

EXAMPLE 13

Preparation and Testing of Multicolor Multilayer Photographic Elements with Inverted Structures A. Preparation of elements A color photographic element, sample ML-401, was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents,surfactants and stabilizers or as solutions both as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargylaminobenzoxazole and so forth. The silver halide emulsions were stabilized with 2 grams of 4-hydroxy-6-methyl-1,3,3a,7-tetraazaindene per mole of silver.

Layer 1-(AHU) {Antihalation Layer}: DYE-1 at 0.043 g; DYE-2 at 0.021 g; C-39 at 0.065 g; DYE-6 at 0.215 g; with 2.15 g gelatin.

Layer 2-(SY) {Lowest Sensitivity Blue-Sensitized Layer}: Blue sensitized silver chloride {100}-faced tabular emulsion, average equivalent circular diameter 1.2 μm, average grain thickness 0.12 μm at 0.43 g; yellow dye-forming image coupler C-3 at 1.08 g; D-18 at 0.108 g; with gelatin at 1.72 g.

Layer 3-(FY) {Highest Sensitivity Blue-Sensitized Layer}: Blue sensitized silver chloride {100} faced tabular emulsion, average equivalent circular diameter 1.4 μm, average grain thickness 0.14 μm at 0.646 g; yellow dye-forming image coupler C-3 at 0.129 g; D-18 at 0.086 g; with gelatin at 1.72 g.

Layer 4-(IL) {Interlayer}: 1.29 g of gelatin.

Layer 5-(SC) {Lowest Sensitivity Red-Sensitized Layer}: Red sensitized silver chloride {100}-faced tabular emulsion, average equivalent circular diameter 1.2 μm, average grain thickness 0.12 μm at 0.807 g; cyan dye-forming image coupler C-1 at 0.70 g; D-15 at 0.043; with gelatin at 1.08 g.

Layer 6-(FC) {Highest Sensitivity Red-Sensitized Layer}: Red sensitized silver chloride {100}-faced tabular emulsion, average equivalent circular diameter 1.4 μm, average grain thickness 0.14 μm at 0.538 g; cyan dye-forming image coupler C-1 at 0.129 g; D-15 at 0.048 g; with gelatin at 1.08 g.

Layer 7-(IL) {Interlayer}: 1.29 g of gelatin.

Layer 8-(SM) {Lowest Sensitivity Green-Sensitized Layer}: Green sensitized silver chloride {100}-faced tabular emulsion, average equivalent circular diameter 1.2 μm, average grain thickness 0.12 μm at 0.807 g; magenta dye-forming image coupler C-2 at 0.323 g; D-17 at 0.065 g; with gelatin at 2.15 g.

Layer 9-(FM) {Highest Sensitivity Green-Sensitized Layer}: Green sensitized silver chloride {100}-faced tabular emulsion, average equivalent circular diameter 1.4 μm, average grain thickness 0.14 μm at 0.538 g; magenta dye-forming image coupler C-2 at 0.086 g; D-16 at 0.032 g, with gelatin at 1.72 g.

Layer 10-(OC) {Protective Layer}: DYE-8 at 0.108 g; DYE-9 at 0.118 g; unsensitized silver bromide Lippman emulsion at 0.108 g; silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 1.99 g.

This film was hardened at coating with 2% by weight to total gelatin of bis-vinylsulfonylmethane. Surfactants, coating aids, scavengers, soluble absorber dyes and stabilizers were added to the various layers of this sample as is commonly practiced in the art. The total dry thickness of the light sensitized layers was about 10.5 μm while the total dry thickness of all of the applied layers was about 16.8 m. The layer order sequence of sample ML-401 was thus: support, AHU, SY, FY, IL, SC, FC, IL, SM, FM, OC.

Sample ML-402 was like sample ML-401 except that compound C-40 was added to layer 8-(SM) at 0.065 g and to layer 9-(FM) at 0.043 g.

Sample ML-403 was like sample ML-401 except that compound C-43 was added to layer 8-(SM) at 0.091 g and to layer 9-(FM) at 0.059 g. The quantities of C-43 were equimolar to those of the C-40 used in ML-402.

Sample ML-404 was prepared by applying the layers employed in sample 401 to the support in the sequence AHU, SC, FC, IL, SM, FM, IL, SY, FY, OC, as follows:

Layer 1-(AHU) {Antihalation Layer}: DYE-1 at 0.043 g; DYE-2 at 0.021 g; C-39 at 0.065 g; DYE-6 at 0.215 g; with 2.15 g gelatin.

Layer 2-(SC) {Lowest Sensitivity Red-Sensitized Layer}: Red sensitized silver chloride {100}-faced tabular emulsion, average equivalent circular diameter 1.2 μm, average grain thickness 0.12 μm at 0.807 g; cyan dye-forming image coupler C-1 at 0.70 g; D-15 at 0.043; with gelatin at 1.08 g.

Layer 3-(FC) {Highest Sensitivity Red-Sensitized Layer}: Red sensitized silver chloride {100}-faced tabular emulsion, average equivalent circular diameter 1.4 μm, average grain thickness 0.14 μm at 0.538 g; cyan dye-forming image coupler C-1 at 0.129 g; D-15 at 0.048 g; with gelatin at 1.08 g.

Layer 4 {Interlayer}: 1.29 g of gelatin.

Layer 5-(SM) {Lowest Sensitivity Green-Sensitized Layer}: Green sensitized silver chloride {100}-faced tabular emulsion, average equivalent circular diameter 1.2 μm, average grain thickness 0.12 μm at 0.807 g; magenta dye-forming image coupler C-2 at 0.323 g; D-17 at 0.065 g; with gelatin at 2.15 g.

Layer 6-(FM) {Highest Sensitivity Green-Sensitized Layer}: Green sensitized silver chloride {100}-faced tabular emulsion, average equivalent circular diameter 1.4 μm, average grain thickness 0.14 μm at 0.538 g; magenta dye-forming image coupler C-2 at 0.086 g; D-16 at 0.032 g, with gelatin at 1.72 g.

Layer 7-(IL) {Interlayer}: 1.29 g of gelatin.

Layer 8-(SY) {Lowest Sensitivity Blue-Sensitized Layer}: Blue sensitized silver chloride {100}-faced tabular emulsion, average equivalent circular diameter 1.2 μm, average grain thickness 0.12 μm at 0.43 g; yellow dye-forming image coupler C-3 at 1.08 g; D-18 at 0.108 g; with gelatin at 1.72 g.

Layer 9-(FY) {Highest Sensitivity Blue-Sensitized Layer}: Blue sensitized silver chloride {100} faced tabular emulsion, average equivalent circular diameter 1.4 μm, average grain thickness 0.14 μm at 0.646 g; yellow dye-forming image coupler C-3 at 0.129 g; D-18 at 0.086 g; with gelatin at 1.72 g.

Layer 10-(OC) {Protective Layer}: DYE-8 at 0.108 g; DYE-9 at 0.118 g; unsensitized silver bromide Lippman emulsion at 0.108 g; silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 1.99 g.

Sample ML-405 was like sample ML-404 except that compound C-42 was added to layer 2-(SC) at 0.065 g and layer 3-(FC) at 0.043 g; and compound C-40 was added to layer 5-(SM) at 0.065 g and layer 6-(FM) at 0.043 g.

B. Measurement of effects of masking couplers

A comparison was made of results from elements containing two different magenta dye-forming masking couplers, one (C-40) containing a preformed yellow dye, the other (C-43) containing a blocked dye that became yellow only after processing.

Samples ML-401 through ML-403 were exposed to light through a graduated density test object and a KODAK WRATTEN 74 filter. This arrangement enables a green-light separation exposure. The samples were then processed using the KODAK® C-41 process. The bleach used in the process was modified to comprise 1,3-propylenediamine-tetraacetic acid. The change in blue Status M density as a function of green-light exposure between a Dmin and Dmax was measured. This change in blue density is listed in Table 20, below. The samples were additionally exposed to white light through a graduated density test object and the relative blue light sensitivity of the blue light sensitized layer monitored. These values are also listed in Table 20.

TABLE 20

Change in blue density as a function of green-light exposure and change in blue speed TABLE 20-continued

| Sample | Masking Coupler | Change in Blue Density | Change in Blue Sensitivity |
|---|---|---|---|
| ML-401 | none | +0.31 | 100.0% |
| ML-402 | C-40 | +0.15 | 38.9% |
| ML-403 | C-43 | +0.14 | 61.7% |

as a function of white light exposure.

Samples ML-402 and ML-403, which incorporate masking couplers, showed improved color separation properties; the undesired blue density associated with exposure and development of the green light sensitive layers is reduced by the presence of the masking coupler C-40 in ML-402 and C-43 in ML-403. It is also apparent that the blue light sensitivity was substantially improved by the blocked and shifted masking function provided by C-43, compared with the conventional masking function provided by C-40. ML-403 thus exhibited a more desirable combination of blue speed and color reproduction.

C. Effect of layer order on film optics in underlying red light sensitized layer Samples ML-401 through ML-405 contain {100}-faced tabular silver iodobromide emulsion in all of the light sensitive layers. Samples ML-404 and ML405 have a normal layer order for color films incorporating silver iodobromide emulsions, i.e., the blue light sensitized layer is closer to the exposure source than are the green or red light sensitized layers. This layer order is normal for silver iodobromide emulsion films because the silver iodobromide emulsions are all sensitive to blue light, and good color separation is best obtained when a yellow colored filter layer is interposed between the layers spectrally sensitized to green or red light and the exposure source. The layers intended to be exposed by blue light are then positioned closer to the exposure source than is the yellow filter layer. Since silver chloride emulsions have little intrinsic sensitivity to blue light, this layer order is longer necessary. Samples ML-401 through 403 employ an inverted layer order in which the emulsion layers spectrally sensitized to blue light are positioned further from the exposure source than are the emulsion layers spectrally sensitized to green or red light. The resolving power of the red light sensitized layer is improved by removing the light scattering film components associated with the blue light sensitized layer from the exposure light path for the red sensitized layer. This is demonstrated as described below.

Samples ML-401 through ML-405 were exposed to sinusoidal patterns of white light to determine the Modulation Transfer Function (MTF) Percent Response as a function of spatial frequency in the film plane. The samples were then processed using the KODAK® C-41 process. The bleach used in the process was modified so as to comprise 1,3-propylenediamine-tetraacetic acid. The exposed and processed samples were evaluated to determine the MTF Percent Response as a function of spatial frequency in the film plane. Specific details of this exposure—evaluation cycle can be found in the previously mentioned paper by R. L. Lamberts and F. C. Eisen.

The MTF Percent Response of the red light sensitized layers of these multicolor multi layer films was monitored, and the spatial frequency at which the MTF Percent Response dropped to 50% was noted. Higher spatial frequencies indicate a film with superior resolving power. The results of this test are listed in Table 21.

TABLE 21

| Red resolving power of normal and inverted inverted layer order films. | | |
|---|---|---|
| Sample | Layer Order | Spatial Frequency (c/mm) at 50% MTF Response Red layer |
| ML-401 | inverted | 50 |
| ML-402 | inverted | 52 |
| ML-403 | inverted | 51 |
| ML-404 | normal | 32 |
| ML-405 | normal | 38 |

As is readily apparent, the film samples with inverted layer order exhibited excellent resolving power.

D. Measurement of photoabrasion effects

Samples ML-401 through ML-405 were evaluated for pressure-fog or photoabrasion sensitivity as previously described in example 11-C.

The results of this evaluation are shown in Table 22, below. Smaller values of photo-abrasion indicate a film composition that is less sensitized to pressure events encountered during manufacture and use, for example, pressure from rollers used to transport film during manufacture and in cameras. The resulting pressure marks cause unsightly blemishes in the final image.

TABLE 22

| Photoabrasion in the red, green and blue sensitized layers of elements. Changes in Status M Dmin | | | |
|---|---|---|---|
| Sample | Red | Green | Blue |
| ML-401 | +0.06 | +0.06 | +0.04 |
| ML-402 | +0.06 | +0.07 | +0.03 |
| ML-403 | +0.06 | +0.05 | +0.02 |
| ML-404 | +0.04 | +0.04 | +0.06 |
| ML-405 | +0.04 | +0.04 | +0.05 |

As can be readily seen, all of these samples showed extremely low sensitivity to pressure-fog, or photoabrasion.

EXAMPLE 14

Preparation and Testing of Multicolor Multilayer Photographic Elements

A. Preparation of elements

A color photographic element, sample ML-501, was prepared by applying the following layers in the given sequence to a transparent support of cellulose triacetate. The quantities of silver halide are given in g of silver per $m^2$ The quantities of other materials are given in g per $m^2$.

The organic compounds were used as emulsions containing coupler solvents, surfactants and stabilizers or used as solutions both as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-( 2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxazole and so forth The silver halide emulsions were stabilized with 2 grams of 4-hydroxy-6-methyl-1,3,3a,7-tetraazaindene per mole of silver.

Layer 1 {Antihalation Layer}: DYE-1 at 0.043 g; DYE-2 at 0.021 g; C-39 at 0.065 g; DYE-6 at 0.215 g; with 2.15 g gelatin.

Layer 2 {Lowest Sensitivity Red-Sensitized Layer}: Red sensitized silver chloride {100} -faced tabular emulsion, average equivalent circular diameter 1.2 μm, average grain thickness 0.12 μm at 0.807 g; cyan dye-forming image coupler C-1 at 0.70 g; D-3 at 0.075; with gelatin at 2.04 g.

Layer 3 {Highest Sensitivity Red-Sensitized Layer}: Red sensitized silver chloride {100}-faced tabular emulsion, average equivalent circular diameter 1.4 μm, average grain thickness 0.14 μm at 0.538 g; cyan dye-forming image coupler C-1 at 0.129 g; D-15 at 0.048 g; with gelatin at 2.15 g.

Layer 4 {Interlayer}: 1.29 g of gelatin.

Layer 5 {Lowest Sensitivity Green-Sensitized Layer}: Green sensitized silver chloride {100} -faced tabular emulsion, average equivalent circular diameter 1.2 μm, average grain thickness 0.12 μm at 0.807 g; magenta dye-forming image coupler C-2 at 0.323 g; D-17 at 0.065 g; with gelatin at 2.15 g.

Layer 6 {Highest Sensitivity Green-Sensitized Layer}: Green sensitized silver chloride {100}-faced tabular emulsion, average equivalent circular diameter 1.4 μm, average grain thickness 0.14 μm at 0.538 g; magenta dye-forming image coupler C-2 at 0.086 g; D-16 at 0.032 g, with gelatin at 1.72 g.

Layer 7 {Interlayer}: 1.29 g of gelatin.

Layer 8 {Lowest Sensitivity Blue-Sensitized Layer}: Blue sensitized silver chloride {100}-faced tabular emulsion, average equivalent circular diameter 1.2 μm, average grain thickness 0.12 μm at 0.43 g; yellow dye-forming image coupler C-3 at 1.08 g; D-18 at 0.108 g; with gelatin at 1.72 g.

Layer 9 {Highest Sensitivity Blue-Sensitized Layer}: Blue sensitized silver chloride {100} faced tabular emulsion, average equivalent circular diameter 1.4 μm, average grain thickness 0.14 μm at 0.646 g; yellow dye-forming image coupler C-3 at 0.129 g; D-18 at 0.086 g; with gelatin at 1.72 g.

Layer 10 {Protective Layer}: DYE-8 at 0.108 g; unsensitized silver bromide Lippman emulsion at 0.108 g; silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 1.61 g.

This film was hardened at coating with 2% by weight to total gelatin of bis-vinylsulfonylmethane. Surfactants, coating aids, scavengers, soluble absorber dyes and stabilizers were added to the various layers of this sample as is commonly practiced in the art. The total dry thickness of the light sensitized layers was about 14.4 μm while the total dry thickness of all of the applied layers was about 20.2 μm.

Sample ML-502 was like sample ML-501 except that compound B-1 was added to layer 2 at 0.043 g.

Sample ML-503 was like sample ML-502 except that compound C-42 was added to layer 2 at 0.065 g and layer 3 at 0.043 g; and compound C-40 was added to layer 5 at 0.065 g and layer 6 at 0.043 g.

Sample ML-504 was like sample ML-501 except that compounds D-3, D-15 and D-18 were omitted and the following compounds added instead: to layer 2 add 0.075 g of D-4; to layer 3 add 0.048 g of D-1; to layer 8 add 0.108 g of D-7; and to layer 9 add 0.086 g of D-7.

Sample ML-505 was like sample ML-504 except that compound B-1 was added to layer 2 at 0.043 g.

Sample ML-506 was like sample ML-505 except that compound C-42 was added to layer 2 at 0.065 g and layer 3 at 0.043 g; and compound C-40 was added to layer 5 at 0.065 g and layer 6 at 0.043 g.

Sample ML-507 was like sample ML-504 except that the quantity of silver chloride emulsions in layers 2, 3, 5 and 6 was doubled and the quantities of compounds D-1, D-4, D-16 and D-17 in these layers was also doubled. These changes add about 1.1 μm to the total dry thickness.

Sample ML-508 was like sample ML-501 except that the quantity of silver chloride emulsions in layers 2, 3, 5 and 6 was doubled and the quantities of compounds D-3, D-15, D-16 and D-17 in these layers was also doubled.

B. Density measurements of exposed and processed elements

The samples were exposed to white light through a graduated density test object, then processed using the KODAK ® C-41 process. The bleach used in the process was modified to comprise 1,3-propylenediamine-tetraacetic acid.

The Status M density produced in a Dmin area of each sample was measured after processing. The Status M density produced after processing at an exposure level ten stops (i.e. 3.0 log E) higher than the ISO speed-point was measured. The ISO speed-point is the exposure required to produce a Status M density 0.15 above Dmin. The difference in density production between Dmin and Dmax was calculated by subtraction. The difference represents the useful imaging density range of each sample. The Dmin or photographic fog density and the useful imaging density are shown in Table 23.

TABLE 23

Status M fog density and useful imaging density.

| | Red Density | | Green Density | | Blue Density | |
|---|---|---|---|---|---|---|
| Sample | fog | image | fog | image | fog | image |
| ML-501 | 0.03 | 1.66 | 0.11 | 2.18 | 0.14 | 2.82 |
| ML-502 | 0.04 | 2.25 | 0.11 | 2.33 | 0.14 | 2.87 |
| ML-503 | 0.06 | 2.37 | 0.14 | 2.33 | 0.14 | 2.58 |
| ML-504 | 0.02 | 2.01 | 0.10 | 2.30 | 0.07 | 2.96 |
| ML-505 | 0.04 | 2.06 | 0.12 | 2.32 | 0.09 | 2.91 |
| ML-506 | 0.05 | 2.20 | 0.14 | 2.46 | 0.08 | 2.73 |
| ML-507 | 0.04 | 2.35 | 0.15 | 2.47 | 0.07 | 3.01 |
| ML-508 | 0.06 | 2.90 | 0.15 | 1.96 | 0.11 | 2.91 |
| Commercial 100 speed film | 0.09 | 1.69 | 0.17 | 1.96 | 0.10 | 2.37 |

As can be readily appreciated, the useful imaging densities of multilayer, multicolor elements prepared according to the invention equaled or exceeded that of a comparative commercial 100 speed film sample that utilizes silver iodobromide emulsions, while the fog values were lower, resulting in improved image—fog discrimination. Additionally, the samples prepared in accordance with the invention produced more uniform density production in the three color records than does the commercial film sample.

C. Measurement of effects of masking couplers. 1. Use of a cyan dye-forming, preformed magenta dye-releasing coupler Samples ML-502, ML-503, ML-505 and ML-506 were exposed light through a graduated density test object and a KODAK WRATTEN 29 filter. This arrangement enables a red-light separation exposure. The samples were then processed using the KODAK ® C-41 process. The bleach used in the process was modified to comprise 1,3-propylenediamine-tetraacetic acid The change in green Status M density as a function of red-light exposure between a Dmin and Dmax was measured. This change in green density is shown in Table 24.

TABLE 24

Change in green density as a function of red-light exposure.

| Sample | Masking Coupler | Change in Green Density |
|---|---|---|
| ML-502 | none | +0.42 |
| ML-503 | C-42 | +0.18 |
| ML-505 | none | +0.38 |
| ML-506 | C-42 | +0.15 |

Samples ML-503 and ML-506, which incorporate the masking coupler, showed improved color separation properties; the undesired green density associated with exposure and development of the red light sensitized layers was reduced by the presence of the masking coupler C-42 in samples ML-503 and ML-506.

2. Use of a magenta dye-forming, preformed yellow dye-releasing coupler

Samples ML-502, ML-503, ML-505 and ML-506 were exposed light through a graduated density test object and a KODAK WRATTEN 74 filter. This arrangement enables a green-light separation exposure. The samples were then processed using the KODAK ® C-41 process. The bleach used in the process was modified to comprise 1,3-propylenediamine-tetraacetic acid. The change in blue Status M density as a function of green-light exposure between Dmin and Dmax was measured. This change in blue density is shown in Table 25.

TABLE 25

Change in blue density as a function of green-light exposure.

| Sample | Masking Coupler | Change in Blue Density |
|---|---|---|
| ML-502 | none | +0.47 |
| ML-503 | C-40 | +0.22 |
| ML-505 | none | +0.49 |
| ML-506 | C-40 | +0.25 |

Samples ML-503 and ML-506, which incorporate the masking coupler, showed improved color separation properties; the undesired blue density associated with exposure and development of the green light sensitized layers was reduced.

D. Interimage effects induced by solubilized thiol releasing compounds.

Samples ML-501, ML-502, ML-504, ML-505 were exposed to white light or to red light using a KODAK WRATTEN 29 filter through a graduated density test object The samples were then processed using the KODAK® C-41 process. The bleach used in the process was modified to comprise 1,3-propylenediamine-tetraacetic acid.

The gamma of the cyan image formed in the red light sensitized element of the samples under both exposure conditions was then determined. The ratio of the red density gamma formed after a red light exposure divided by the red density gamma formed after a white light exposure is a measure of the onto red interimage effects caused by development inhibiting products of development released in the green light and blue light sensitized elements during their development. These products are not released from the green and blue light sensitized layers in the case of a red light exposure and process but are released in the case of a white light exposure and process. In these film samples, the development inhibiting products released are the development inhibitors released from the DIR compounds purposefully added to the green and blue light sensitized layers. Larger values of the gamma ratio thus determined are indicative of greater degrees of color saturation in print made from such a negative. Solubilized aliphatic thiol releasing compounds (compound B-1 is an example of such a solubilized thiol releasing compound) are known to interfere with the inhibition reaction between development inhibitors and of silver iodobromide emulsions. The samples evaluated in this test differ only in the presence or absence of compound B-1 The results of this evaluation are shown in Table 26.

TABLE 26

Gamma ratio of red and white light exposures.

| Sample | Compound B-1 in layer 2 | Red Gamma Ratio |
|---|---|---|
| ML-501 | no | 1.30 |
| ML-502 | yes | 1.07 |
| ML-504 | no | 1.03 |
| ML-505 | yes | 0.98 |

As can be seen, color saturation can be substantially suppressed in elements of the invention upon addition of a compound capable of releasing a solubilized aliphatic thiol.

E. Interimage effects induced by development inhibitor releasing (DIR) compounds Samples ML-501, ML-504, ML-507, ML-508 and a commercial 100 speed color negative film containing silver iodobromide emulsions were exposed to white light or to red light using a KODAK WRATTEN 29 filter through a graduated density test object. The samples were then processed using the KODAK® process. The bleach used in the process was modified to comprise 1,3-propylenediamine-tetraacetic acid.

The gamma of the cyan image formed in the red light sensitized element of the samples under both exposure conditions was then determined. The ratio of the red density gamma formed after a red light exposure divided by the red density gamma formed after a white light exposure is a measure of the onto red interimage effects caused by development inhibiting products of development released in the green light and blue light sensitized elements during their development. These products are not released from the green and blue light sensitized layers in the case of a red light exposure and process but are released in the case of a white light exposure and process. In these film samples, the development inhibiting products released are the development inhibitors released from the DIR compounds purposefully added to the green and blue light sensitized layers. Larger values of the gamma ratio thus determined are indicative of greater degrees of color saturation in print made from such a negative. The results of this evaluation are shown in Table 27.

TABLE 27

Gamma ratio of red and white light exposures.

| Sample | Red Gamma Ratio |
|---|---|
| ML-501 | 1.30 |
| ML-504 | 1.03 |
| ML-507 | 1.10 |
| ML-508 | 1.32 |
| Commercial 100 Speed Film | 1.30 |

As can be seen, substantial color saturation can be achieved in elements of the invention. It will also be appreciated that, depending on the choice of DIR compound employed and the details of the structure of the elements, greater or lesser color saturation can be achieved as desired.

EXAMPLE 15

Preparation and Testing of Multicolor Multilayer Photographic Elements

A. Preparation of elements

A color photographic element, sample ML-601, was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents, surfactants and stabilizers or as solutions as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargylaminobenzoxazole and so forth. The silver halide emulsions were stabilized with 2 grams of 4-hydroxy-6-methyl-1,3,3a,7-tetraazaindene per mole of silver.

Layer 1 {Antihalation Layer}: DYE-1 at 0.011 g; DYE-2 at 0.013 g; C-39 at 0.065 g; DYE-6 at 0.108 g; DYE-9 at 0.075 g; gray colloidal silver at 0.215 g; SOL-1 at 0.005; SOL-2 at 0.005 g; with 2.41 g gelatin.

Layer 2 {Interlayer}: 0.108 g of S-1; with 1.08 g of gelatin.

Layer 3 {Lowest Sensitivity Red-Sensitized Layer}: Red sensitized silver iodobromide emulsion, ca. 4 mole percent iodide, average equivalent circular diameter 0.5 μm, average thickness 0.08 μm at 0.538 g; C-1 at 0.753 g; D-15 at 0.022 g; C-42 at 0.054 g; B-1 at 0.043 g; S-2 at 0.005 g; with gelatin at 1.72 g.

Layer 4 {Medium Sensitivity Red-Sensitized Layer}: Red sensitized silver iodobromide emulsion, ca. 3.7 mole percent iodide, average equivalent circular diameter 1.0 μm, average grain thickness 0.09 μm at 0.592 g; C-1 at 0.097 g; D-15 at 0.022 g; C-42 at 0.032 g; D-17 at 0.005 g; S-2 at 0.005 g; with gelatin at 1.72 g.

Layer 5 {Highest Sensitivity Red-Sensitized Layer}: Red sensitized silver iodobromide emulsion, ca. 3.7 mole percent iodide, average equivalent circular diameter 1.2 μm, average grain thickness 0.13 μm at 0.592 g; 0.538 g; C-1 at 0.086 g; D-15 at 0.022 g; C-42 at 0.022 g; D-17 at 0.016 g; S-2 at 0.005 g; with gelatin at 1.72 g.

Layer 6 {Interlayer}: S-1 at 0.054 g with 1.29 g of gelatin.

Layer 7 {Lowest Sensitivity Green-Sensitized Layer}: Green sensitized silver iodobromide emulsion, ca. 4 mole percent iodide, average equivalent circular diameter 0.57 μm, average grain thickness 0.14 μm at 0.603 g; C-2 at 0.355 g; D-17 at 0.011 g; C-40 at 0.043 g; S-2 at 0.005 g; with gelatin at 1.4 g.

Layer 8 {Medium Sensitivity Green-Sensitized Layer}: Green sensitized silver iodobromide emulsion, ca. 3.7 mole percent iodide, average equivalent circular diameter 0.85 μm, average grain thickness 0.12 at 0.592 g; C-2 at 0.086 g; D-17 at 0.016 g; C-40 at 0.038 g; S-2 at 0.005 g; with gelatin at 1.4 g.

Layer 9 {Highest Sensitivity Green-Sensitized Layer}: Green sensitized silver iodobromide emulsion, average equivalent circular diameter 1.05 μm, average grain thickness 0.12 μm at 0.592 g; C-2 at 0.086 g; D-16 at 0.005 g; C-40 at 0.038 g; S-2 at 0.005 g; with gelatin at 1.72 g.

Layer 10 {Interlayer}: S-1 at 0.054 g; DYE-9 at 0.108 g; DYE-7 at 0.108 g; with 1.29 g of gelatin.

Layer 11 {Lowest Sensitivity Blue-Sensitized Layer}: Blue sensitized silver iodobromide emulsion, ca. 4 mole percent iodide, average equivalent circular diameter 0.5 μm, average grain thickness 0.08 at 0.172 g; Blue sensitized silver iodobromide emulsion, ca. 3.7 mole percent iodide, average equivalent circular diameter 0.70 μm, average grain thickness 0.09 μm at 0.172 g; C-3 at 1.08 g; D-18 at 0.065 g; B-1 at 0.005 g; S-2 at 0.011 g; with gelatin at 1.08 g.

Layer 12 {Highest Sensitivity Blue-Sensitized Layer}: Blue sensitized silver iodobromide emulsion, ca. 3 mole percent iodide, average equivalent circular diameter 0.8 μm, average grain thickness 0.08 μm at 0.43 g; C-3 at 0.129 g; D-18 at 0.043 g; B-1 at 0.005 g; S-2 at 0.011 g; with gelatin at 1.13 g.

Layer 13 {Protective Layer-1}: DYE-8 at 0.118 g; unsensitized silver bromide Lippman emulsion at 0.108 g; N,N,N,-trimethyl-N-(2-perfluorooctylsulfonamido-ethyl) ammonium iodide; sodium tri-isopropylnaphthalene sulfonate; SOL-Cl at 0.043 g; DYE-1 at 0.006 g; and gelatin at 1.08 g.

Layer 14 {Protective Layer-2}: silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 0.91 g.

This film was hardened at coating with 2% by weight to total gelatin of bis-vinylsulfonylmethane. Surfactants, coating aids, scavengers, soluble absorber dyes and stabilizers were added to the various layers of this sample as is commonly practiced in the art. The total dry thickness of the light sensitized layers was about 15.1 μm, while the total thickness of all the applied layers was about 23.1 μm.

Sample ML-602 was like sample ML-601 except that the silver iodobromide emulsions in layers 11 and 12 (the two blue light sensitized layers) were replaced by equimolar quantities of cubic blue sensitized silver chloride emulsions, as follows:

to layer 11 add a blue sensitized silver chloride cubic emulsion with average edge length of 0.28 μm at 0.344 g;

to layer 12 add a blue sensitized silver chloride cubic emulsion with average edge length 0.6 μm at 0.43 g.

Sample ML-603 was like sample ML-601 except that the silver iodobromide emulsions in layers 11 and 12 (the two blue light sensitized layers) were replaced by equimolar quantities of {100}-faced tabular blue sensitized silver chloride emulsions, as follows:

to layer 11 add a blue sensitized silver chloride {100}-faced tabular emulsion with average equivalent circular diameter of 1.2 μm and average grain thickness of 0.14 μm at 0.344 g;

to layer 12 add a blue sensitized silver chloride {100}-faced tabular emulsion with average equivalent circular diameter of 1.4 μm and average grain thickness of 0.14 μm at 0.43 g.

B. Measurement of film optics in underlying layers of processed elements

Samples ML-601, ML-602 and ML-603 were exposed to sinusoidal patterns of white light to determine the Modulation Transfer Function (MTF) Percent Response as a function of spatial frequency in the film plane. The samples were then processed using the KODAK® C-41 process. The bleach used in the process was modified to comprise 1,3-propylenediamine-tetraacetic acid. The exposed and processed samples were evaluated to determine the MTF Percent Response as a function of spatial frequency in the film plane. Specific details of this exposure—evaluation cycle can be found in the previously mentioned paper by R. L. Lamberts and F. C. Eisen.

The MTF Percent Response of the green and red light sensitized layers of these multilayer, multicolor films was monitored and the spatial frequency at which the MTF Percent Response dropped to 50% was noted. Higher spatial frequencies indicate a film with superior resolving power. The results of this test are listed in Table 28, below.

The front surface reflection of the film samples as a function of the wavelength of reflected light was also determined. The quantity of light reflected at 600 nm from the front surface of a film sample can be important when the film is intended for use in an auto-exposure camera that utilizes a light reflection monitoring scheme to measure scene illuminance as part of the automatic exposure control sequence. These values are also reported in Table 28.

TABLE 28

Resolving power and percent reflected light at 600 nm as a function of emulsion type in overlying layers.

| Sample | Emulsions in Blue Sensitized layer | Spatial Frequency (c/mm) at 50% MTF Response Green | Red | Reflection at 600 nm |
|---|---|---|---|---|
| ML-601 | Tabular AgIBr | 70 | 41 | 31% |
| ML-602 | Cubic AgCl | 62 | 38 | 26% |
| ML-603 | {100}-faced Tabular AgCl | >80 | 48 | 25% |

Samples ML-601 through ML-603 are identical except for the morphology and iodide content of the emulsions incorporated in the blue light sensitized layers. In these samples the blue light sensitized layer is closer to an exposure source that are the green light or red light sensitized layers. Incorporation of sensitized {100}-faced tabular AgCl emulsions in the blue light sensitized layers in accordance with the present invention greatly improved the resolving power of the underlying layers, as can be seen by comparison with the results from the control elements containing either a cubic silver chloride emulsion or a tabular shaped silver iodobromide emulsion in the overlying blue sensitized layers. Lowered front surface reflection also resulted from the use of the {100}-faced tabular AgCl emulsions.

EXAMPLE 16

Preparation and Testing of Multicolor Multilayer Photographic Elements

A. Preparation of elements

A color photographic element, sample ML-701, was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents, surfactants and stabilizers or used as solutions both as commonly practiced in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxazole and so forth. The silver halide emulsions were stabilized with 2 grams of 4-hydroxy-6-methyl-1,3,3a,7-tetraazaindene per mole of silver.

Layer 1 {Antihalation Layer}: DYE-1 at 0.011 g; DYE-3 at 0.011 g; C-39 at 0.065 g; DYE-6 at 0.108 g; DYE-9 at 0.075g; gray colloidal silver at 0.215 g; SOL-1 at 0.005; SOL-2 at 0.005 g; with 2.41 g gelatin.

Layer 2 {Interlayer}: 0.108 g of S-1; B-1 at 0.022 g; with 1.08 g of gelatin.

Layer 3 {Lowest Sensitivity Red-Sensitized Layer}: Red sensitized silver chloride {100}-faced tabular emulsion, average equivalent circular diameter 1.2 μm, average thickness 0.12 μm at 0.538 g; C-1 at 0.538 g; D-15 at 0.011g; C-42 at 0.054 g; D-3 at 0.054 g; C-41 at 0.032 g; S-2 at 0.005 g; with gelatin at 1.72 g.

Layer 4 {Medium Sensitivity Red-Sensitized Layer}: Red sensitized silver chloride {100} -faced tabular emulsion, average equivalent circular diameter 1.5 μm, average grain thickness 0.14 μm at 0.592 g; C-1 at 0.075 g; D-15 at 0.011 g; C-42 at 0.032 g; D-17 at 0.032 g; C-41 at 0.022 g; S-2 at 0.005 g; with gelatin at 1.72 g.

Layer 5 {Highest Sensitivity Red-Sensitized Layer}: Red sensitized silver chloride {100}-faced tabular emulsion, average equivalent circular diameter 2.2 μm, average grain thickness 0.12 μm at 0.592 g; C-1 at 0.075 g; D-15 at 0.011 g; C-42 at 0.022 g; D-17 at 0.032 g; C-41 at 0.011 g; S-2 at 0.005 g; with gelatin at 1.72 g.

Layer 6 {Interlayer}: S-1 at 0.054 g; D-25 at 0.032 g; with 1.08 g of gelatin.

Layer 7 {Lowest Sensitivity Green-Sensitized Layer}: Green sensitized silver chloride {100}-faced tabular emulsion, average equivalent circular diameter 1.2 μm, average grain thickness 0.12 μm at 0.484 g; C-2 at 0.355 g; D-17 at 0.022 g; C-40 at 0.043 g; D-8 at 0.022 g; S-2 at 0.011 g; with gelatin at 1.13 g.

Layer 8 {Medium Sensitivity Green-Sensitized Layer}: Green sensitized silver chloride {100}-faced tabular emulsion, average equivalent circular diameter 1.5 μm, average grain thickness 0.14 μm at 0.592 g; C-2 at 0.086 g; D-17 at 0.022 g; C-40 at 0.038 g; S-2 at 0.011 g; with gelatin at 1.4 g.

Layer 9 {Highest Sensitivity Green-Sensitized Layer}: Green sensitized silver chloride {100}-faced tabular emulsion, average equivalent circular diameter 2.2 μm, average grain thickness 0.12 μm at 0.592 g; C-2 at 0.075 g; D-16 at 0.022 g; C-40 at 0.038 g; D-7 at 0.022 g; S-2 at 0.011 g; with gelatin at 1.35 g.

Layer 10 {Interlayer}: S-1 at 0.054 g; DYE-7 at 0.108 g; with 0.97 g of gelatin.

Layer 11 {Lowest Sensitivity Blue-Sensitized Layer}: Blue sensitized silver chloride cubic emulsion, average edge length 0.28 μm, at 0.344 g; C-3 at 1.08 g; D-18 at 0.065 g; D-19 at 0.065 g; B-1 at 0.005 g; S-2 at 0.011 g; with gelatin at 1.34 g.

Layer 12 {Highest Sensitivity Blue-Sensitized Layer}: Blue sensitized silver chloride cubic emulsion, average edge length 0.6 μm, at 0.43 g; C-3 at 0.108 g; D-18 at 0.043 g; B-1 at 0.005 g; S-2 at 0.011 g; with gelatin at 1.13 g.

Layer 13 {Protective Layer-1}: DYE-8 at 0.054 g; DYE-9 at 0.108 g; DYE-10 at 0.054 g; unsensitized silver bromide Lippman emulsion at 0.108 g; N,N,N,-trimethyl-N-(2-perfluoro-octylsulfonamidoethyl) ammonium iodide; sodium tri-isopropylnaphthalene sulfonate; SOL-$C_1$ at 0.043 g; and gelatin at 1.08 g.

Layer 14 {Protective Layer-2}: silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 0.91 g.

This film was hardened at coating with 2% by weight to total gelatin of bis-vinylsulfonylmethane. Surfactants, coating aids, scavengers, soluble absorber dyes and stabilizers were added to the various layers of this sample as is commonly practiced in the art. The total dry thickness of the light sensitized layers was about 12.1 μm while the total dry thickness of all the applied layers was about 20.5 μm.

Sample ML-702 was like sample ML-701 except that the silver chloride cubic emulsions were omitted from in layers 11 and 12 (the two blue light sensitized layers) and replaced by equimolar quantities of {100}-faced tabular blue sensitized silver chloride emulsions, as follows:

to layer 11 add a blue sensitized silver chloride {100}-faced tabular emulsion with average equivalent circular diameter of 1.2 μm and average grain thickness of 0.12 μm at 0.172 g; and a blue sensitized silver chloride {100}-faced tabular emulsion with average equivalent circular diameter of 1.5 μm and average grain thickness of 0.14 μm at 0.172 g;

to layer 12 add a blue sensitized silver chloride {100}-faced tabular emulsion with average equivalent circular diameter of 2.2 μm and average grain thickness of 0.12 μm at 0.43 g.

Sample ML-703 was like sample ML-702 except that coupler C-3 was omitted from layers 11 and 12 and replaced with an equal quantity of coupler C-29, as follows:

to layer 11 add 1.076 g of C-29; and
to layer 12 add 0.108 g of C-29.

Sample ML-704 was like sample ML-703 except that coupler C-2 was omitted from layers 7, 8 and 9 and replaced by coupler C-18, as follows:

to layer 7 add 0.71 g of C-18;
to layer 8 add 0.172 g of C-18; and
to layer 9 add 0.151 g of C-18.

Sample ML-705 was like sample ML-703 except that coupler C-2 was omitted from layers 7, 8 and 9 and replaced by couplers C-15 and C-16, as follows:

to layer 7 add 0.16 g of C-15 and 0.16 g of C-16;
to layer 8 add 0.039 g of C-15 and 0.039 g of C-16; and
to layer 9 add 0.033 g of C-15 and 0.033 g of C-16.

Sample ML-706 was like sample ML-703 except that coupler C-2 was omitted from layers 7, 8 and 9 and replaced by coupler C-15, as follows:

to layer 7 add 0.32 g of C-15;
to layer 8 add 0.077 g of C-15; and
to layer 9 add 0.068 g of C-15.

Sample ML-707 was like sample ML-706 except that 0.006 g of DYE-2 was added to layer 13; 0.065 g of BA-1 was added to layer 1.

Sample ML1-708 was like sample ML-706 except that 0.006 g of DYE-2 was added to layer 13; 0.258 g of BA-2 was added to layer 1.

B. Measurement of film optics in underlying layers of processed elements

Samples ML-701 through ML-708 as well as a sample of a commercial 100 speed color negative film comprising silver iodobromide emulsions in the light sensitized layers were exposed to sinusoidal patterns of white light and then developed according to the Kodak® C-41 Process. The sinusoidal patterns were evaluated to determine the MTF percent response as described in Example 14.

The MTF percent response of the red light sensitized layers of these multilayer, multicolor films was monitored and the spatial frequency at which the MTF percent response dropped to 50 percent was noted. Higher spatial frequencies indicate a film with superior resolving power. The results of this test are shown in Table 29.

TABLE 29

Resolving power in red light sensitized layers

| Sample | Emulsion in Blue-Sensitized Layer | Spatial Frequency (c/mm) at 50% MTF Response Red-Sensitized Layer |
|---|---|---|
| ML-701 | Cubic AgCl | 25 |
| ML-702 | {100} tabular AgCl | 33 |
| ML-703 | {100} tabular AgCl | 34 |
| ML-704 | {100} tabular AgCl | 33 |
| ML-705 | {100} tabular AgCl | 35 |
| ML-706 | {100} tabular AgCl | 31 |
| ML-707 | {100} tabular AgCl (plus red absorber dye BA-1 in Layer 1) | 38 |
| ML-708 | {100} tabular AgCl (plus red absorber dye BA-2 in Layer 1) | 38 |
| Commercial 100 speed film | AgIBr | 22 |

As is readily apparent, use of {100} tabular AgCl emulsions in overlying layers in accordance with the present invention provided improved resolving power in underlying layers relative to that attainable using either cubic silver chloride emulsions or silver iodobromide emulsions. The resolving power was further improved by employing red light absorbing dyes in the antihalation layer.

C. Measurement of spark sensitivity of elements

Samples ML-701 through ML-708 as well as a sample of a commercial 100 speed color negative film comprising silver iodobromide emulsions in the radiation sensitive layers were exposed through the base to a spark discharge providing ultraviolet and visible light, then developed in the Kodak® C-41 process with a modified bleach containing 1,3-propylenediamine-tetraacetic acid. The relative speeds to white and ultraviolet light of the red layers of the elements employing silver chloride tabular emulsions in accordance with the invention and the control sample employing silver iodobromide emulsions were then compared. The elements of the invention showed, when adjusted to comparable visible light sensitivity, a lowered sensitivity to ultraviolet light of about 100-fold (ca. 10 log E), indicative of spark and static discharge properties that are superior to those of the control sample.

The invention has been described in detail with particular reference to preferred embodiments thereof, but it will be understood that variations and modifications can be effected within the spirit and scope of the invention.

What is claimed is:

1. A color photographic element comprised of a support and, coated on the support, at least one unit containing a radiation sensitive emulsion layer comprised of a dispersing medium and silver halide grains and, in reactive association with the emulsion layer, an image-dye forming compound, where (A) within at least one emulsion layer at least 50 percent of total grain projected area is accounted for by tabular grains (a) bounded by {100} major faces having adjacent edge ratios of less than 10, (b) each having an aspect ratio of at least 2, and (c) internally at their nucleation site containing iodide and at least 50 mole percent chloride and (B) in reactive association with said one emulsion layer, a development inhibitor releasing compound that contains a development inhibitor group and is capable of reacting with oxidized developing agent thereby to release such group.

2. A color photographic element according to claim 1 wherein the average aspect ratio is at least 5.

3. A color photographic element according to claim 1 wherein the average aspect ratio is greater than 8.

4. A color photographic element according to claim 1 wherein the edge ratios are less than 5.

5. A color photographic element according to claim 1 wherein the edge ratios are less than 2.

6. A color photographic element according to claim 1 wherein the tabular grains have thicknesses of less than 0.3 μm.

7. A color photographic element according to claim 1 wherein the tabular grains have thicknesses of less than 0.2 μm.

8. A color photographic element according to claim 1 wherein the tabular grains have thicknesses of less than 0.06 μm.

9. A color photographic element according to claim 1 wherein the tabular grains contain at least 70 mole percent chloride.

10. A color photographic element according to claim 1 wherein the tabular grains contain at least 90 mole percent chloride.

11. A color photographic element according to claim 10 wherein the tabular grains are silver iodochloride grains.

12. A color photographic element according to claim 1 wherein the compound that contains the development inhibitor is a coupler.

13. A color photographic element according to claim 1 wherein the development inhibitor is a mercaptotetrazole, mercaptooxadiazole or a mercaptothiadiazole.

14. A color photographic element according to claim 1 wherein the development inhibitor is a benzotriazole or a tetrazole.

15. A color photographic element according to claim 1 additionally comprised of a bleach accelerator, a development accelerator, a competing coupler, an electron transfer agent, or a bleach inhibitor.

16. A color photographic element according to claim 1 wherein the developing agent is a p-phenylenediamine developing agent.

17. A color photographic element according to claim 1 wherein said one emulsion layer is blue-sensitized.

18. A color photographic element according to claim 1 comprised of a red-sensitized unit containing at least one silver halide emulsion layer, a green-sensitized unit containing at least one silver halide emulsion layer and a blue-sensitized unit containing at least one silver halide emulsion layer, wherein at least one of these emulsion layers contains the tabular grains bounded by {100} major faces.

19. A color photographic element according to claim 18 wherein at least one of the silver halide emulsion layers that contains tabular silver halide grains bounded by {100} major faces is blue-sensitized.

20. A color photographic element according to claim 18 wherein at least one of the silver halide emulsion layers that contains tabular silver halide grains bounded by }100} major faces is red-sensitized.

* * * * *